US006269300B1

(12) United States Patent
Moore-McKee et al.

(10) Patent No.: US 6,269,300 B1
(45) Date of Patent: Jul. 31, 2001

(54) METHOD FOR PRODUCING PRODUCTION CONTROL SOFTWARE FOR A NATURAL GAS OR DIESEL ENGINE CONTROLLER

(75) Inventors: Amy L. Moore-McKee, Varna; William Schubert, Peoria, both of IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 08/412,504

(22) Filed: Mar. 29, 1995

(51) Int. Cl.[7] ..... G06G 7/70; F02M 21/02

(52) U.S. Cl. ..... 701/102; 701/115; 701/29; 123/27 GE; 123/526; 123/527; 395/922; 395/703

(58) Field of Search ..... 364/431.06, 431.04, 364/431.12, 431.02, 431.01, 431.05, 424.01, 424.03, 424.04, 423.098, 424.036, 424.037, 424.039, 550, 551.01, 146, 147, 187, 191, 468.15, 468.06, 474.16, 551.02, 474.24, 468.17, 468.01, 468.24, 468.02; 123/526, 527, 27 GE, 490, 321, 452, 459, 486, 480, 479; 395/50, 61, 76, 900, 800, 650, 905, 911, 616, 919, 922, 703, 508

(56) References Cited

U.S. PATENT DOCUMENTS

| | | | | |
|---|---|---|---|---|
| 4,125,101 | * | 11/1978 | Garcia et al. | 123/452 |
| 4,291,383 | * | 9/1981 | Tedeschi et al. | 364/431.04 |
| 4,614,168 | * | 9/1986 | Batchelor | 123/527 |
| 4,841,441 | | 6/1989 | Nixon et al. | 395/50 |
| 4,924,418 | | 5/1990 | Bachman et al. | 364/550 |
| 4,996,643 | | 2/1991 | Sakamoto et al. | 364/424.037 |
| 5,023,800 | | 6/1991 | Carver et al. | 364/474.24 |
| 5,067,129 | | 11/1991 | Evans et al. | 371/25.1 |
| 5,070,534 | | 12/1991 | Lascelles et al. | 395/348 |
| 5,084,813 | | 1/1992 | Ono | 395/703 |
| 5,119,479 | | 6/1992 | Arai et al. | 395/887 |
| 5,142,469 | | 8/1992 | Weisenborn | 364/146 |
| 5,212,645 | | 5/1993 | Wildes et al. | 364/468.15 |
| 5,224,457 | * | 7/1993 | Arsenault et al. | 123/526 |
| 5,247,446 | * | 9/1993 | Motz et al. | 364/431.12 |
| 5,251,122 | | 10/1993 | Sakamoto et al. | 364/147 |
| 5,255,197 | | 10/1993 | Iida | 364/468.15 |
| 5,263,164 | | 11/1993 | Kannady et al. | 395/651 |
| 5,270,918 | | 12/1993 | Seki et al. | 364/191 |
| 5,278,759 | * | 1/1994 | Berra et al. | 364/424.01 |
| 5,284,116 | * | 2/1994 | Richardson, Jr. | 364/431.12 |
| 5,285,392 | | 2/1994 | Kyle et al. | 364/468.06 |
| 5,293,317 | * | 3/1994 | Adrian et al. | 364/431.01 |
| 5,293,553 | * | 3/1994 | Dudek et al. | 364/431.01 |
| 5,295,222 | | 3/1994 | Wadhwa et al. | 395/703 |
| 5,301,103 | | 4/1994 | Sakamoto et al. | 364/184 |
| 5,318,449 | | 6/1994 | Schoell et al. | 434/305 |
| 5,370,097 | * | 12/1994 | Davis | 123/526 |
| 5,398,724 | * | 3/1995 | Vars et al. | 123/490 |
| 5,404,852 | * | 4/1995 | Fränkle | 123/321 |
| 5,426,585 | | 6/1995 | Stepper et al. | 364/571.01 |
| 5,491,631 | * | 2/1996 | Shirane et al. | 364/424.03 |
| 5,523,948 | * | 6/1996 | Adrian | 364/431.12 |

* cited by examiner

*Primary Examiner*—Jacques H. Louis-Jacques
(74) *Attorney, Agent, or Firm*—James R. Yee; David M. Masterson; Steve G. Kibby

(57) ABSTRACT

A method of operating a computer to automatically produce production control software for a natural gas engine controller or a diesel engine controller is provided. The method includes the steps of (1) as a function of user input, defining a set specifications of the controller; and (2) producing control software to operate the controller as defined by the specifications.

24 Claims, 71 Drawing Sheets

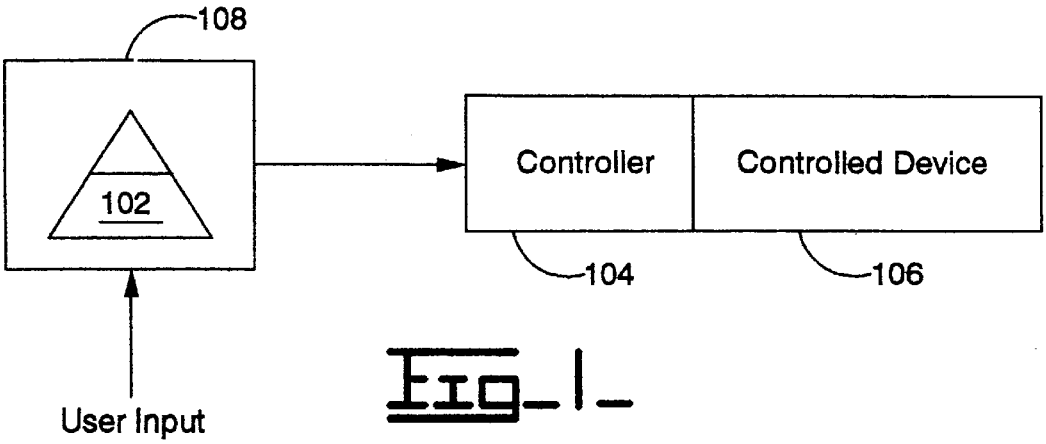
Fig_1_
Fig_2_
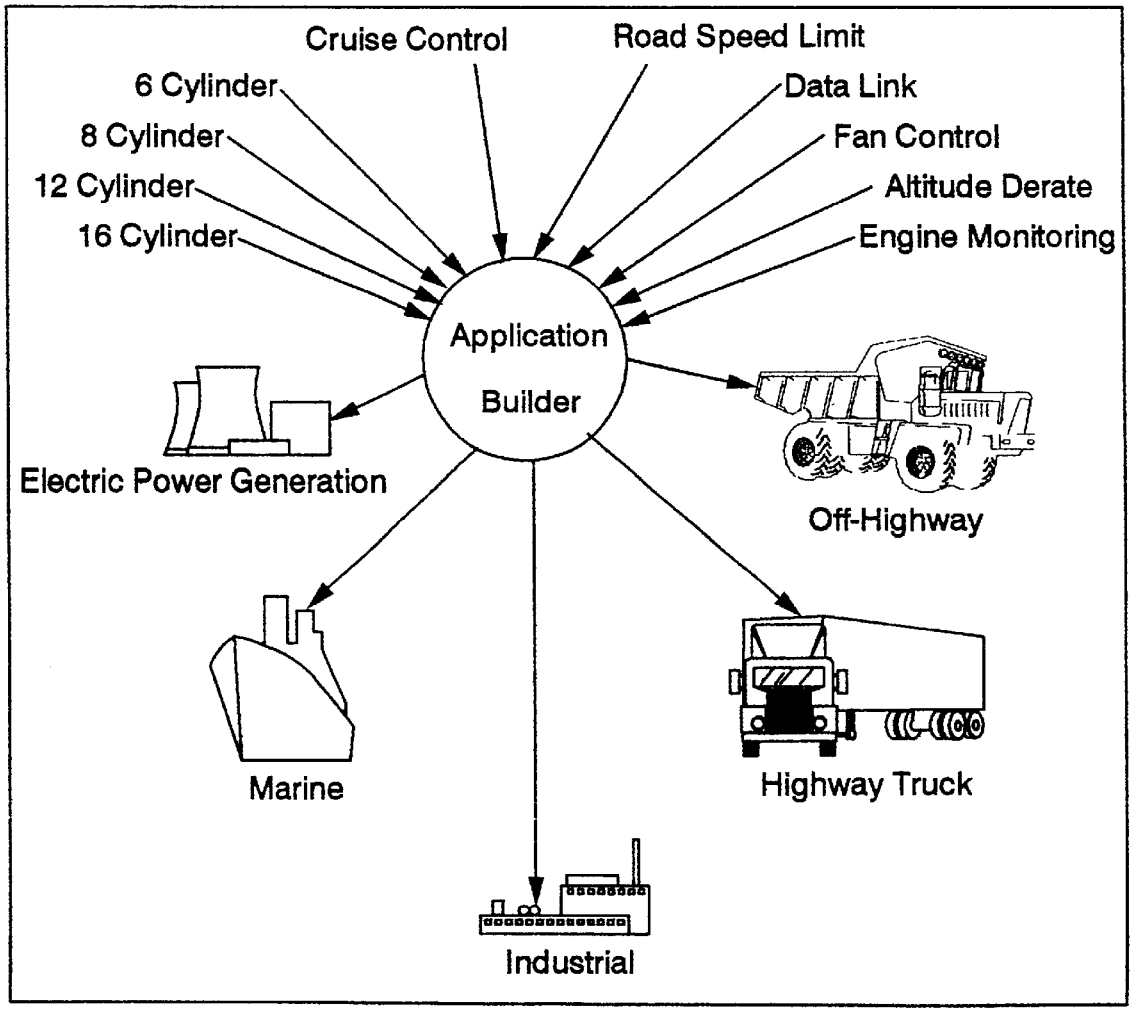

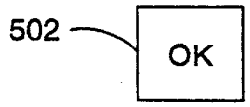
Fig_5_
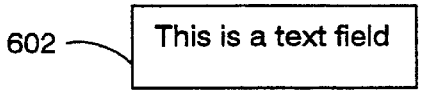
Fig_6_
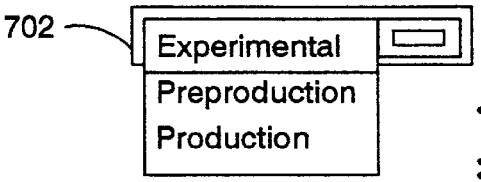
Fig_7_
Fig_8_
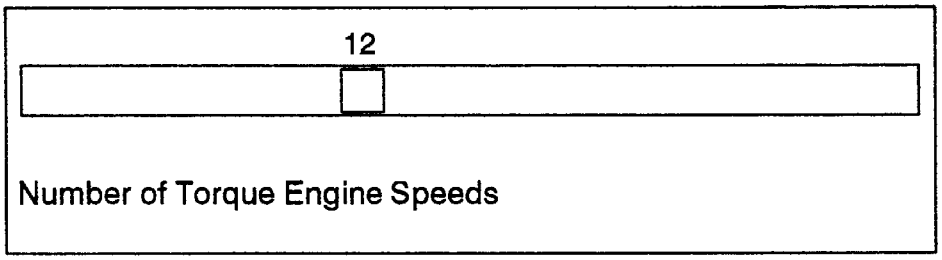
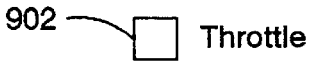
Fig_9_
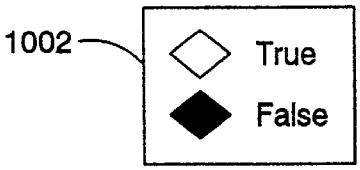
Fig_10_
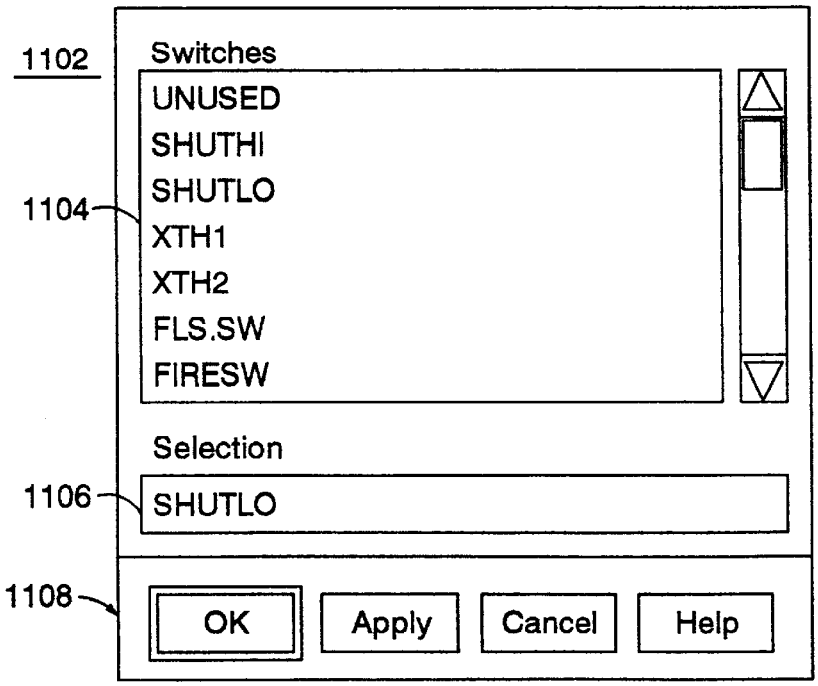
Fig_11_

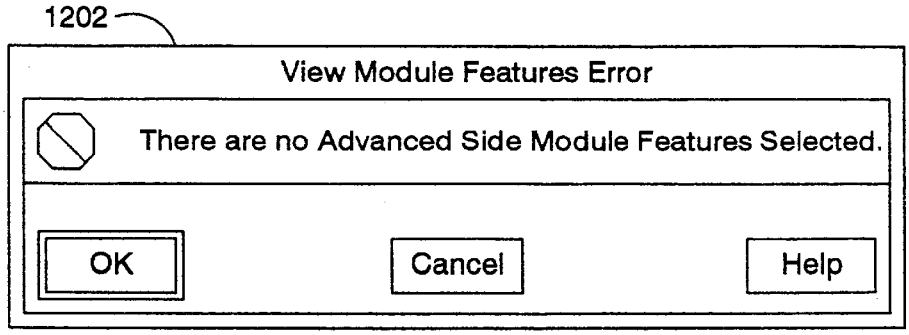
Fig_12_
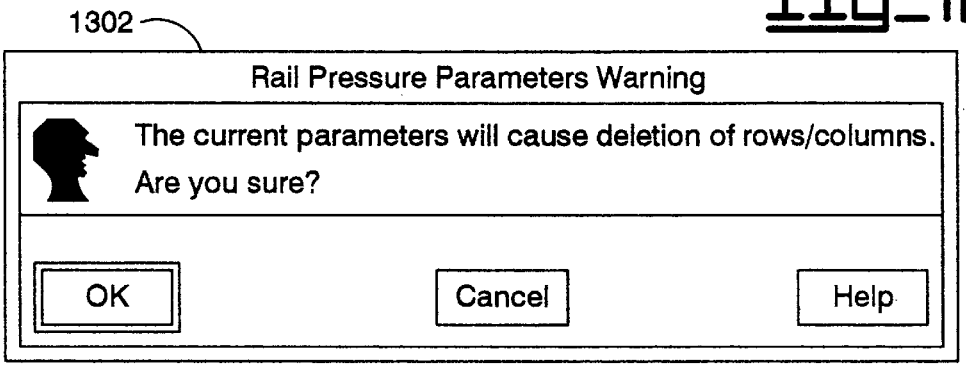
Fig_13_
Fig_14_
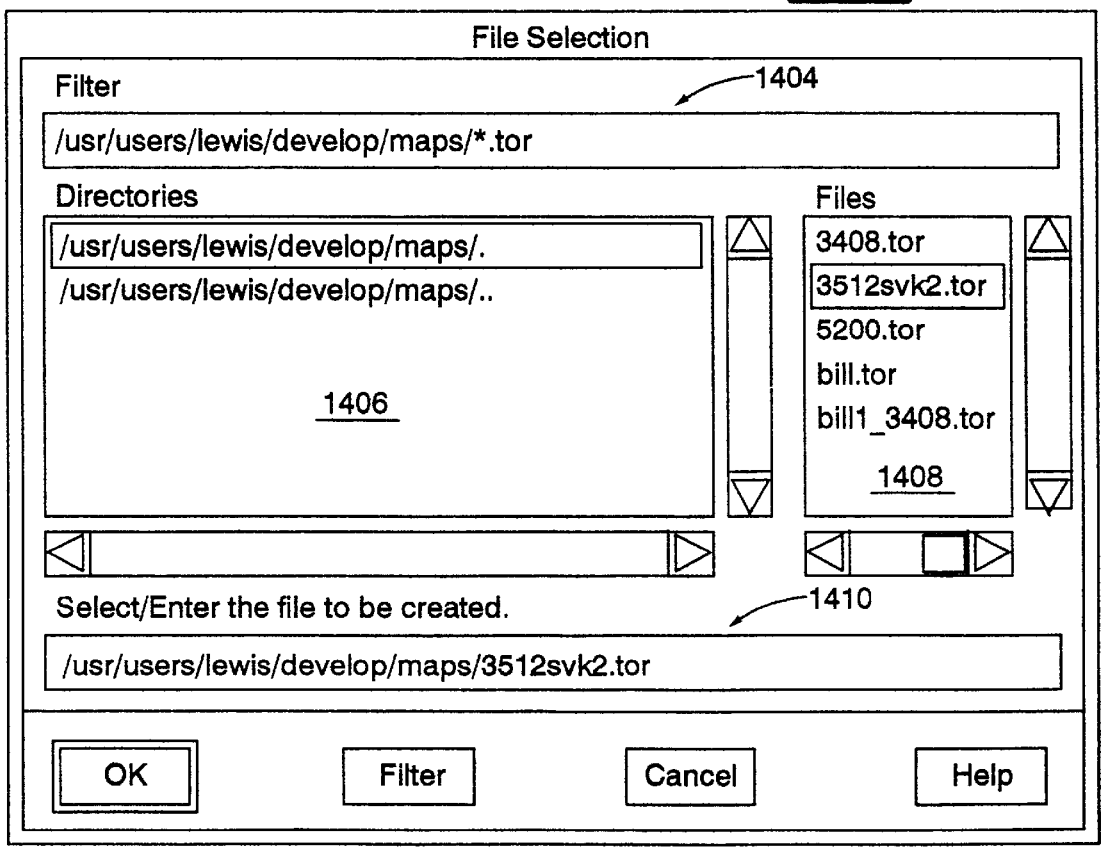

Fig_16_

Torque Map

Fuel Limit (10*mm3/st)

Enter Value: 0

◆ Edit ◇ Replace

| Engine Speed (rpm) | | S.S. | TRANS | S.S. Slope | Intercept | TRANS Slope | Intercept |
|---|---|---|---|---|---|---|---|
| 0 | 1100 | 20.18 | 20.18 | 0 | 0 | 0 | 0 |
| 1 | 1200 | 20.37 | 20.37 | 49 | 3618 | 49 | 3618 |
| 2 | 1400 | 19.20 | 19.20 | -150 | 5478 | -150 | 5478 |
| 3 | 1500 | 18.71 | 18.71 | -125 | 5212 | -125 | 5212 |
| 4 | 1600 | 18.02 | 18.02 | -177 | 5812 | -177 | 5812 |
| 5 | 1800 | 17.79 | 17.79 | -29 | 3972 | -29 | 3972 |
| 6 | 1900 | 16.81 | 16.81 | -251 | 7086 | -251 | 7086 |
| 7 | 2000 | 16.88 | 16.88 | 18 | 3096 | 18 | 3096 |
| 8 | 2020 | 17.76 | 16.76 | 1126 | -14224 | -154 | 5776 |
| 9 | 2054 | 15.50 | 15.50 | -1702 | 30406 | -949 | 18324 |
| 10 | 2200 | 2.52 | 2.52 | -2276 | -99999 | -2276 | -99999 |
| 11 | 3000 | 2.52 | 2.52 | 0 | 504 | 0 | 504 |

1602

OK Cancel Help

| | Engine Speed (rpm) | S.S. | TRANS | S.S. Slope | Intercept | TRANS Slope | Intercept |
|---|---|---|---|---|---|---|---|
| 0 | 1100 | 20.18 | 20.18 | 0 | 0 | 0 | 0 |
| 1 | 1200 | 20.37 | 20.37 | 49 | 3618 | 49 | 3618 |
| 2 | 1400 | 19.20 | 19.20 | -150 | 5478 | -150 | 5478 |
| 3 | 1500 | 18.71 | 18.71 | -125 | 5212 | -125 | 5212 |
| 4 | 1600 | 18.02 | 18.02 | -177 | 5812 | -177 | 5812 |
| 5 | 1800 | 17.79 | 17.79 | -29 | 3972 | -29 | 3972 |
| 6 | 1900 | 16.81 | 16.81 | -251 | 7086 | -251 | 7086 |
| 7 | 2000 | 16.88 | 16.88 | 18 | 3096 | 18 | 3096 |
| 8 | 2020 | 17.76 | 16.76 | 1126 | -14224 | -154 | 5776 |
| 9 | 2054 | 15.50 | 15.50 | -1702 | 30406 | -949 | 18324 |
| 10 | 2200 | 2.52 | 2.52 | -2276 | -99999 | -2276 | -99999 |
| 11 | 3000 | 2.52 | 2.52 | 0 | 504 | 0 | 504 |

Fig_25

Cold Smoke Map

IMAP Absolute | Low Rack Limit | High Rack Limit

Enter Value: 0

Edit | Replace

| Engine Speed (rpm) | IMAP1 | IMAP2 | RACK 1 | RACK 2 | RACK 1 | RACK 2 |
|---|---|---|---|---|---|---|
| 0 | 70.00 | 200.00 | 4.12 | 13.52 | 4.31 | 15.20 |
| 400 | 70.00 | 200.00 | 4.12 | 13.52 | 4.31 | 15.20 |
| 700 | 70.00 | 200.00 | 5.74 | 20.66 | 6.26 | 23.55 |
| 800 | 70.00 | 200.00 | 6.34 | 21.94 | 6.99 | 25.08 |
| 900 | 70.00 | 200.00 | 7.01 | 22.98 | 7.80 | 26.31 |
| 1000 | 70.00 | 200.00 | 7.74 | 23.79 | 8.68 | 27.27 |
| 1100 | 70.00 | 200.00 | 7.19 | 24.15 | 8.22 | 27.88 |
| 1200 | 70.00 | 200.00 | 7.57 | 23.40 | 8.58 | 26.94 |
| 1300 | 70.00 | 200.00 | 8.64 | 21.03 | 9.49 | 23.83 |
| 1400 | 70.00 | 200.00 | 9.10 | 21.52 | 10.02 | 24.42 |
| 1500 | 70.00 | 200.00 | 9.55 | 21.93 | 10.56 | 24.91 |
| 1600 | 70.00 | 200.00 | 10.00 | 22.23 | 11.09 | 25.28 |
| 1700 | 70.00 | 200.00 | 10.44 | 22.45 | 11.62 | 25.54 |
| 1750 | 70.00 | 200.00 | 10.65 | 22.52 | 11.88 | 25.64 |
| 1800 | 70.00 | 200.00 | 10.85 | 22.47 | 12.10 | 25.57 |
| 1900 | 70.00 | 200.00 | 11.20 | 22.26 | 12.51 | 25.33 |
| 2000 | 70.00 | 200.00 | 11.76 | 22.51 | 13.16 | 25.61 |

2502

OK | Cancel | Help

Fig_31_

Rail Pressure Map

Fuel Quantity (10*mm3/st)

Enter Value: in Mpa 33.00 Edit Replace

| Engine Speed (rpm) | 1.000 | 2.000 | 3.000 | 4.000 | 5.000 | 6.000 | 7.000 | 8.000 | 9.000 | 10.000 | 11.000 | 12.000 |
|---|---|---|---|---|---|---|---|---|---|---|---|---|
| 600 | 33.00 | 33.00 | 33.00 | 33.00 | 33.00 | 33.00 | 33.00 | 33.00 | 33.00 | 33.00 | 33.00 | 33.00 |
| 650 | 33.00 | 33.00 | 33.00 | 33.00 | 33.00 | 33.00 | 33.00 | 33.00 | 33.00 | 33.00 | 33.00 | 33.00 |
| 700 | 33.00 | 33.00 | 33.00 | 33.00 | 33.00 | 33.00 | 33.00 | 33.00 | 33.00 | 33.00 | 33.00 | 33.00 |
| 750 | 33.00 | 33.00 | 33.00 | 33.00 | 33.00 | 33.00 | 33.00 | 33.00 | 33.00 | 33.00 | 33.00 | 33.00 |
| 800 | 33.00 | 33.00 | 33.00 | 33.00 | 33.00 | 33.00 | 33.00 | 33.00 | 33.00 | 33.00 | 33.00 | 33.00 |
| 850 | 33.00 | 33.00 | 33.00 | 33.00 | 33.00 | 33.00 | 33.00 | 33.00 | 33.00 | 33.00 | 33.00 | 33.00 |
| 900 | 33.00 | 33.00 | 33.00 | 33.00 | 33.00 | 33.00 | 33.00 | 33.00 | 33.00 | 33.00 | 33.00 | 33.00 |
| 950 | 33.00 | 33.00 | 33.00 | 33.00 | 33.00 | 33.00 | 33.00 | 33.00 | 33.00 | 33.00 | 33.00 | 33.00 |
| 1000 | 33.00 | 33.00 | 33.00 | 33.00 | 33.00 | 33.00 | 33.00 | 33.00 | 33.00 | 33.00 | 33.00 | 33.00 |
| 1050 | 33.00 | 33.00 | 33.00 | 33.00 | 33.00 | 33.00 | 33.00 | 33.00 | 33.00 | 33.00 | 33.00 | 33.00 |
| 1100 | 33.00 | 33.00 | 33.00 | 33.00 | 33.00 | 33.00 | 33.00 | 33.00 | 33.00 | 33.00 | 33.00 | 33.00 |
| 1150 | 33.00 | 33.00 | 33.00 | 33.00 | 33.00 | 33.00 | 33.00 | 33.00 | 33.00 | 33.00 | 33.00 | 33.00 |
| 1200 | 33.00 | 33.00 | 33.00 | 33.00 | 33.00 | 33.00 | 33.00 | 33.00 | 33.00 | 33.00 | 33.00 | 33.00 |
| 1250 | 33.00 | 33.00 | 33.00 | 33.00 | 33.00 | 33.00 | 33.00 | 33.00 | 33.00 | 33.00 | 33.00 | 33.00 |
| 1300 | 33.00 | 33.00 | 33.00 | 33.00 | 33.00 | 33.00 | 33.00 | 33.00 | 33.00 | 33.00 | 33.00 | 33.00 |
| 1350 | 33.00 | 33.00 | 33.00 | 33.00 | 33.00 | 33.00 | 33.00 | 33.00 | 33.00 | 33.00 | 33.00 | 33.00 |
| 1400 | 33.00 | 33.00 | 33.00 | 33.00 | 33.00 | 33.00 | 33.00 | 33.00 | 33.00 | 33.00 | 33.00 | 33.00 |
| 1450 | 33.00 | 33.00 | 33.00 | 33.00 | 33.00 | 33.00 | 33.00 | 33.00 | 33.00 | 33.00 | 33.00 | 33.00 |
| 1500 | 33.00 | 33.00 | 33.00 | 33.00 | 33.00 | 33.00 | 33.00 | 33.00 | 33.00 | 33.00 | 33.00 | 33.00 |
| 1550 | 33.00 | 33.00 | 33.00 | 33.00 | 33.00 | 33.00 | 33.00 | 33.00 | 33.00 | 33.00 | 33.00 | 33.00 |

OK Cancel 3102 Help

Rail Pressure Ceiling Parameters

| | Minimum | Maximum | Increment | Positions |
|---|---|---|---|---|
| Fuel Quantity (10*mm3/st) | 1.000 | 15.000 | 1.000 | 15 |
| Engine Speed (rpm) | 600 | 2350 | 50 | 36 |

3402

OK Cancel Help

Fig_34_

Master Timing Parameters

| | Minimum | Maximum | Increment | Positions |
|---|---|---|---|---|
| Rack Position (mm) | 0.000 | 11.000 | 1.000 | 12 |
| Engine Speed (rpm) | 700 | 1650 | 50 | 20 |

3602

OK Cancel Help

Fig_36_

Fig. 35

Rail Pressure Ceiling Map

Fuel Quantity (10*mm3/st)

Enter Value: in Mpa 0.00

Edit Replace

| Engine Speed (rpm) | 1.000 | 2.000 | 3.000 | 4.000 | 5.000 | 6.000 | 7.000 | 8.000 | 9.000 | 10.000 | 11.000 | 12.000 |
|---|---|---|---|---|---|---|---|---|---|---|---|---|
| 600 | 0.00 | 0.00 | 0.00 | 0.00 | 0.00 | 0.00 | 0.00 | 0.00 | 0.00 | 0.00 | 0.00 | 0.00 |
| 650 | 0.00 | 0.00 | 0.00 | 0.00 | 0.00 | 0.00 | 0.00 | 0.00 | 0.00 | 0.00 | 0.00 | 0.00 |
| 700 | 0.00 | 0.00 | 0.00 | 0.00 | 0.00 | 0.00 | 0.00 | 0.00 | 0.00 | 0.00 | 0.00 | 0.00 |
| 750 | 0.00 | 0.00 | 0.00 | 0.00 | 0.00 | 0.00 | 0.00 | 0.00 | 0.00 | 0.00 | 0.00 | 0.00 |
| 800 | 0.00 | 0.00 | 0.00 | 0.00 | 0.00 | 0.00 | 0.00 | 0.00 | 0.00 | 0.00 | 0.00 | 0.00 |
| 850 | 0.00 | 0.00 | 0.00 | 0.00 | 0.00 | 0.00 | 0.00 | 0.00 | 0.00 | 0.00 | 0.00 | 0.00 |
| 900 | 0.00 | 0.00 | 0.00 | 0.00 | 0.00 | 0.00 | 0.00 | 0.00 | 0.00 | 0.00 | 0.00 | 0.00 |
| 950 | 0.00 | 0.00 | 0.00 | 0.00 | 0.00 | 0.00 | 0.00 | 0.00 | 0.00 | 0.00 | 0.00 | 0.00 |
| 1000 | 0.00 | 0.00 | 0.00 | 0.00 | 0.00 | 0.00 | 0.00 | 0.00 | 0.00 | 0.00 | 0.00 | 0.00 |
| 1050 | 0.00 | 0.00 | 0.00 | 0.00 | 0.00 | 0.00 | 0.00 | 0.00 | 0.00 | 0.00 | 0.00 | 0.00 |
| 1100 | 0.00 | 0.00 | 0.00 | 0.00 | 0.00 | 0.00 | 0.00 | 0.00 | 0.00 | 0.00 | 0.00 | 0.00 |
| 1150 | 0.00 | 0.00 | 0.00 | 0.00 | 0.00 | 0.00 | 0.00 | 0.00 | 0.00 | 0.00 | 0.00 | 0.00 |
| 1200 | 0.00 | 0.00 | 0.00 | 0.00 | 0.00 | 0.00 | 0.00 | 0.00 | 0.00 | 0.00 | 0.00 | 0.00 |
| 1250 | 0.00 | 0.00 | 0.00 | 0.00 | 0.00 | 0.00 | 0.00 | 0.00 | 0.00 | 0.00 | 0.00 | 0.00 |
| 1300 | 0.00 | 0.00 | 0.00 | 0.00 | 0.00 | 0.00 | 0.00 | 0.00 | 0.00 | 0.00 | 0.00 | 0.00 |
| 1350 | 0.00 | 0.00 | 0.00 | 0.00 | 0.00 | 0.00 | 0.00 | 0.00 | 0.00 | 0.00 | 0.00 | 0.00 |
| 1400 | 0.00 | 0.00 | 0.00 | 0.00 | 0.00 | 0.00 | 0.00 | 0.00 | 0.00 | 0.00 | 0.00 | 0.00 |
| 1450 | 0.00 | 0.00 | 0.00 | 0.00 | 0.00 | 0.00 | 0.00 | 0.00 | 0.00 | 0.00 | 0.00 | 0.00 |
| 1500 | 0.00 | 0.00 | 0.00 | 0.00 | 0.00 | 0.00 | 0.00 | 0.00 | 0.00 | 0.00 | 0.00 | 0.00 |
| 1550 | 0.00 | 0.00 | 0.00 | 0.00 | 0.00 | 0.00 | 0.00 | 0.00 | 0.00 | 0.00 | 0.00 | 0.00 |

OK Cancel Help

3502

Fig-39

Ceiling Timing Map

Rack Position (mm)

Enter Value: in deg. BTDC 8.00

Edit Replace

| Engine Speed (rpm) | 0.000 | 0.500 | 1.000 | 1.500 | 2.000 | 2.500 | 3.000 | 3.500 | 4.000 | 4.500 | 5.000 | 5.500 |
|---|---|---|---|---|---|---|---|---|---|---|---|---|
| 600 | 8.00 | 8.00 | 8.00 | 8.00 | 8.00 | 8.00 | 8.00 | 8.00 | 8.00 | 8.00 | 8.00 | 2.50 |
| 650 | 8.00 | 8.00 | 8.00 | 8.00 | 8.00 | 8.00 | 8.00 | 8.00 | 8.00 | 8.00 | 8.00 | 2.50 |
| 700 | 8.00 | 8.00 | 8.00 | 8.00 | 8.00 | 8.00 | 8.00 | 8.00 | 8.00 | 8.00 | 8.00 | 3.50 |
| 750 | 8.00 | 8.00 | 8.00 | 8.00 | 8.00 | 8.00 | 8.00 | 8.00 | 8.00 | 8.00 | 8.00 | 3.50 |
| 800 | 8.00 | 8.00 | 8.00 | 8.00 | 8.00 | 8.00 | 8.00 | 8.00 | 8.00 | 8.00 | 8.00 | 8.00 |
| 850 | 8.00 | 8.00 | 8.00 | 8.00 | 8.00 | 8.00 | 8.00 | 8.00 | 8.50 | 8.00 | 8.00 | 8.00 |
| 900 | 8.00 | 8.00 | 8.00 | 8.00 | 8.00 | 8.00 | 8.00 | 8.00 | 9.00 | 9.00 | 9.00 | 8.00 |
| 950 | 8.00 | 8.00 | 8.00 | 8.00 | 8.00 | 8.00 | 8.00 | 8.50 | 9.50 | 9.50 | 9.50 | 9.50 |
| 1000 | 8.00 | 8.00 | 8.00 | 8.00 | 8.00 | 8.00 | 8.00 | 9.00 | 10.00 | 10.00 | 10.00 | 10.00 |
| 1050 | 8.00 | 8.00 | 8.00 | 8.00 | 8.00 | 8.00 | 8.00 | 9.50 | 10.50 | 10.50 | 10.50 | 10.50 |
| 1100 | 8.00 | 8.00 | 8.00 | 8.00 | 8.00 | 8.00 | 8.00 | 10.00 | 11.00 | 11.00 | 11.00 | 10.00 |
| 1150 | 8.00 | 8.00 | 8.00 | 8.00 | 8.00 | 8.00 | 8.00 | 10.00 | 11.50 | 11.50 | 11.50 | 10.00 |
| 1200 | 8.00 | 8.00 | 8.00 | 8.00 | 8.00 | 8.00 | 8.00 | 10.00 | 11.50 | 12.00 | 12.00 | 10.00 |
| 1250 | 8.00 | 8.00 | 8.00 | 8.00 | 8.00 | 8.00 | 8.00 | 10.00 | 12.00 | 12.00 | 12.00 | 10.50 |
| 1300 | 8.00 | 8.00 | 8.00 | 8.00 | 8.00 | 8.00 | 8.00 | 10.00 | 12.00 | 12.00 | 12.00 | 11.00 |
| 1350 | 8.00 | 8.00 | 8.00 | 8.00 | 8.00 | 8.50 | 8.00 | 10.00 | 12.00 | 12.00 | 13.00 | 11.50 |
| 1400 | 8.00 | 8.00 | 8.00 | 8.00 | 8.00 | 8.00 | 8.00 | 10.00 | 12.00 | 12.00 | 13.00 | 12.00 |
| 1450 | 8.00 | 8.00 | 8.00 | 8.00 | 8.00 | 8.50 | 8.50 | 10.50 | 12.00 | 12.00 | 13.00 | 11.50 |
| 1500 | 8.00 | 8.00 | 8.00 | 8.00 | 8.00 | 8.00 | 9.00 | 11.00 | 12.00 | 12.00 | 12.00 | 11.00 |
| 1550 | 8.00 | 8.00 | 8.00 | 8.00 | 8.00 | 9.00 | 9.50 | 11.00 | 12.00 | 13.00 | 12.00 | 11.00 |

OK Cancel 3902 Help

| | Timing Degrees | Rack Threshold (mm) | Engine Speed (rpm) |
|---|---|---|---|
| 0 | 20.0 | 2.000 | 750 |
| 1 | 10.0 | 10.000 | 1230 |
| 2 | 30.0 | 10.000 | 2450 |
| 3 | 40.0 | 2.010 | 320 |
| 4 | 20.0 | 0.750 | 1850 |
| 5 | 10.0 | 10.830 | 1230 |
| 6 | 8.0 | 5.432 | 1920 |
| 7 | 6.5 | 0.678 | 1870 |
| 8 | 12.2 | 1.125 | 1450 |
| 9 | 5.6 | 10.431 | 2220 |
| 10 | 1.2 | 0.384 | 750 |
| 11 | 3.4 | 1.223 | 1500 |
| 12 | 1.1 | 0.875 | 1100 |
| 13 | 2.3 | 18.374 | 1000 |
| 14 | 18.4 | 0.732 | 800 |

Fuel Rate Parameters

File Name: /usr/users/lewis/develop/maps/777c.frt

Fuel Rate Labels

Fuel Rate Parameters

5802

Fuel Rate Map

OK Cancel Options Help

Fig_58_

Fuel Rate Map

| | Minimum | Maximum | Increment | Positions |
|---|---|---|---|---|
| Engine Speed (rpm) | 700 | 1900 | 100 | 13 |
| Rack Position (mm) | 3.000 | 23.000 | 2.000 | 11 |

5902

OK Cancel Help

Fig_59_

Fig_63

Combustion Probe Map

Fuel/Stroke (lbs/stk)

Enter Value: in msec 2.0

Edit Replace

| Engine Speed (rpm) | 0.00000 | 0.00022 | 0.00044 | 0.00066 | 0.00088 | 0.00110 | 0.00132 | 0.00154 | 0.00176 | 0.00198 | 0.00220 | 0.00242 |
|---|---|---|---|---|---|---|---|---|---|---|---|---|
| 350 | 2.0 | 2.0 | 2.0 | 2.0 | 2.0 | 2.0 | 2.0 | 2.0 | 2.0 | 2.0 | 2.0 | 2.0 |
| 400 | 2.0 | 2.0 | 2.0 | 2.0 | 2.0 | 2.0 | 2.0 | 2.0 | 2.0 | 2.0 | 2.0 | 2.0 |
| 450 | 2.0 | 2.0 | 2.0 | 2.0 | 2.0 | 2.0 | 2.0 | 2.0 | 2.0 | 2.0 | 2.0 | 2.0 |
| 500 | 2.0 | 2.0 | 2.0 | 2.0 | 2.0 | 2.0 | 2.0 | 2.0 | 2.0 | 2.0 | 2.0 | 2.0 |
| 550 | 2.0 | 2.0 | 2.0 | 2.0 | 2.0 | 2.0 | 2.0 | 2.0 | 2.0 | 2.0 | 2.0 | 2.0 |
| 600 | 2.0 | 2.0 | 2.0 | 2.0 | 2.0 | 2.0 | 2.0 | 2.0 | 2.0 | 2.0 | 2.0 | 2.0 |
| 650 | 2.0 | 2.0 | 2.0 | 2.0 | 2.0 | 2.0 | 2.0 | 2.0 | 2.0 | 2.0 | 2.0 | 2.0 |
| 700 | 2.0 | 2.0 | 2.0 | 2.0 | 2.0 | 2.0 | 2.0 | 2.0 | 2.0 | 2.0 | 2.0 | 2.0 |
| 750 | 2.0 | 2.0 | 2.0 | 2.0 | 2.0 | 2.0 | 2.0 | 2.0 | 2.0 | 2.0 | 2.0 | 2.0 |
| 800 | 2.0 | 2.0 | 2.0 | 2.0 | 2.0 | 2.0 | 2.0 | 2.0 | 2.0 | 2.0 | 2.0 | 2.0 |
| 850 | 2.0 | 2.0 | 2.0 | 2.0 | 2.0 | 2.0 | 2.0 | 2.0 | 2.0 | 2.0 | 2.0 | 2.0 |
| 900 | 2.0 | 2.0 | 2.0 | 2.0 | 2.0 | 2.0 | 2.0 | 2.0 | 2.0 | 2.0 | 2.0 | 2.0 |
| 950 | 2.0 | 2.0 | 2.0 | 2.0 | 2.0 | 2.0 | 2.0 | 2.0 | 2.0 | 2.0 | 2.0 | 2.0 |
| 1000 | 2.0 | 2.0 | 2.0 | 2.0 | 2.0 | 2.0 | 2.0 | 2.0 | 2.0 | 2.0 | 2.0 | 2.0 |
| 1050 | 2.0 | 2.0 | 2.0 | 2.0 | 2.0 | 2.0 | 2.0 | 2.0 | 2.0 | 2.0 | 2.0 | 2.0 |
| 1100 | 2.0 | 2.0 | 2.0 | 2.0 | 2.0 | 2.0 | 2.0 | 2.0 | 2.0 | 2.0 | 2.0 | 2.0 |

6302

OK Cancel Help

Fig. 64

Air/Fuel Map

Fuel/Stroke (lbs/stk)

Enter Value: in A/F Vol 10.00

Edit Replace

| Engine Speed (rpm) | 0.00000 | 0.00022 | 0.00044 | 0.00066 | 0.00088 | 0.00110 | 0.00132 | 0.00154 | 0.00176 | 0.00198 | 0.00220 | 0.00242 |
|---|---|---|---|---|---|---|---|---|---|---|---|---|
| 350 | 10.00 | 10.00 | 10.00 | 10.00 | 10.00 | 10.00 | 10.00 | 10.00 | 10.00 | 10.00 | 10.00 | 10.00 |
| 400 | 10.00 | 10.00 | 10.00 | 10.00 | 10.00 | 10.00 | 10.00 | 10.00 | 10.00 | 10.00 | 10.00 | 10.00 |
| 450 | 10.00 | 10.00 | 10.00 | 10.00 | 10.00 | 10.00 | 10.00 | 10.00 | 10.00 | 10.00 | 10.00 | 10.00 |
| 500 | 10.00 | 10.00 | 10.00 | 10.00 | 10.00 | 10.00 | 10.00 | 10.00 | 10.00 | 10.00 | 10.00 | 10.00 |
| 550 | 10.00 | 10.00 | 10.00 | 10.00 | 10.00 | 10.00 | 10.00 | 10.00 | 10.00 | 10.00 | 10.00 | 10.00 |
| 600 | 10.00 | 10.00 | 10.00 | 10.00 | 10.00 | 10.00 | 10.00 | 10.00 | 10.00 | 10.00 | 10.00 | 10.00 |
| 650 | 10.00 | 10.00 | 10.00 | 10.00 | 10.00 | 10.00 | 10.00 | 10.00 | 10.00 | 10.00 | 10.00 | 10.00 |
| 700 | 10.00 | 10.00 | 10.00 | 10.00 | 10.00 | 10.00 | 10.00 | 10.00 | 10.00 | 10.00 | 10.00 | 10.00 |
| 750 | 10.00 | 10.00 | 10.00 | 10.00 | 10.00 | 10.00 | 10.00 | 10.00 | 10.00 | 10.00 | 10.00 | 10.00 |
| 800 | 10.00 | 10.00 | 10.00 | 10.00 | 10.00 | 10.00 | 10.00 | 10.00 | 10.00 | 10.00 | 10.00 | 10.00 |
| 850 | 10.00 | 10.00 | 10.00 | 10.00 | 10.00 | 10.00 | 10.00 | 10.00 | 10.00 | 10.00 | 10.00 | 10.00 |
| 900 | 10.00 | 10.00 | 10.00 | 10.00 | 10.00 | 10.00 | 10.00 | 10.00 | 10.00 | 10.00 | 10.00 | 10.00 |
| 950 | 10.00 | 10.00 | 10.00 | 10.00 | 10.00 | 10.00 | 10.00 | 10.00 | 10.00 | 10.00 | 10.00 | 10.00 |
| 1000 | 10.00 | 10.00 | 10.00 | 10.00 | 10.00 | 10.00 | 10.00 | 10.00 | 10.00 | 10.00 | 10.00 | 10.00 |
| 1050 | 10.00 | 10.00 | 10.00 | 10.00 | 10.00 | 10.00 | 10.00 | 10.00 | 10.00 | 10.00 | 10.00 | 10.00 |
| 1100 | 10.00 | 10.00 | 10.00 | 10.00 | 10.00 | 10.00 | 10.00 | 10.00 | 10.00 | 10.00 | 10.00 | 10.00 |

6402

OK Cancel Help

Fig_69_

Transient Air/Fuel Map

Air/Stroke (lbs/stk)

Enter Value: in A/F Vol 17.44 Edit Replace

| Engine Speed (rpm) | 0.0000 | 0.0100 | 0.0200 | 0.0300 | 0.0400 | 0.0500 | 0.0600 | 0.0700 | 0.0800 | 0.0900 | 0.1000 | 0.1100 | 0.1200 | 0.1300 |
|---|---|---|---|---|---|---|---|---|---|---|---|---|---|---|
| 0 | 17.44 | 17.44 | 17.44 | 17.44 | 17.20 | 15.05 | 13.03 | 12.04 | 12.04 | 12.04 | 12.04 | 12.04 | 12.04 | 12.04 |
| 75 | 17.44 | 17.44 | 17.44 | 17.44 | 16.97 | 15.05 | 13.03 | 12.04 | 12.04 | 12.04 | 12.04 | 12.04 | 12.04 | 12.04 |
| 150 | 17.44 | 17.44 | 17.44 | 17.44 | 16.97 | 15.05 | 13.03 | 12.04 | 12.04 | 12.04 | 12.04 | 12.04 | 12.04 | 12.04 |
| 225 | 17.32 | 17.32 | 17.32 | 17.20 | 16.86 | 15.05 | 13.03 | 12.04 | 12.04 | 12.04 | 12.04 | 12.04 | 12.04 | 12.04 |
| 300 | 16.97 | 16.86 | 16.97 | 16.86 | 16.74 | 15.05 | 13.03 | 12.04 | 12.04 | 12.04 | 12.04 | 12.04 | 12.04 | 12.04 |
| 375 | 16.53 | 16.53 | 16.53 | 16.53 | 16.63 | 15.05 | 13.03 | 12.04 | 12.04 | 12.04 | 12.04 | 12.04 | 12.04 | 12.04 |
| 450 | 15.23 | 15.23 | 15.23 | 15.23 | 15.23 | 14.96 | 14.28 | 11.55 | 11.55 | 11.55 | 11.55 | 11.55 | 11.55 | 11.55 |
| 525 | 15.23 | 15.23 | 15.23 | 15.23 | 15.23 | 14.96 | 14.28 | 10.53 | 10.53 | 10.53 | 10.53 | 10.53 | 10.53 | 10.53 |
| 600 | 15.23 | 15.23 | 15.23 | 15.23 | 15.23 | 14.79 | 14.13 | 10.53 | 10.53 | 10.53 | 10.53 | 10.53 | 10.53 | 10.53 |
| 675 | 15.14 | 15.14 | 15.14 | 15.14 | 15.14 | 14.70 | 13.89 | 10.53 | 10.53 | 10.53 | 10.53 | 10.53 | 10.53 | 10.53 |
| 750 | 15.14 | 15.14 | 15.14 | 15.14 | 15.05 | 14.62 | 13.45 | 11.04 | 11.04 | 11.04 | 11.04 | 11.04 | 11.04 | 11.04 |
| 825 | 15.90 | 15.90 | 15.90 | 15.90 | 15.90 | 13.97 | 12.21 | 11.04 | 11.04 | 11.04 | 11.04 | 11.04 | 11.04 | 11.04 |
| 900 | 16.53 | 16.53 | 16.63 | 16.63 | 16.63 | 13.97 | 12.33 | 11.04 | 11.04 | 11.04 | 11.04 | 11.04 | 11.04 | 11.04 |
| 975 | 16.97 | 16.97 | 16.97 | 16.97 | 16.97 | 13.97 | 11.93 | 11.04 | 11.04 | 11.04 | 11.04 | 11.04 | 11.04 | 11.04 |
| 1050 | 16.97 | 16.97 | 16.97 | 16.97 | 16.97 | 13.97 | 11.93 | 11.04 | 11.04 | 11.04 | 11.04 | 11.04 | 11.04 | 11.04 |
| 1125 | 16.97 | 16.97 | 16.97 | 16.97 | 16.97 | 13.97 | 11.93 | 11.04 | 11.04 | 11.04 | 11.04 | 11.04 | 11.04 | 11.04 |

6902

OK Cancel Help

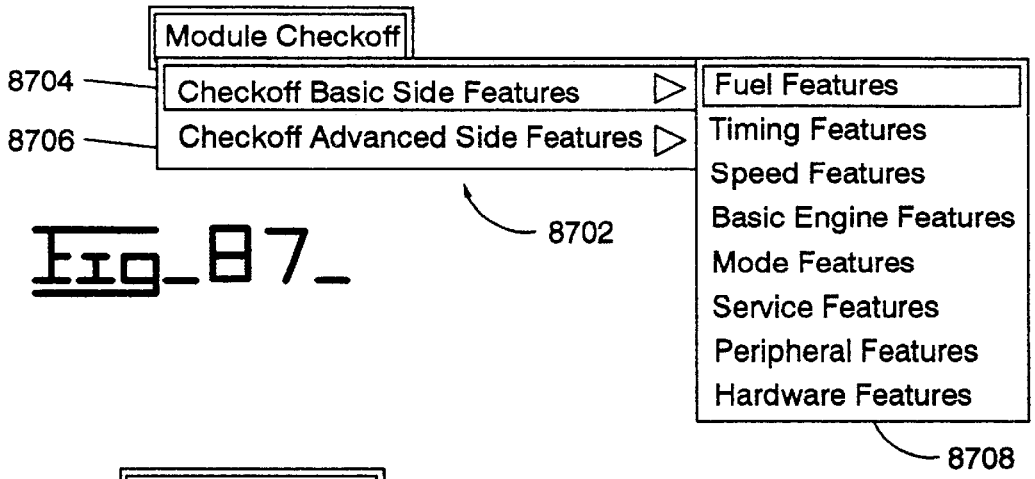
Fig_87_
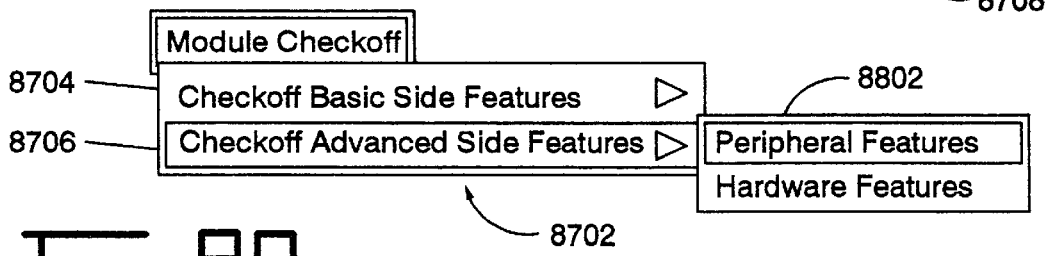
Fig_88_
Fig_89_
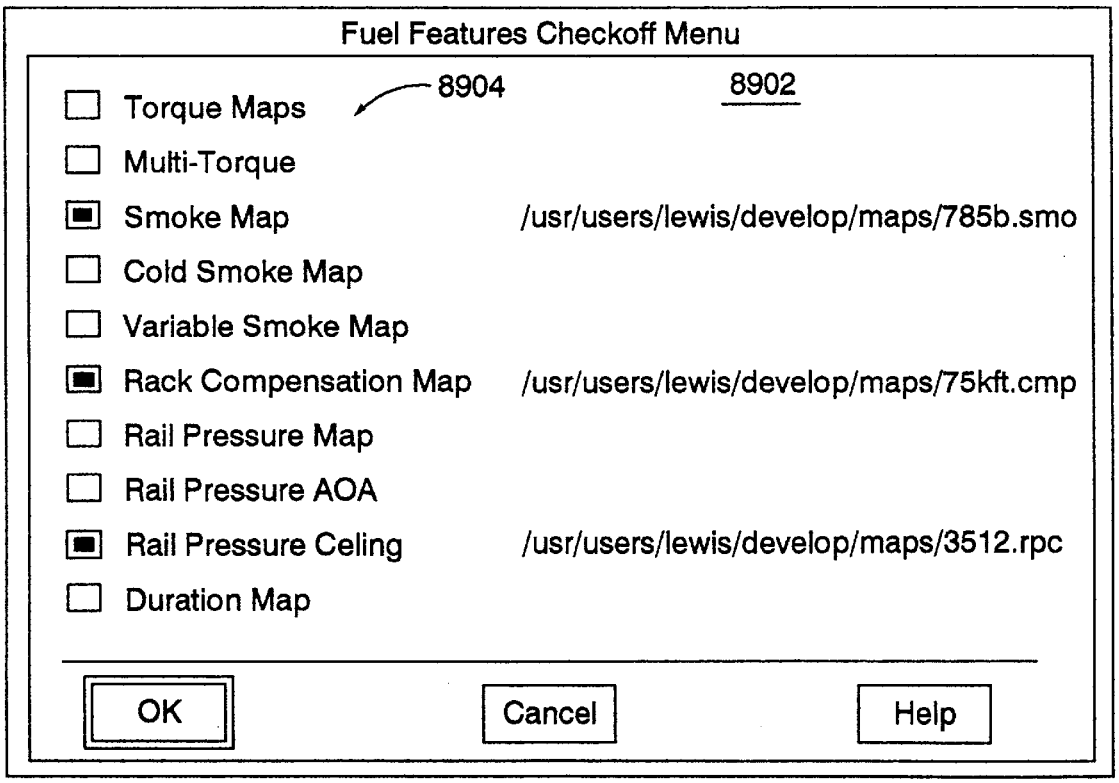

METHOD FOR PRODUCING PRODUCTION CONTROL SOFTWARE FOR A NATURAL GAS OR DIESEL ENGINE CONTROLLER

I. Technical Field

This invention relates generally to electronic controllers and more particularly to a method for programming a natural gas engine electronic controller or a diesel engine electronic controller based on user input.

II. Background Art

Electronic controllers, typically microprocessor based, are being increasingly used. For example, electronic controllers are commonly used to control engines. The electronic engine controller typically receives specific sensor information and controls operation of the engine in accordance with a preprogrammed set of rules.

The evolving complexity and use of electronic controllers has demanded increasing design time. Each application is different, requiring a different set of sensors, different data, and different software. Even electronic controllers designed to control similar devices may require different sensors, data and software. Thus, an engine controller, for example, must be designed and a unique set of rules must be written for each engine application.

Therefore, it became desirable to have a basic electronic controller system or platform for similar devices which is flexible. The electronic engine controller platform can be adapted/configured to work on various types, models, series or configurations of similar devices. However, each application has different requirements and specifications. Thus, utilization of the basic platform requires significant engineering design time and software engineer programming.

The present invention is directed to overcoming one or more of the problems set forth above.

III. Disclosure of the Invention

In one aspect of the present invention, a method of operating a computer to produce control software for an electronic controller for a natural gas or diesel engine is provided. The method includes the steps of selecting a target device as one of a diesel engine controller or a natural gas engine controller, defining a set of specifications of the electronic controller and the selected target device as a function of user input, and producing control software to operate the controller as specified by the specifications.

In another aspect of the present invention, a method of operating a computer to produce control software for an electronic controller for a natural gas or diesel engine is provided. The method includes the steps of selecting a target device as one of a diesel engine controller or a natural gas engine controller, defining a set of specifications of the electronic controller and the selected target device as a function of user input, and producing control software to operate the controller as specified by the specifications. The specifications include air features, fuel features, and timing features if the target device is a natural gas engine controller and fuel features, timing features, and speed features if the target device is a diesel engine controller.

BRIEF DESCRIPTION OF THE DRAWINGS

For a better understanding of the present invention, reference may be made to the accompanying drawings, in which:

FIG. 1 is a block diagram of the present invention, illustrating an Application Builder, a controller, and a controlled device;

FIG. 2 is a diagrammatic illustration of an Application Builder adapted to produce control software for an engine, illustrating user input and different engine applications;

FIG. 5 is a diagrammatic view of a pushbutton;

FIG. 6 is a diagrammatic view of a text field;

FIG. 9 is a diagrammatic view of a toggle button;

FIG. 10 is a diagrammatic view of a radio box;

FIG. 11 is a diagrammatic view of a selection box;

FIG. 12 is a diagrammatic view of an error dialog popup;

FIG. 13 is a diagrammatic view of a question dialog popup;

FIG. 14 is a diagrammatic view of a file selection dialog popup window;

FIG. 16 is a diagrammatic view of an exemplary data map;

FIG. 25 is a diagrammatic view of a Cold Smoke Map Window;

FIG. 31 is a diagrammatic view of a Rail Pressure Map Window;

FIG. 34 is a diagrammatic view of a Rail Pressure Ceiling Parameters Window;

FIG. 35 is a diagrammatic view of a Rail Pressure Ceiling Map Window;

FIG. 36 is a diagrammatic view of a Master Timing Parameters Window;

FIG. 39 is a diagrammatic view of a Ceiling Timing Map Window;

FIG. 58 is a diagrammatic view of a Fuel Rate Parameters Window;

FIG. 59 is a diagrammatic view of a Fuel Rate Map Window;

FIG. 63 is a diagrammatic view of a Combustion Probe Map Window;

FIG. 64 is a diagrammatic view of an Air/Fuel Map Window;

FIG. 69 is a diagrammatic view of a Transient Air/Fuel Map Window;

FIG. 76 is a diagrammatic view of a Protection Features Window;

FIG. 86 is a diagrammatic view of a Module Parameters Window;

FIG. 87 is a diagrammatic view of a Module Checkoff menu showing the Checkoff Basic Side Features submenu structure;

FIG. 88 is a diagrammatic view of the Module Checkoff menu showing the Checkoff Advanced Side Features submenu structure;

FIG. 89 is a diagrammatic view of a Fuel Features Checkoff Window;

VI. BEST MODE FOR CARRYING OUT THE INVENTION

A. Copyright

Figure 3:
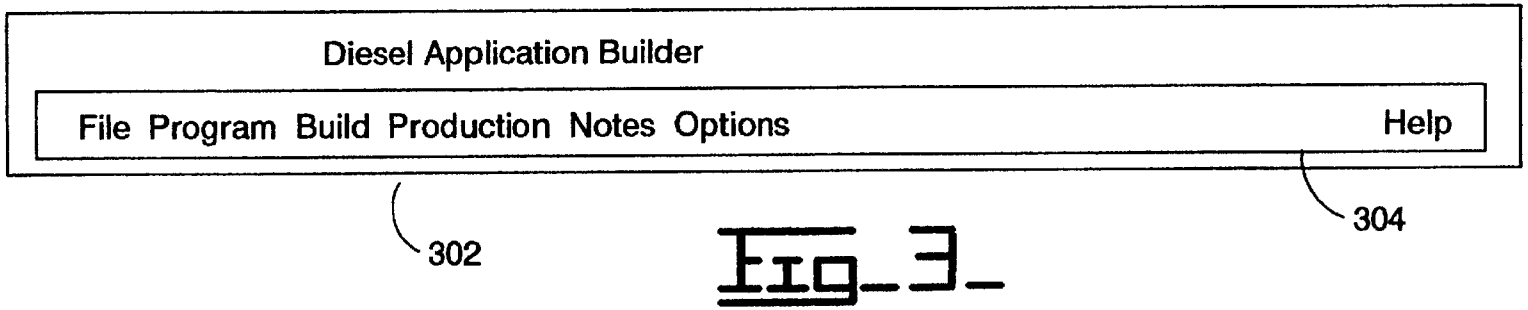
FIG. 3 is a diagrammatic view of the main menu of the Application Builder, according to an embodiment of the present invention.

Portions of the disclosure of this patent document contain material which is subject to copyright protection. The copyright owner has no objection to the facsimile production by anyone of the patent document or the patent disclosure as it appears in the Patent and Trademark Office patent file or records, but otherwise reserves all copyrights.

B. Introduction

Referring to the figures, the present invention provides a method of operating a computer (Application Builder) 102 to produce control software for a controller 104. The controller 104 is adapted to control a device 106, e.g., an engine, based on various inputs. The controller device is either a diesel engine or a natural gas engine.

The Application Builder 102 generally allows for user input of the specifications of the target controller/device 104,106 and produces the control software for the defined engine application. With reference to FIG. 2, the Application Builder 102 accepts user input for a specific engine application and produces the control software for the defined application. For example, the type of user input may include the number of cylinders, the type of data link and whether specific features are to be enabled (cruise control, speed limiting, fan control, engine monitoring, altitude derating). The various types of engine applications include electric power generation, marine, industrial, highway trucks, and off-highway trucks.

In the one embodiment, the Application Builder 102 utilizes a database of software code and the user defined parameter information and configuration data. The parameter information and configuration data is converted into a machine format and placed in a file. The file may then be downloaded to the target controller for testing. A database includes sets of default parameters and configurations which are dependent upon choices made by the user.

In a second embodiment, the Application Builder 102 converts the user input specifications into machine code which can be run directly by the target controller.

The present invention is embodied in a computer 108. The computer is programmed to receive user input and to produce the control software. The user inputs the parameters of the target controller as discussed below. The computer may be a microcomputer, a mainframe, a general purpose computer, or any suitable computer system. In the preferred embodiment, the present invention is embodied in a programmed DEC ULTRIX workstation running the ULTRIX operating system. The Application Builder 102 can be accessed via any workstation connected or networked to the programmed workstation.

The present invention is designed to be used in the development of production control software for a controller. The controller may be a new design or a new configuration built on a common platform. The present invention provides a method whereby a user, knowing the specifications of the target controller, inputs the specifications of the target controller and the control software is produced. The user does not have to be a computer programmer or have any computer programming experience.

With reference to FIG. 3, the main screen 302 of the Application Builder (AB) 102 is illustrated. The main screen 302 includes a pull down menu bar 304 with a plurality of pull down menus. In the preferred embodiment, the pull-down menus include "File", "Program", "Build", "Production", "Notes", "Options", and "Help". The pull down menus have the following functions:

File: The File menu item is used to exit the Application Builder Program.

Program: The Program menu item is used to enter data for the various features of the target controller.

Build: The Build menu item is used to build the top level source file for the target controller.

Production: The Production menu item is used to archive a configuration for production status.

Notes: The Notes menu item is used to view the Application Builder Release Notes.

Options: The Options menu item is used for selecting the download queue and user environment for Application Builder.

Help: The Help menu item is used to display the top level help information for Application Builder.

Figure 4:
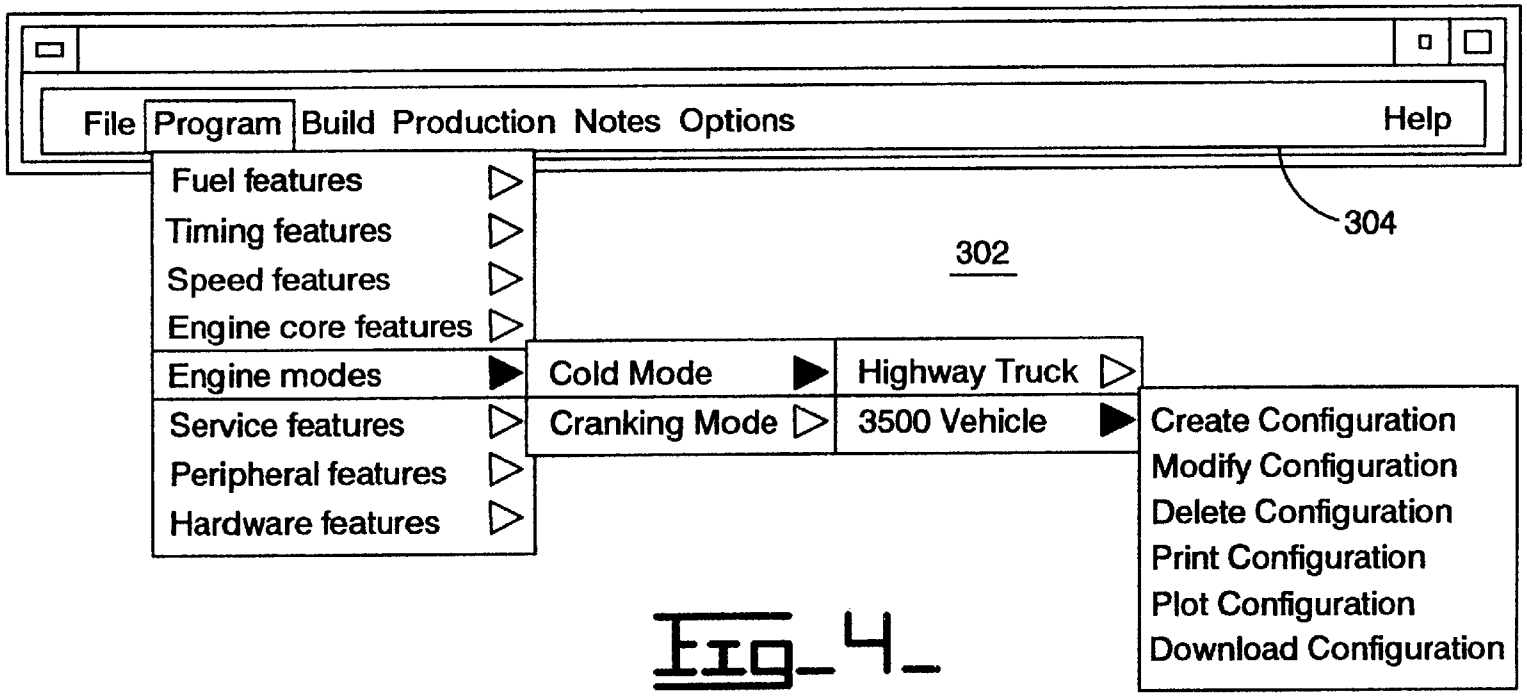
FIG. 4 is a diagrammatic view of the main menu of FIG. 3, illustrating an exemplary menu architecture.
Figure 15:
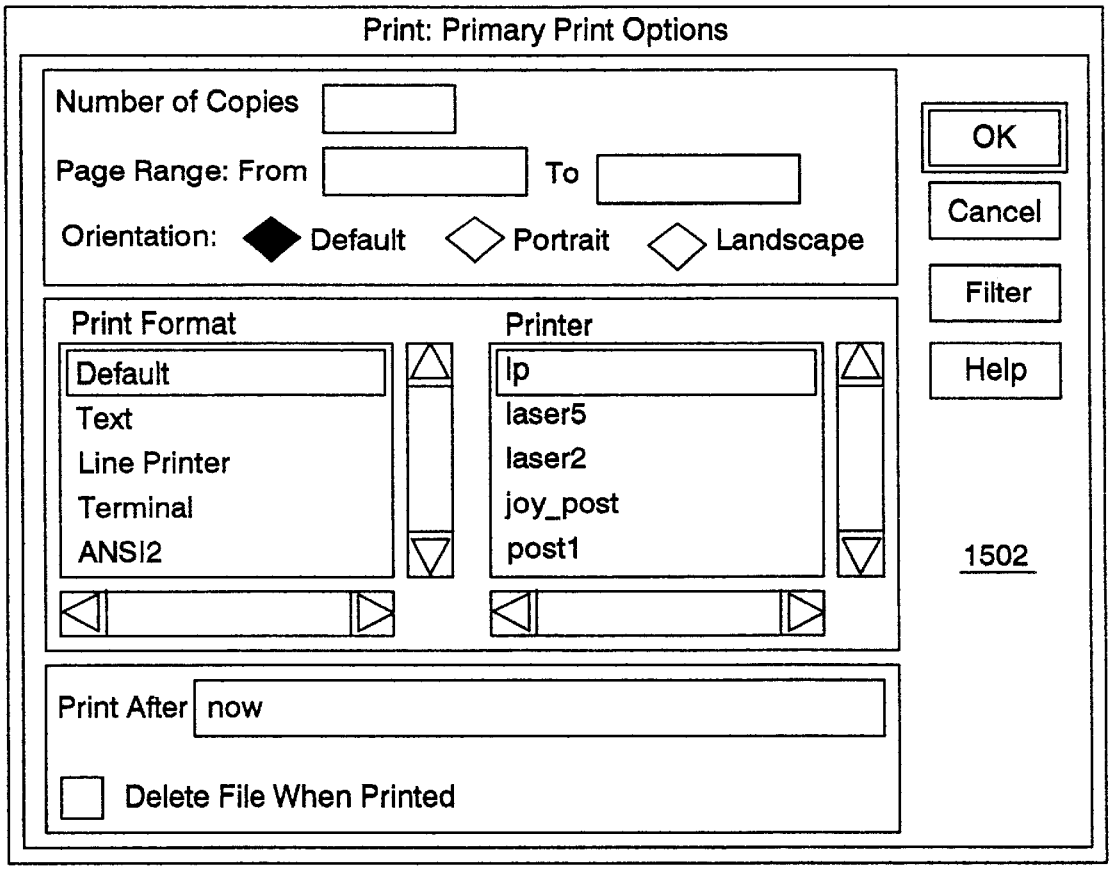
FIG. 15 is a diagrammatic view of a file print dialog popup.

Each menu may include a number of selectable items or sub-menus, as illustrated in FIG. 4.

Throughout the Application Builder 102 certain conventions are used. All data input and menu windows contain three standard control buttons: "OK", "Cancel", and "Help". An additional "Options" control button appears on select menu windows. The standard control buttons have the following functions:

OK: The OK button is used to accept the data currently displayed within the window.

Cancel: The Cancel button will discard any changes made in the current window and any subwindow.

Options: The Options button will display a popup window with additional functions that can be performed, e.g., "Print", "Plot", "Download", "Add/Edit Note", "Import", and "Save". Specific options are not available for all features. The Add/Edit Note option allows a text note to be attached to the current map or module. The Import features allows data to be read from files which have been saved in different file formats.

Help: The Help button will display information relating to the current window.

With reference to FIGS. 5–16, data is entered using various methods in the data input windows. A pushbutton or button 502 is activated by positioning a pointer (via a mouse) on the button and clicking (pressing and releasing) a first mouse button (MB1). The user must supply the requested information in a text field 602 followed by a TAB or RETURN. If the entered information is not valid, an error message will be displayed. To select an option within an option menu 702, the user places the pointer on the option menu and presses (and holds) MB1. A list of menu items will be displayed. To select the desired option, the user moves the pointer to the desired option and releases MB1.

To select a value via a slider 802, the user positions the pointer on a slider bar 804 and presses MB1. While holding MB1, the slider bar 804 can be moved until the desired value is displayed.

A toggle button 902 indicates a True/False or On/Off value. To change the state of a toggle button, the user positions the pointer on the button and clicks MB1.

A radio box 1002 is a collection of toggle buttons, where only one of the toggle buttons can be active or on at one time.

Selection boxes 1102 display a list of options 1104 and a selection edit field 1106. An option from the list may be selected by clicking MB1 with the pointer on the item in the list or the selection may be entered manually in the selection edit field. After an item is selected, a row of control pushbuttons 1108 is used to accept or cancel the selection.

Popups or windows appear in certain situations, asking for specific data or confirming a specific action.

When an error condition is encountered, an Error Popup 1202 with an appropriate error message will be displayed. Clicking MB1 with the pointer positioned on the OK or Cancel pushbutton will remove the Error Popup 1202 and allow the re-entry of data that caused the error.

When a change in parameters will cause rows and/or columns to be deleted from a map, a Question Dialog Popup 1302 will be displayed, confirming the action.

When the input of a FILENAME is required, a File Selection Popup 1402 appears. A Filter Field 1404 contains a wildcard specification. A Directories field 1406 and a Files Field 1408 display the available directories and the files which meet the requirements of the Filter Field 1404, respectively. To select a file, the pointer is positioned on a filename in the Files field 1408 and MB1 is clicked. The selected file will be highlighted and displayed in a Selection Edit Field 1410. Optionally, a filename may be entered manually in the selection edit field 1410.

A File Print Popup 1502 displays the printers available and allows for the selection of various print options.

Some selection boxes are displayed as separate popups. After the desired selection is made, the popup is removed. Additionally, data entry, for example, entry into a test field, may be done via a popup.

Various features of the target controller 104 may require a map, i.e., an array of operating data. An exemplary data map window 1602 is shown in FIG. 16. The data map window 1602 provides the mechanism for entering data, and for some maps, for manipulating the size of the map itself. Data may be entered as an absolute value or an increment/multiple of the current value. Each individual data value is displayed in a cell. One cell will always be the active cell and is indicated by a highlighted border. Groups of cells may be selected in order to update multiple cells. Selected cells are highlighted (in reverse video).

In general, maps may be updated using various techniques. A list of the techniques is below. However, it should be noted that not all techniques are supported by all maps.

Row Update: Clicking MB1 with the pointer in one of the header columns on the left side of a map will highlight the row in which the pointer is positioned. Any data modification will affect the entire row, including any cells that are not visible.

Column Update: Clicking MB1 with the pointer in one of the header columns at the top of a map will highlight the column in which the pointer is positioned. Any data modification will affect the entire column, including any cells that are not visible.

Range Update: Pressing and holding MB1 while dragging the pointer will highlight a rectangular group of cells. When MB1 is released, the selection is complete. Any data modification will now affect the selected cells.

Map Update: Clicking MB1 with the pointer in the extreme upper left corner of the map, will select and highlight the entire map. Any data modifications will affect the entire map, including any cells which are not visible.

Discontiguous Update: This method is similar to the Range Update technique, but is preceded by pressing and holding the <Shift> key. As long as the <Shift> key is held, additional selections, either ranges or individual cells, will be selected. Any data modifications will affect all selected cells and/or ranges of cells.

By default, map data entry defaults to an ENTRY or EDIT mode. In the EDIT mode, the data in the currently active cell is displayed in the data entry text field and the displayed value may be modified. Pressing a REPLACE toggle button changes data entry to a REPLACE mode. In the REPLACE mode, entry of the first character will result in the removal of the current value.

Modifications to the map data may be entered in several ways. A simple numeric value is interpreted as an absolute entry and the entered value will be placed in the map as it was entered.

Additionally, data entries may be modified incrementally. The first character in the data input is used to indicate the type of incremental modification to be performed. The supported modifications are: addition (+), subtraction (−), multiplication (*), and division (/). The value that follows one of these operators is used to modify the value in the selected cell or cells. For example, an entry of *1.25 indicates that the value in the currently selected cell or cells should be increased be 25 percent.

Some maps are variable in size. Maps will be sized via the Parameters input window. Additionally, rows and/or columns may be added or deleted from the map data window. Clicking a second mouse button (MB2) with the pointer positioned in one of the headers (row or column) will display a dialog box for deleting or inserting a column.

C. Diesel Engine Controller

As stated above, the Application Builder 102 is adaptable to produce control software for different types of target diesel or natural gas controllers.

Figure 17:
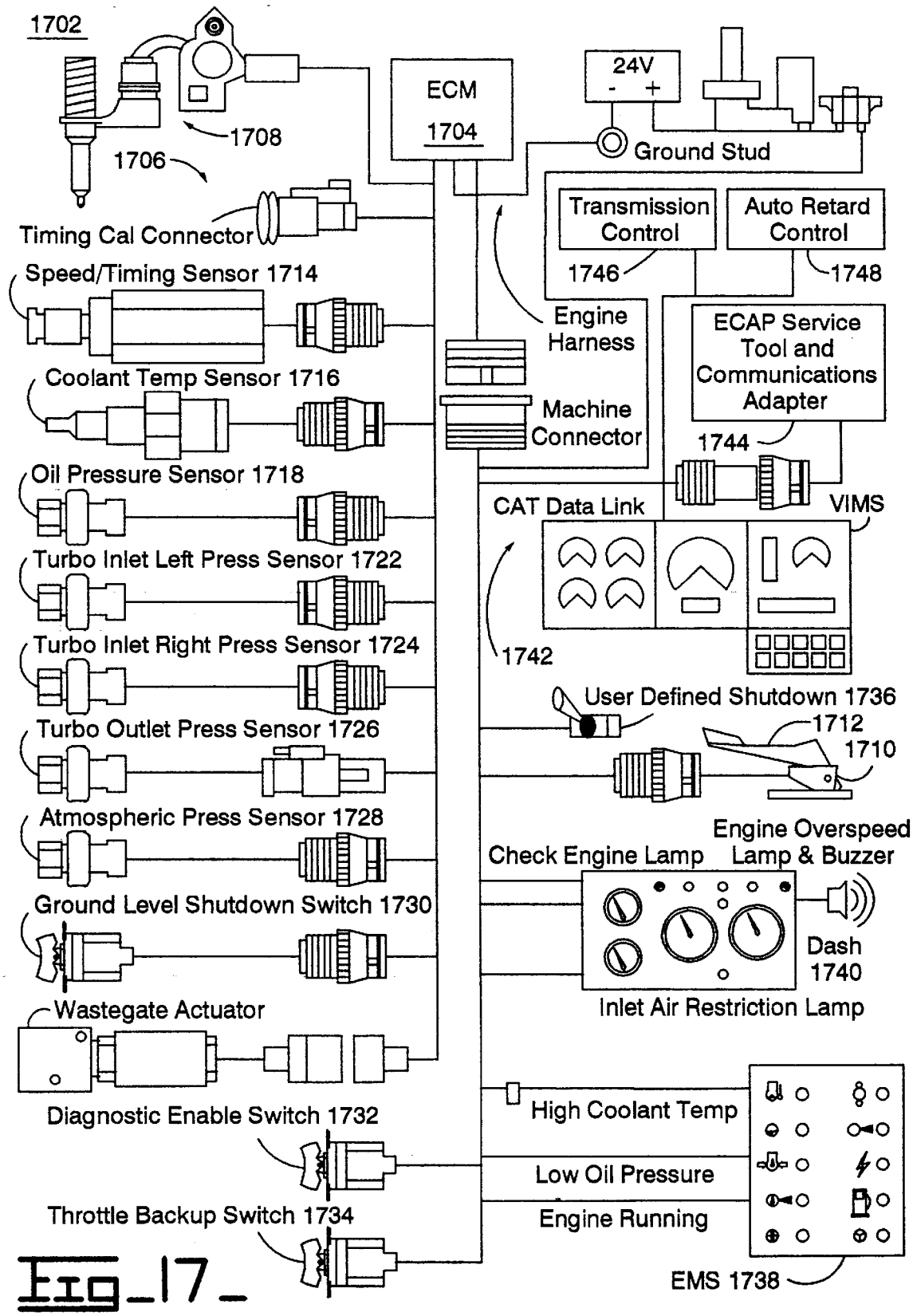
FIG. 17 is a diagrammatic view of a diesel engine control system.

With reference to FIG. 17, an exemplary diesel engine controller 1702 includes an electronic control module or ECM 1704 and a personality module. Preferably, the ECM 1704 includes one or more microprocessors. The personality module is the software for the ECM 1704 and also stores the operating maps that define certain operating curves, e.g., horsepower and torque. The ECM 1704 and the personality module operate together, along with a plurality of sensors 1706 and a plurality of electronic unit injectors 1708 (only one of which is shown).

In general, the ECM 1704 receives information from the sensors 1706 and controls the diesel engine via actuation of the electronic unit injectors 1708. A pedal position sensor 1710 connected to a throttle 1712 also delivers relevant information to the ECM 1704.

In one embodiment, the plurality of sensors 1706 includes an engine speed or timing sensor 1714, an engine coolant temperature sensor 1716, an engine oil pressure sensor 1718, a turbocharger compressor inlet (left and right) pressure sensors 1722,1724, a turbo outlet pressure sensor 1726 and an atmospheric pressure sensor 1728.

The ECM 1704 determines a desired engine speed based on the throttle position and certain diagnostic codes. The ECM 1704 maintains the desired engine speed by sensing actual engine speed using the engine speed sensor 1714 and determining the amount of fuel to inject to achieve the desired engine speed.

The ECM 1704 controls the amount of fuel injected by varying electrical signals to the electronic unit injectors 1708. The injectors 1708 will inject fuel only if the injector solenoid is energized. The ECM 1704 delivers a 105 volt signal to the solenoid to energize it. By controlling the timing and duration of the 105 volt signal, the ECM 1704 can control injection timing and amount.

A number of switches provide additional information to the ECM 1704. In one embodiment, the diesel engine controller 1702 includes a ground level shutdown switch 1730, a diagnostic enable switch 1732, a throttle backup switch 1734, and a user defined shutdown 1736.

A number of devices provide information to an operator. An electronic monitoring system (EMS) 1738, e.g., provides the operator with indications that the engine is operating and indications of high coolant temperatures and low oil pressures. Dash board indicators 1740 may include additional indicators, e.g., a check engine lamp and an engine overspeed buzzer.

Some of the devices discussed above are connected directly to the ECM 1704 and others are connected to the ECM 1704 via a communications or services link 1742. The communications link 1742 also provides connection to a service tool 1744 and may also provide communications to other control modules, e.g., a transmission control 1746, an auto retard control 1748, and/or a vital information monitoring system (VIMS) 1750.

While one diesel engine controller is generally described above, it should be noted that the present invention is not limited to a particular arrangement. The arrangement discussed above and other diesel engine controllers are well known in the art and are therefore not further discussed.

D. Natural Gas Engine Controller

As stated above, the Application Builder 102 is adaptable to produce control software for different types of target controllers.

Figure 18:
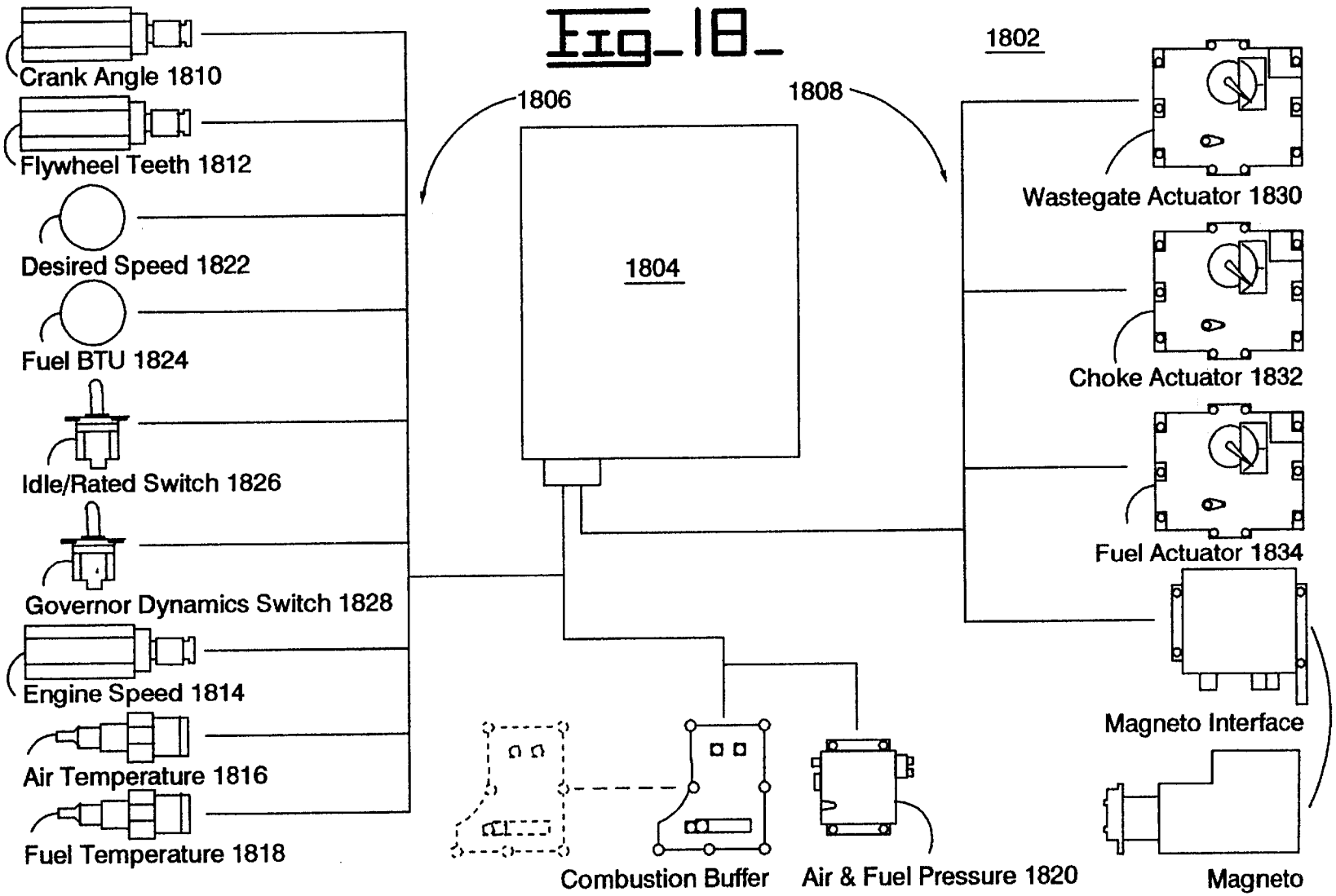
FIG. 18 is a diagrammatic view of a natural gas engine control system.

With reference to FIG. 18, an exemplary natural gas engine controller 1802 includes an electronic control module or ECM 1804 and a personality module. Preferably, the ECM 1804 includes one or more microprocessors. The personality module contains the software for the ECM 1804 and also stores the operating maps that define certain operating curves, e.g., horsepower and torque. The ECM 1804 and the personality module operate together, along with a plurality of sensors 1806 and a plurality of actuators 1808.

In general, the ECM 1804 receives information from the sensors 1806 and controls the engine 106 via the actuators 1808.

In one embodiment, the plurality of sensors 1806 includes a crank angle sensor 1810, a flywheel teeth sensor 1812, an engine speed sensor 1814, an air temperature sensor 1816, a fuel temperature sensor 1818, and a combined air and fuel pressure sensor 1820. The ECM 1804 also receives relevant information from a desired speed potentiometer 1822, a fuel BTU potentiometer 1824, an idle/rated switch 1826 and a governor dynamics switch 1828.

Operation of the natural gas engine 104 is controlled through the various actuators 1808. In the illustrated embodiment, the engine 104 is controlled via a wastegate actuator 1830, a choke actuator 1832, and a fuel actuator 1834.

E. Inputting the Target Controller's Specifications

Using the options under the Program menu, the user configures and defines the specifications of the target application builder 102. The specifications of the target controller are known as configuration data.

In the illustrated embodiment, the Application Builder 102 is adapted to produce the control software for a controller for a diesel engine and for a controller for an engine which runs on natural gas. Software engineers design and program core software routines. The Application Builder 102 combines the core software routines and the configuration data to produce the control software.

Figure 19:
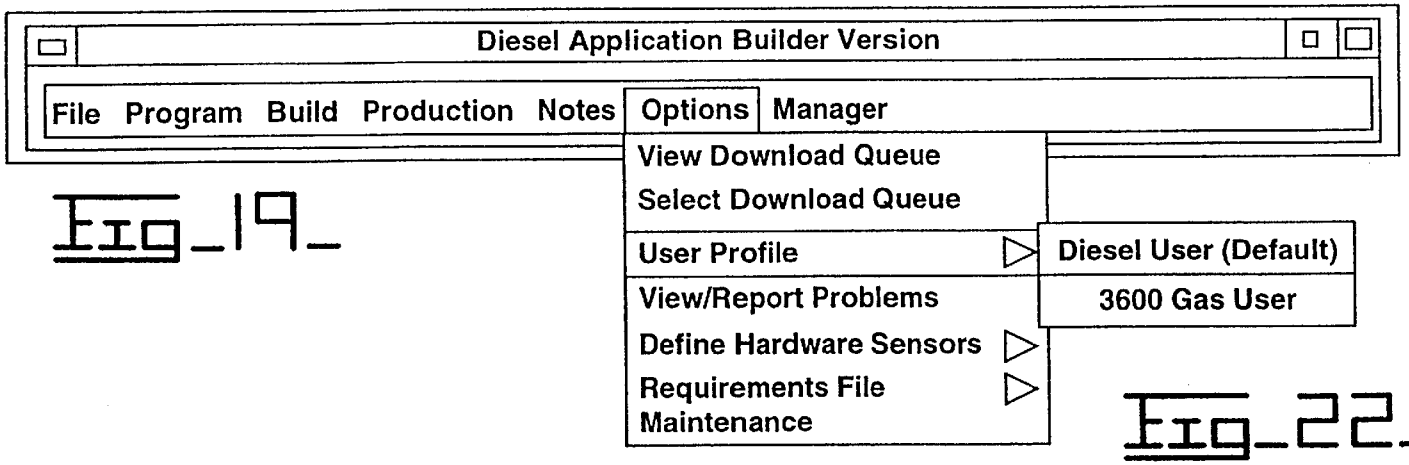
FIG. 19 is a diagrammatic view of the main menu of the Application Builder of FIG. 3 showing the Options Menu Structure.

As shown in FIG. 19, the target controller is defined via a User Profile option under the Options menu. Currently, the two available options are Diesel User and 3600 Gas User. The default option is Diesel User. Selection of the diesel option selects a diesel engine controller as the target controller. Selection of 3600 Gas User selects a natural gas engine controller for the 3600 Series Engine.

1. Inputting the Specifications for a Diesel User

If the default option or the diesel option is selected from the Options >> User Profile (menu >> sub-menu), the Application Builder 102 will enable the user to input data required to produce the control software for a diesel engine controller. The target diesel engine controller specifications are input via the Program menu on the Pull Down Menu Bar 204 on the Main Screen of Application Builder 102. As shown in FIG. 4, the specifications are separated into eight (8) categories: Fuel Features, Timing Features, Speed Features, Engine Core Features, Engine Modes, Service Features, Peripheral Features, and Hardware Features.

The fuel features define those features that monitor how much fuel is needed by the engine. The timing features are used to control the timing of the engine. The speed features are features that are used to control the desired engine speed. The engine core features control the engine's governor. The engine mode features define specific engine operating modes. The service features configure the interface to the ECAP service tool. The peripheral features define features which are controlled by the engine controller which are not related to the engine. The hardware features are used to configure the hardware inputs and outputs.

a. Fuel Features

As stated above, the fuel features define those features that monitor how much fuel is needed by the engine. With reference to FIGS. 20–35, the fuel features are subdivided into torque features, smoke features, cold smoke features, variable smoke features, rack compensation features, rail pressure features, rail pressure advance on acceleration features, and rail pressure ceiling parameters.

Figure 20:
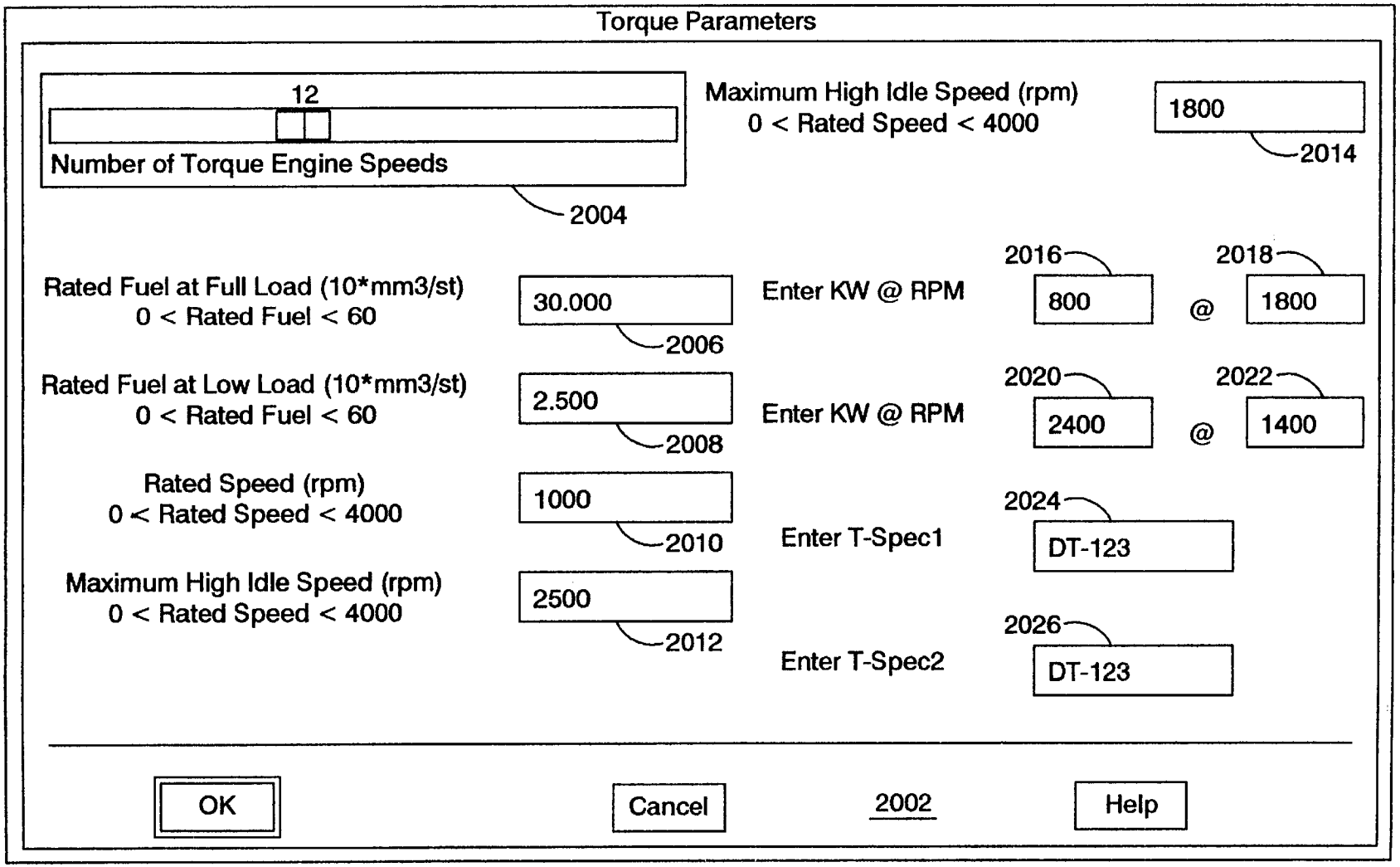
FIG. 20 is a diagrammatic view of a Torque Parameters Window.
Figure 21:
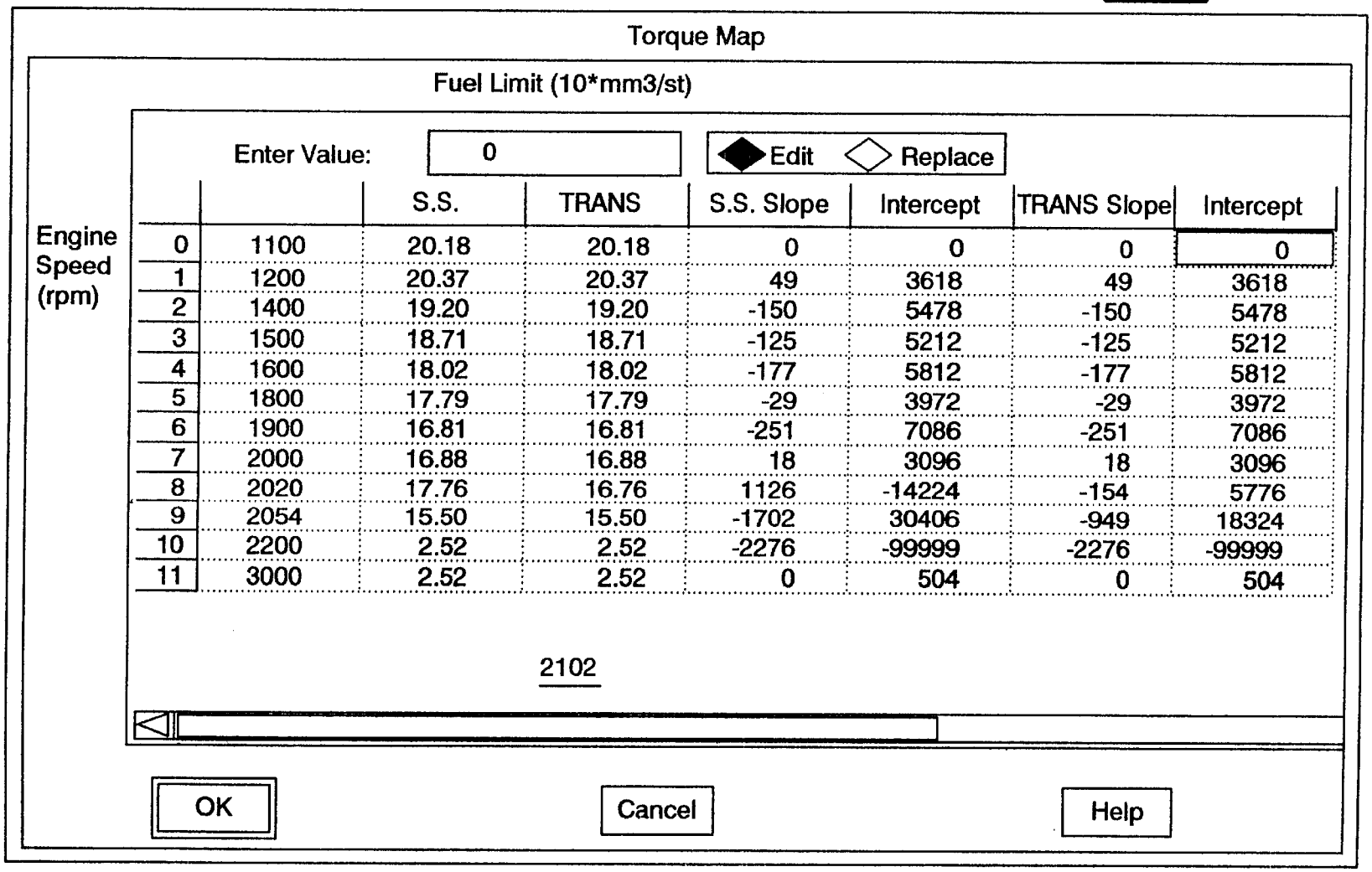
FIG. 21 is a diagrammatic view of a Torque Map Window.

With particular reference to FIGS. 20–21, the torque features include torque parameters and a torque map. A Torque Parameters Window 2002 allows entry of various torque parameters. In the preferred embodiment, the Torque Parameters Window 2002 includes a slider bar 2004 for entry of the number of torque engine speeds and text entry boxes 2006,2008,2010,2012,2014,2016,2018,2020,2024, 2026 for entry of various constants. A Torque Map Window 2102 allows entry of the torque map. The size of the torque map is determined by the slider bar 2004. Generally, the torque features are used to control engine output torque over the full range of engine operating speeds.

Figure 22:
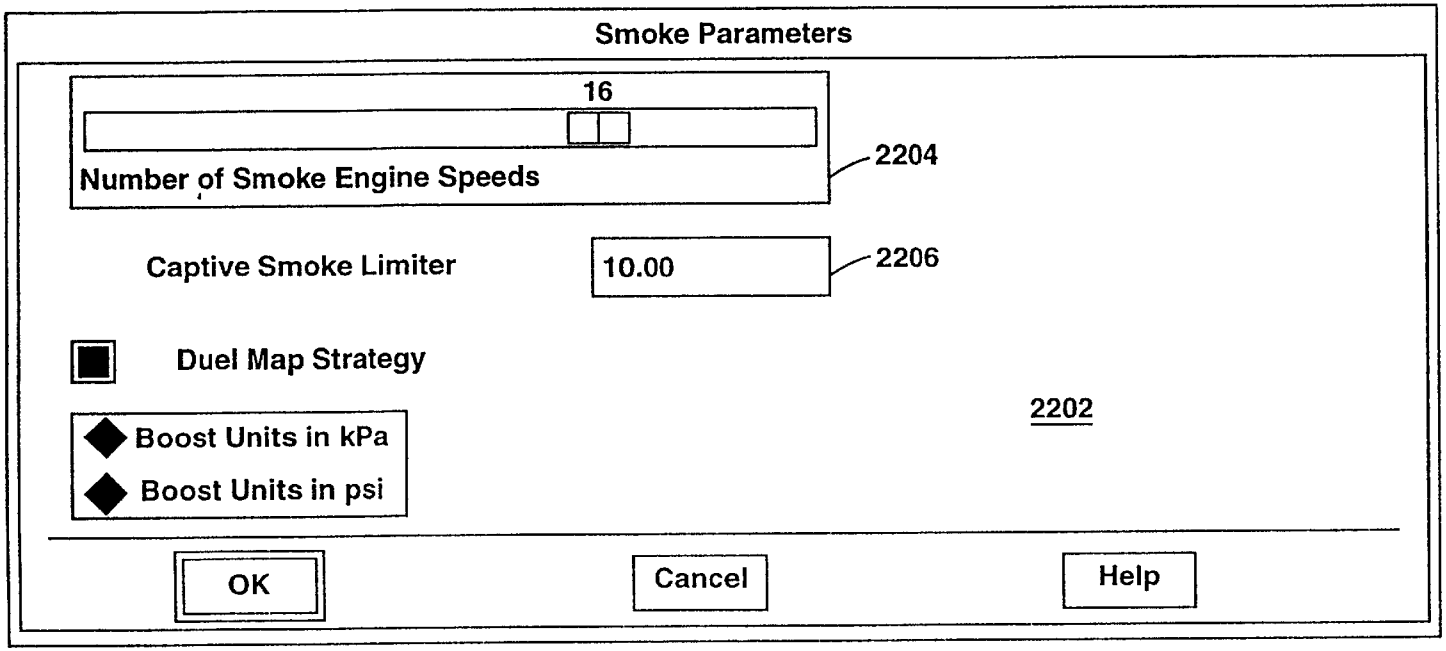
FIG. 22 is a diagrammatic view of a Smoke Parameters Window.
Figure 23:
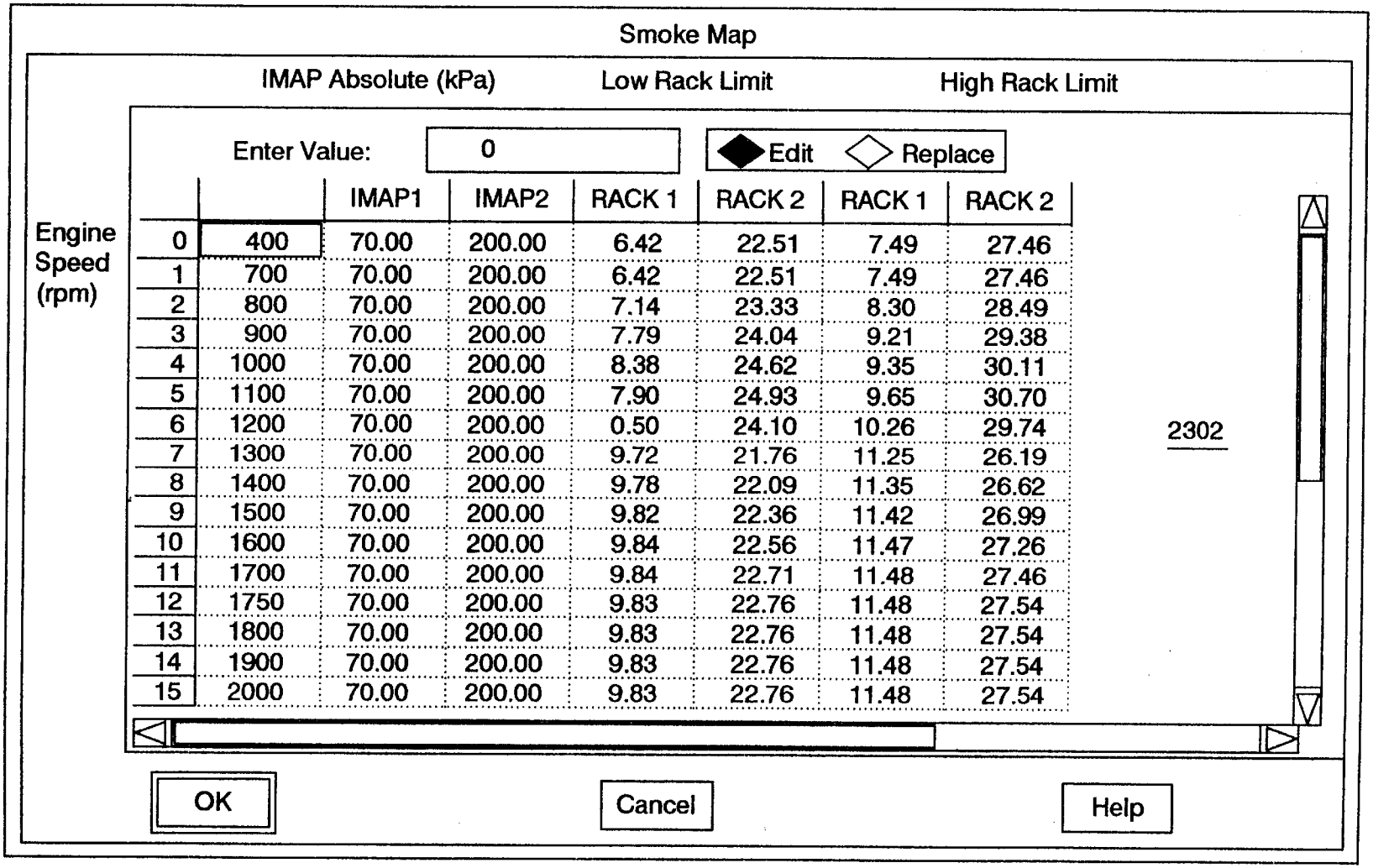
FIG. 23 is a diagrammatic view of a Smoke Map Window.

With particular reference to FIGS. 22–23, the smoke features include smoke parameters and a smoke map. A Smoke Parameters Window 2202 allows entry of various smoke parameters. In the preferred embodiment, the Smoke Parameters Window 2202 includes a slider bar 2204 for entry of the number of cold smoke engine speed and a text field 2206 for entry of a captive smoke limiter. A Smoke Map Window 2302 allows entry of the smoke map. The size of the smoke map is determined by the slider bar 2204. Generally, the smoke features are used to reduce emissions and maintain engine response time during engine acceleration.

Figure 24:
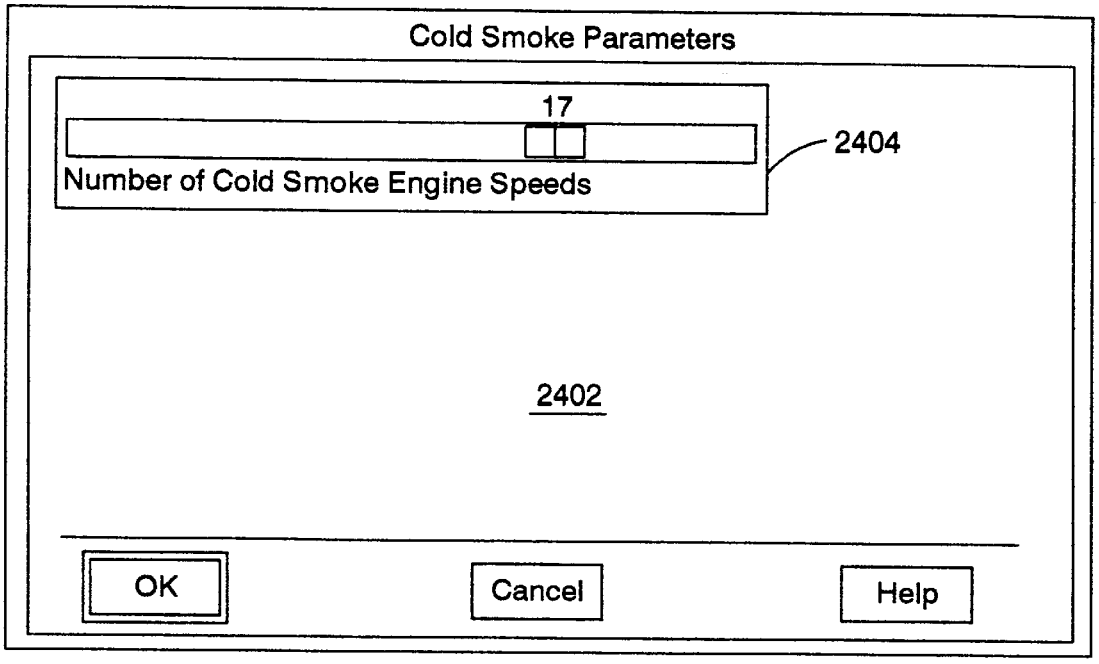
FIG. 24 is a diagrammatic view of a Cold Smoke Parameters Window.

With particular reference to FIGS. 24–25, the cold smoke features include cold smoke parameters and a cold smoke map. A Cold Smoke Parameters Window 2402 includes a slider bar 2204 for entry of the number of cold smoke engine. A Cold Smoke Map Window 2302 allows entry of the smoke map. The size of the cold smoke map is determined by the slider bar 2404. Generally, the cold smoke features are used to achieve or maintain proper engine operating temperature.

Figure 26:
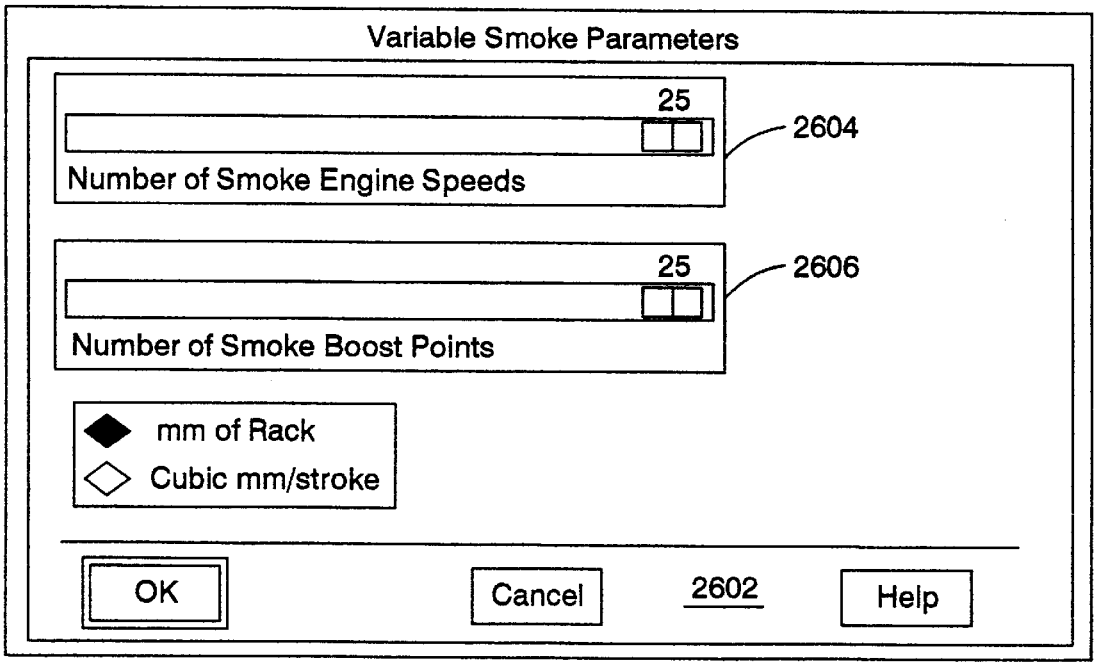
FIG. 26 is a diagrammatic view of a Variable Smoke Parameters Window.
Figure 27:
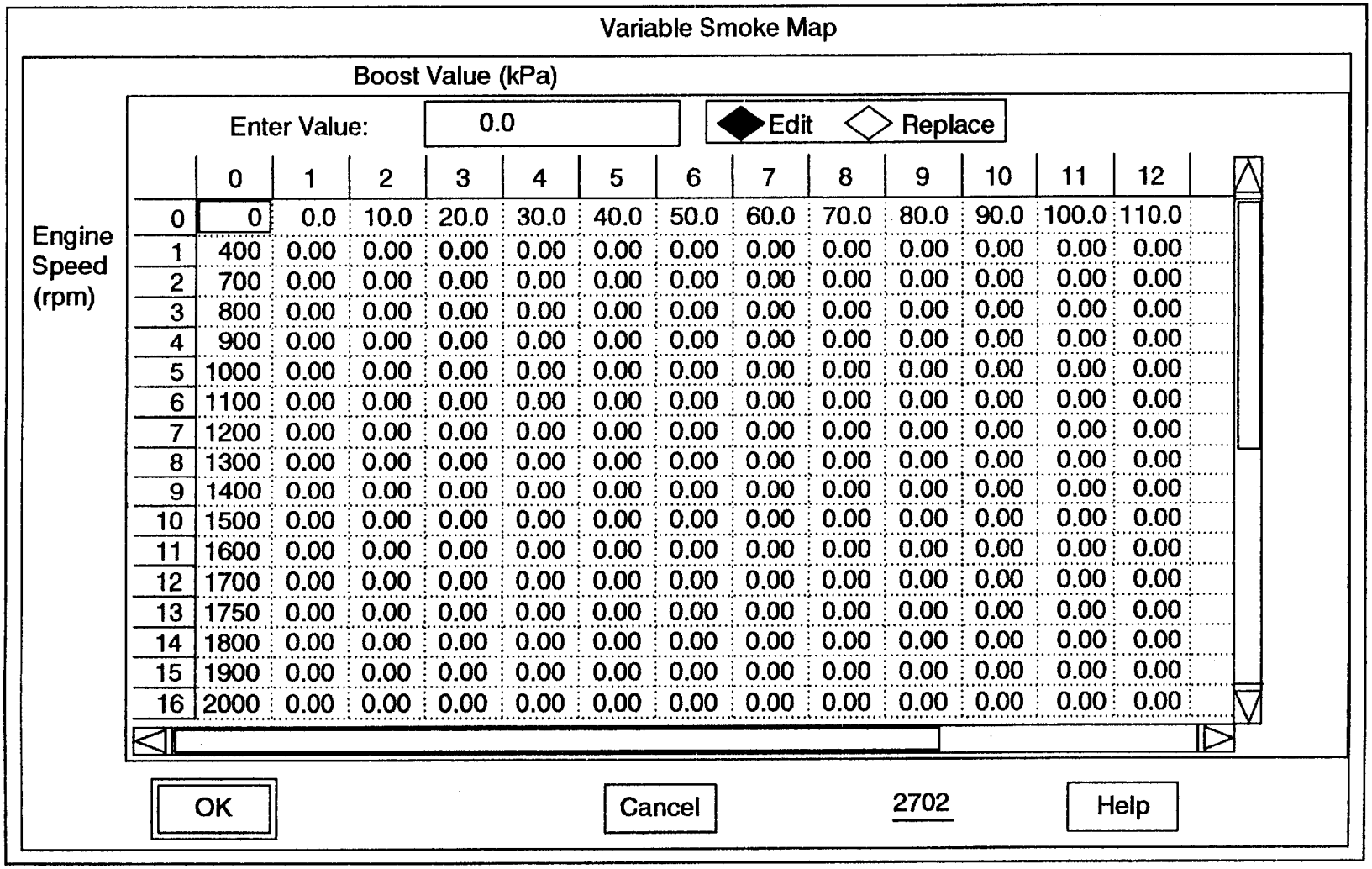
FIG. 27 is a diagrammatic view of a Variable Smoke Map Window.

With particular reference to FIGS. 26–27, the variable smoke features include variable smoke parameters and a variable smoke map. A Variable Smoke Parameters Window 2602 allows entry of various variable smoke parameters. In the preferred embodiment, the Variable Smoke Parameters Window 2602 includes first and second slider bars 2604, 2606 for entry of the number of smoke engine speeds and for the entry of the number of smoke boost points, respectively. A Variable Smoke Map Window 2702 allows entry of the variable smoke map. The size of the variable smoke map is determined by the slider bars 2604,2606.

Figure 28:
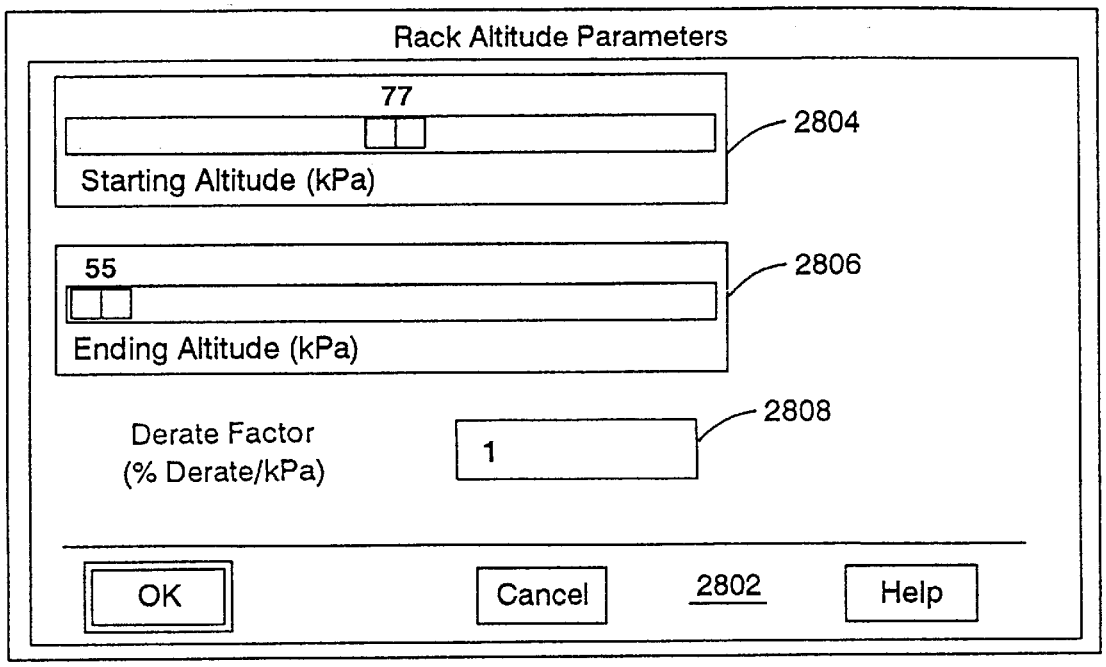
FIG. 28 is a diagrammatic view of a Rack Altitude Parameters Window.

With particular reference to FIG. 28, a Rack Altitude Parameters Window 2802 includes first and second slider bars 2804,2806 and a text box for entry of a starting altitude, an ending altitude and a derate factor, respectively. Generally, the rack altitude features are used to derate power output of the engine according to operating altitude.

Figure 29:
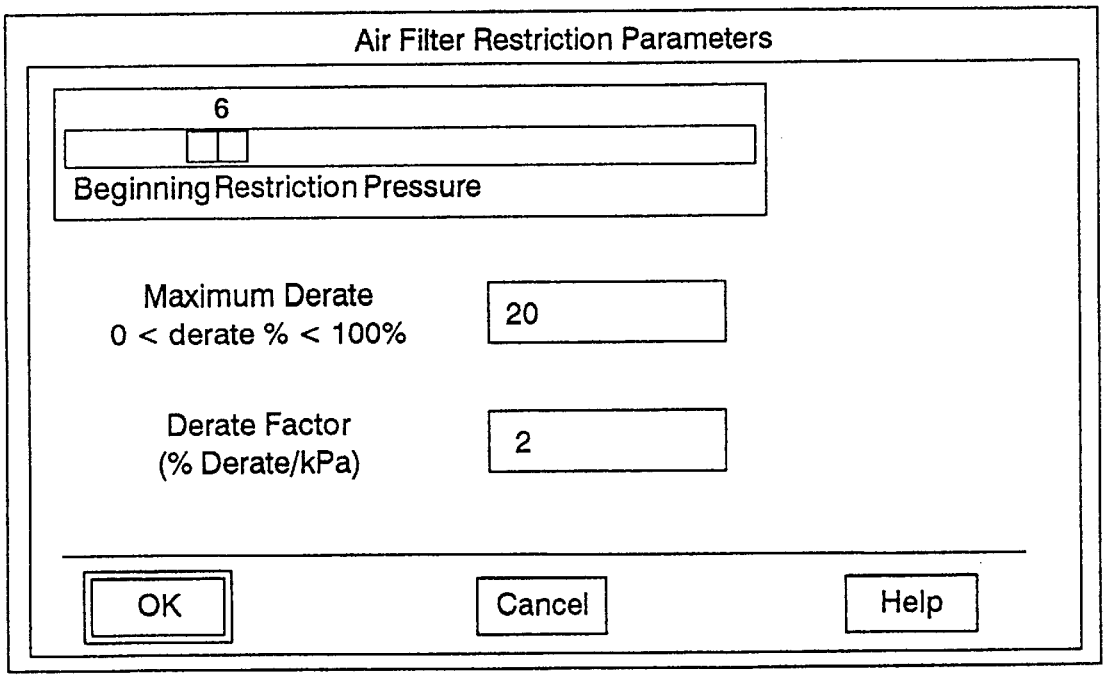
FIG. 29 is a diagrammatic view of an Air Filter Restriction Parameters Window.

With particular reference to FIG. 29, an Air Filter Restriction Parameters Window 2902 includes a slider bar 2904 and first and second text entry fields for entry of a beginning restriction pressure, a maximum derator, and a derate factor, respectively.

Figure 30:
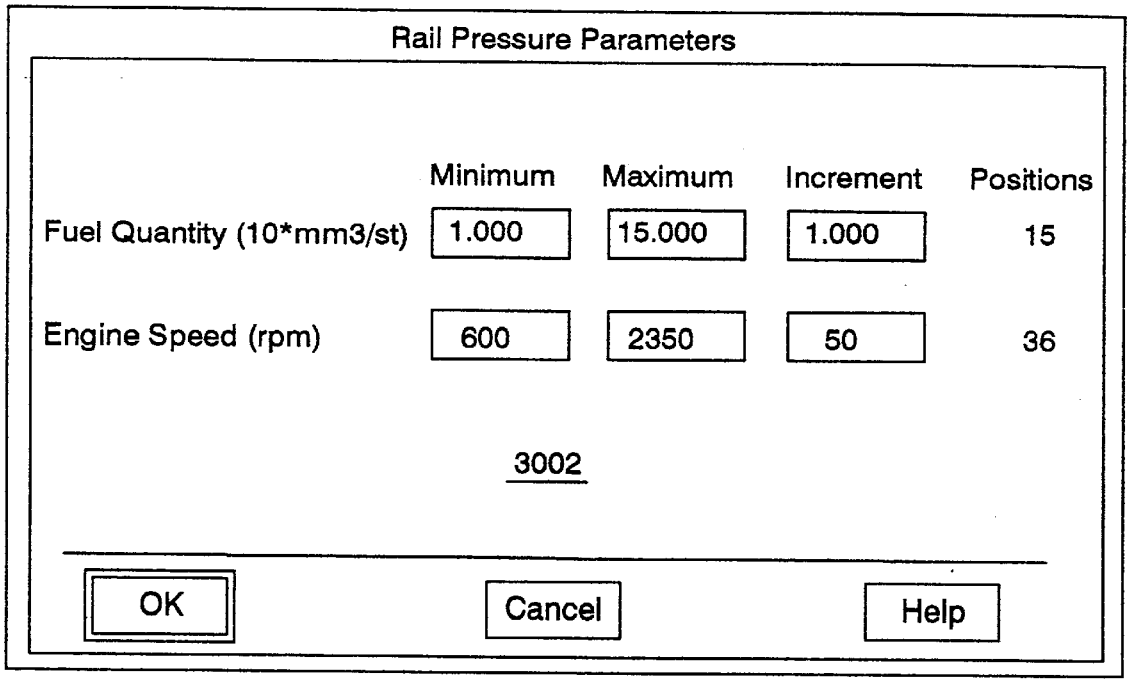
FIG. 30 is a diagrammatic view of a Rail Pressure Parameters Window.

With particular reference to FIGS. 30–31, the rail pressure features include rail pressure parameters and a rail pressure map. A Rail Pressure Parameters Window 3002 allows entry of various rail pressure parameters. In the preferred embodiment, the Rail Pressure Parameters Window 3002 includes text entry fields for entering a rail pressure map. A Rail Pressure Map Window 3102 allows entry/modification of the rail pressure map.

Figure 32:
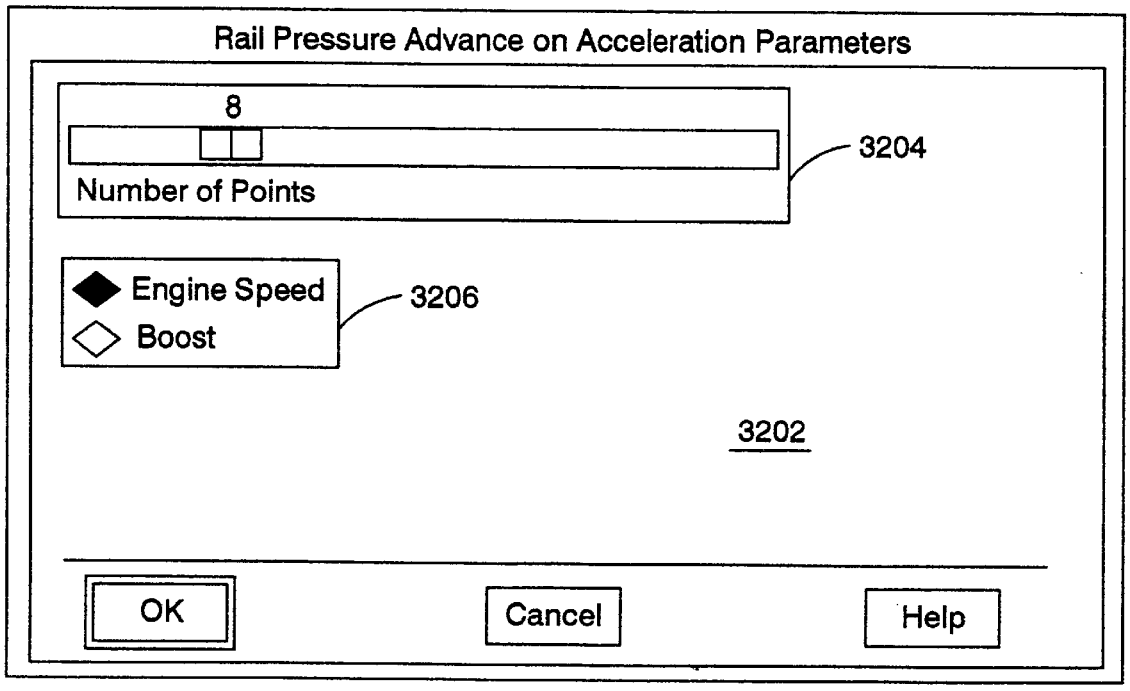
FIG. 32 is a diagrammatic view of a Rail Pressure Advance on Acceleration Parameters Window.
Figure 33:
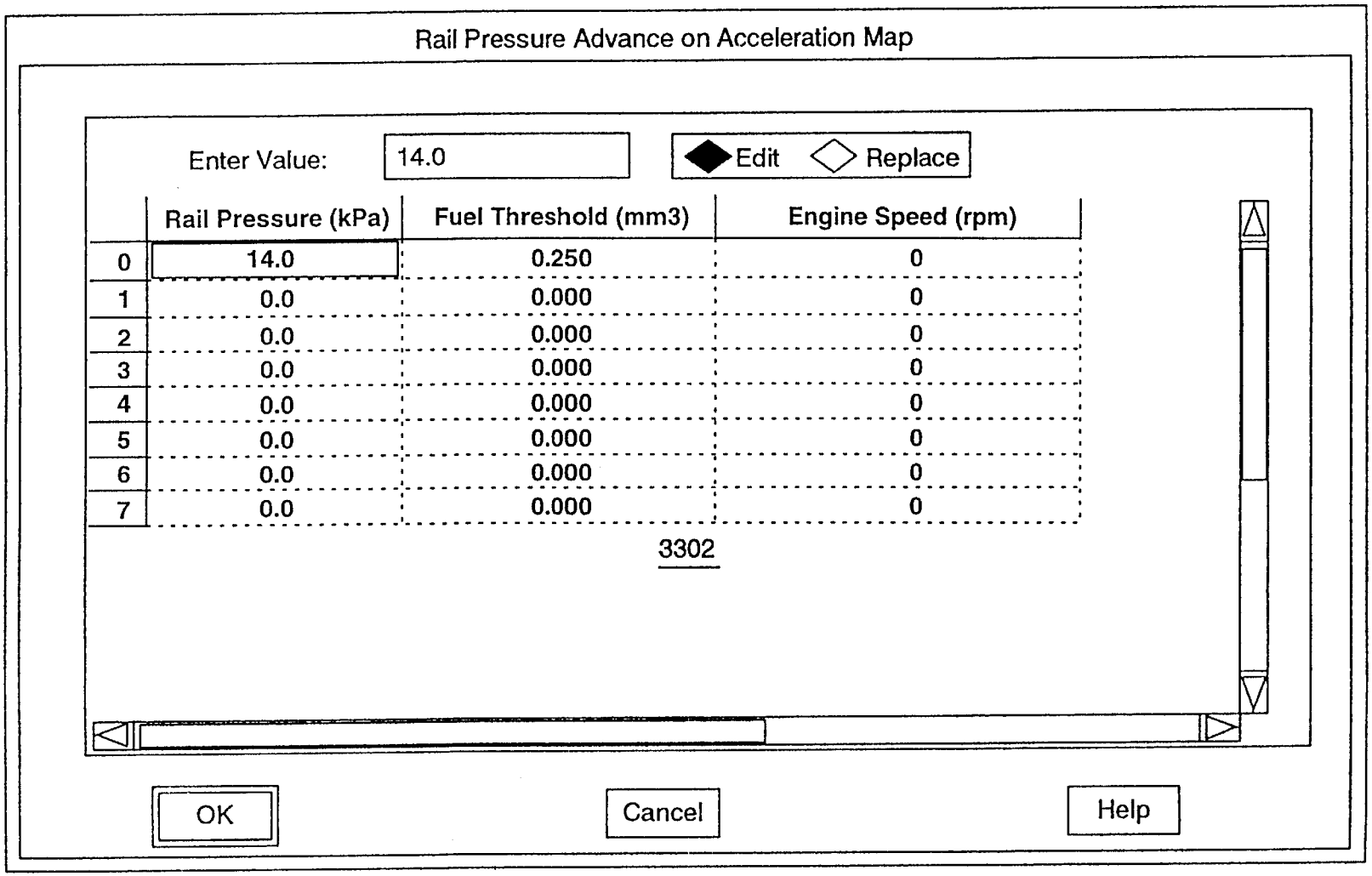
FIG. 33 is a diagrammatic view of a Rail Pressure Advance on Acceleration Map Window.

With particular reference to FIGS. 32–33, the Rail Pressure Advance on Acceleration Features include rail pressure advance on acceleration parameters and a rail pressure advance on acceleration map. A Rail Pressure Advance on Acceleration Parameters Window 3202 allows entry of parameters. In the preferred embodiment, the Rail Pressure Advance on Acceleration Parameters Window 3202 includes a slider bar 3204 and a radio box 3206 for sizing the rail pressure advance on acceleration map and for determining whether the map will contain engine speed or boost values. A Rail Pressure Advance on Acceleration Map Window 3302 allows entry of the rail pressure advance on acceleration map.

With particular reference to FIGS. 34–35, the rail pressure ceiling features include rail pressure ceiling parameters and a rail ceiling pressure map. A Rail Pressure Ceiling Parameters Window 3402 allows entry of various rail pressure parameters. In the preferred embodiment, the Rail Pressure Ceiling Parameters Window 3402 includes text entry fields for entering a rail pressure ceiling map. A Rail Pressure Ceiling Map Window 3502 allows entry/modification of the rail pressure ceiling map.

b. Timing Features

As stated above, the timing features defined are used to control the timing of the engine. With reference to FIGS. 36–53, the timing features are subdivided into master timing features, ceiling timing features, conditional timing features, advance on acceleration features, cold advance on acceleration features, ramp style advance on acceleration features, inlet air temperature, altitude timing features, and high altitude timing features.

Figure 37:
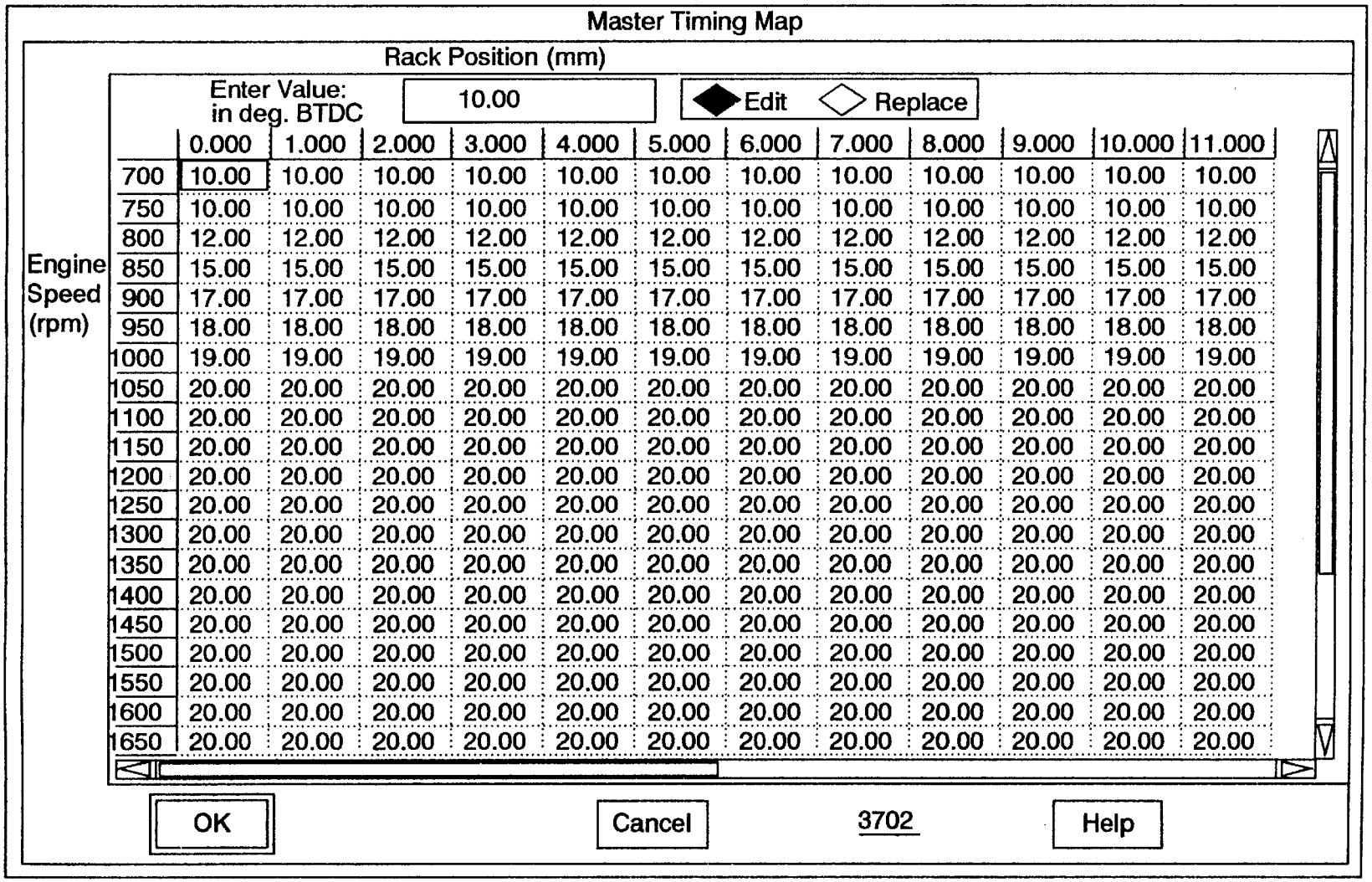
FIG. 37 is a diagrammatic view of a Master Timing Map Window.

With particular reference to FIGS. 36–37, the master timing features include master timing parameters and a master timing map. A Master Timing Parameters Window 3602 allows entry of various master timing parameters. In the preferred embodiment, the Master Timing Parameters Window 3602 includes text entry fields for entering a master timing map. A Master Timing Map Window 3702 allows entry/modification of the master timing map. Generally, the master timing features control peak cylinder pressure, exhaust temperature, and smoke emission by providing appropriate desired timing values for dynamic values of engine speed and load.

Figure 38:
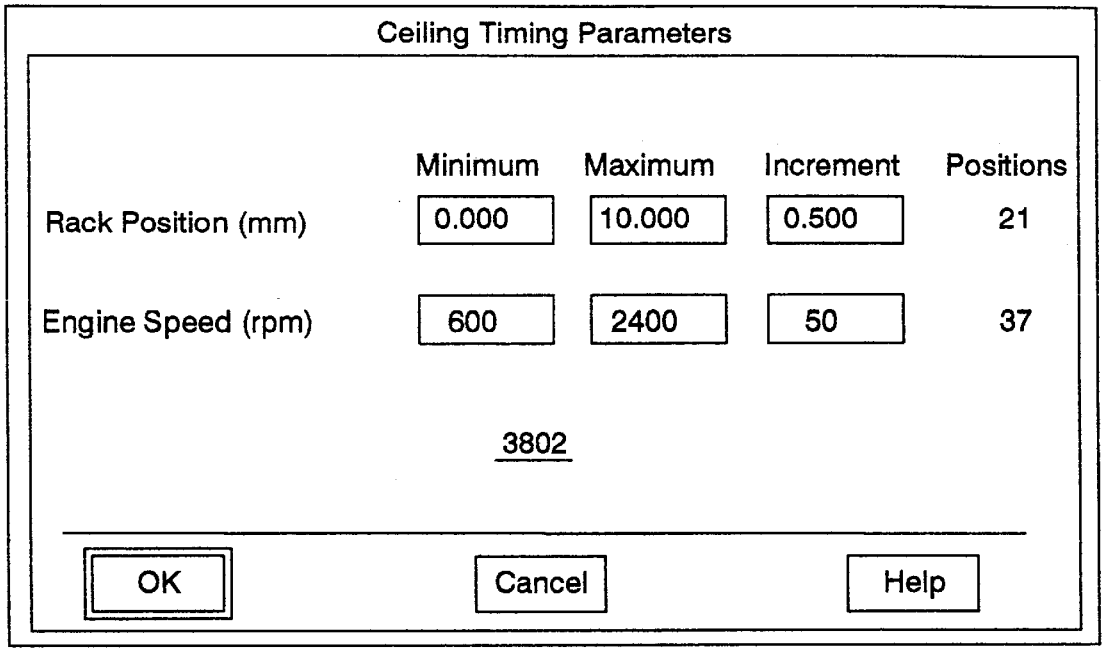
FIG. 38 is a diagrammatic view of a Ceiling Timing Parameters Window.

With particular reference to FIGS. 38–39, the ceiling timing features include ceiling timing parameters and a ceiling timing map. A Ceiling Timing Parameters Window 3802 allows entry of various ceiling timing parameters. In the preferred embodiment, the Ceiling Timing Parameters Window 3802 includes text entry fields for sizing the ceiling timing map. A Ceiling Timing Map Window 3902 allows entry/modification of the ceiling timing map.

Figure 40:
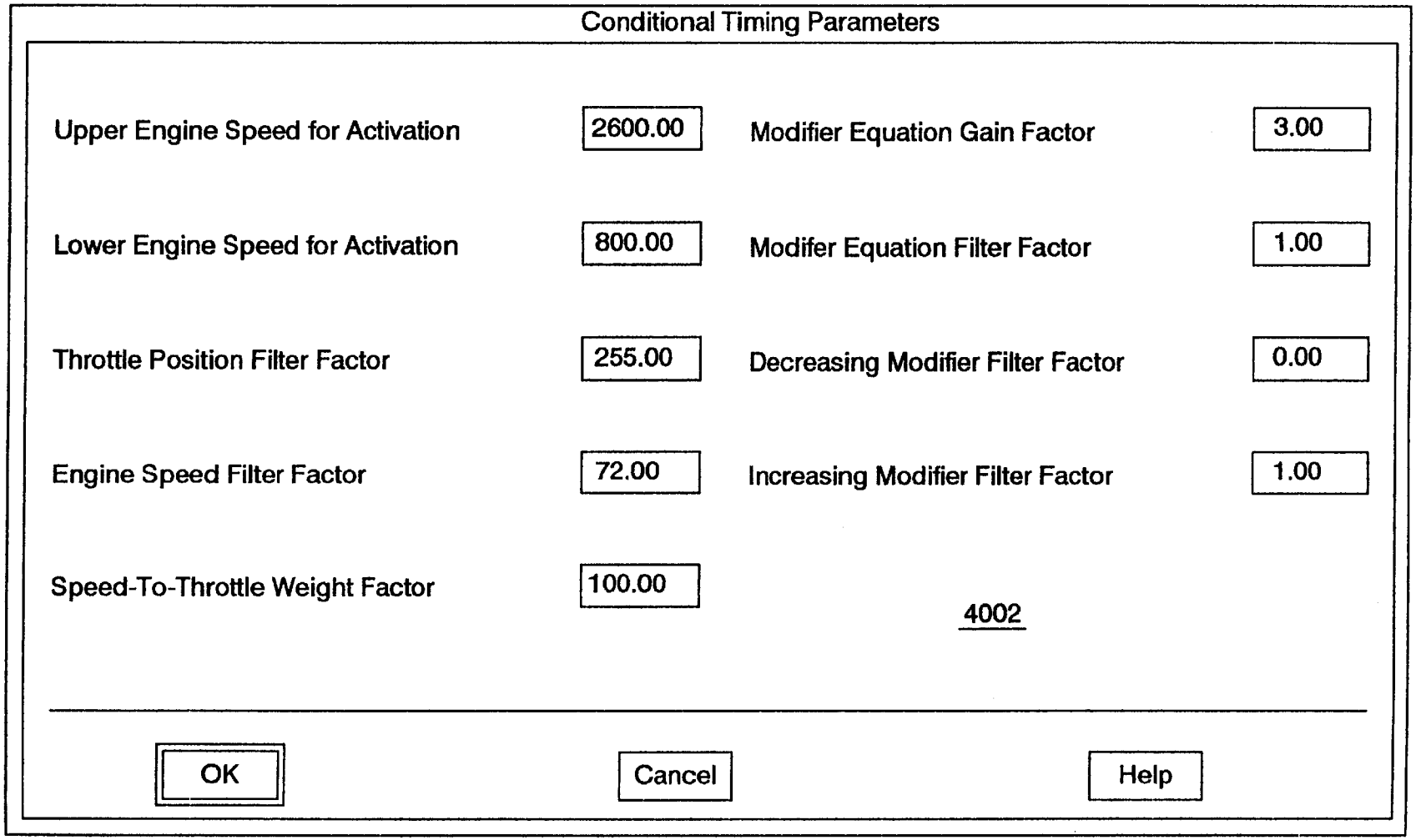
FIG. 40 is a diagrammatic view of a Conditional Timing Parameters Window.
Figure 41:
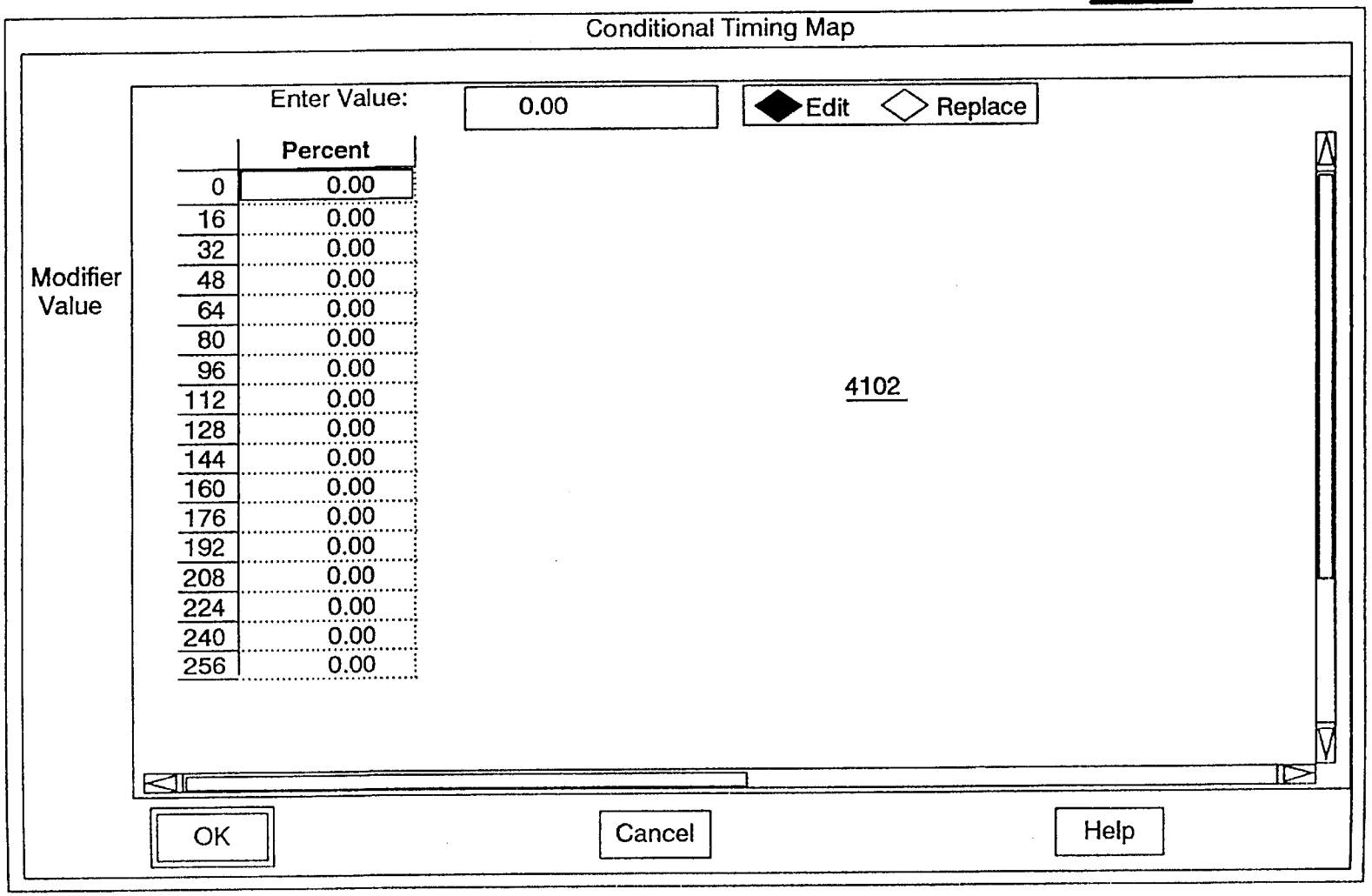
FIG. 41 is a diagrammatic view of a Conditional Timing Map Window.

With particular reference to FIGS. 40–41, the conditional timing features include conditional timing parameters and a conditional timing map. A Conditional Timing Parameters Window 4002 allows entry of various ceiling timing parameters. In the preferred embodiment, the Conditional Timing Parameters Window 4002 includes text entry fields for entering various parameters. A Conditional Timing Map Window 4102 allows entry/modification of the conditional timing map.

Figure 42:
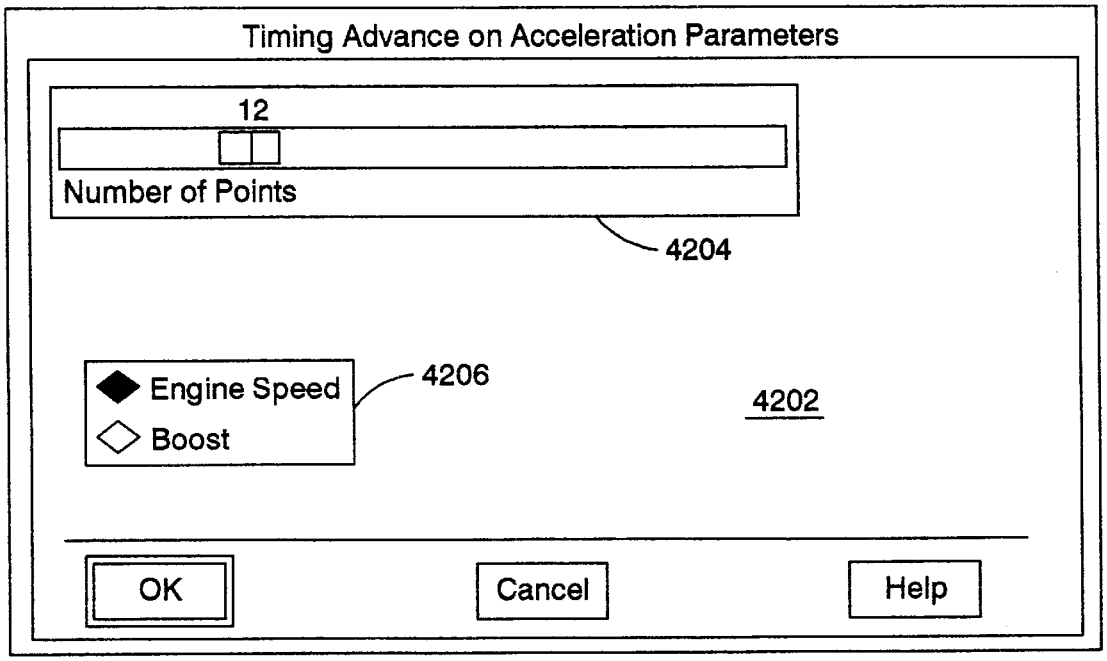
FIG. 42 is a diagrammatic view of an Advance on Acceleration Parameters Window.
Figure 43:
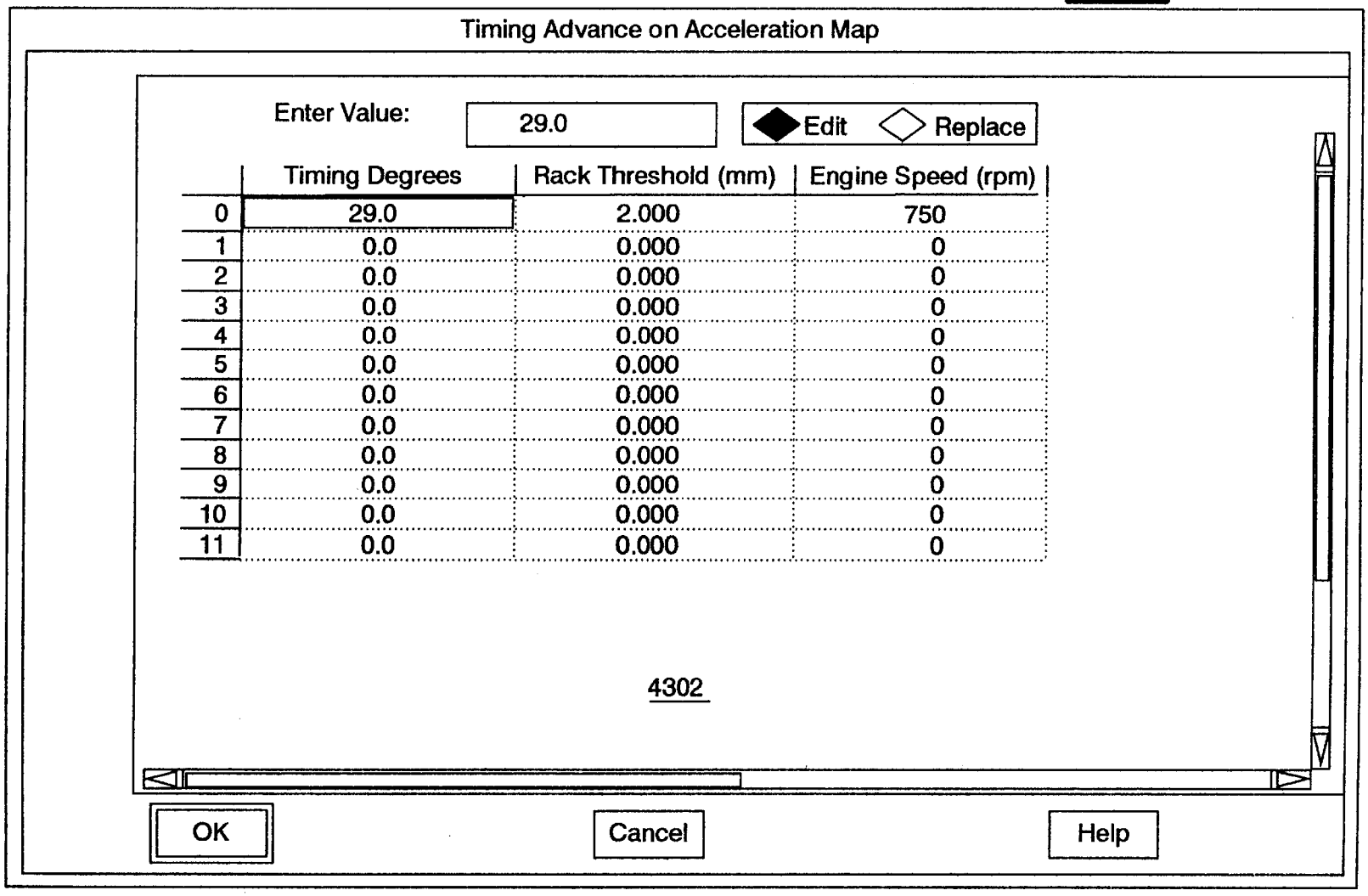
FIG. 43 is a diagrammatic view of an Advance on Acceleration Map Window.

With particular reference to FIGS. 42–43, the Advance on Acceleration Features include advance on acceleration parameters and an advance on acceleration map. An Advance on Acceleration Parameters Window 4202 allows entry of parameters. In the preferred embodiment, the Advance on Acceleration Parameters Window 4202 includes a slider bar 4204 and a radio box 4206 for sizing the advance on acceleration map and for determining whether the map will contain engine speed or boost values, respectively. An Advance on Acceleration Map Window 4302 allows entry of the rail pressure advance on acceleration map. Generally, the AOA features are used to advance fuel injection timing while the engine is accelerating and thereby reduce emissions.

Figure 44:
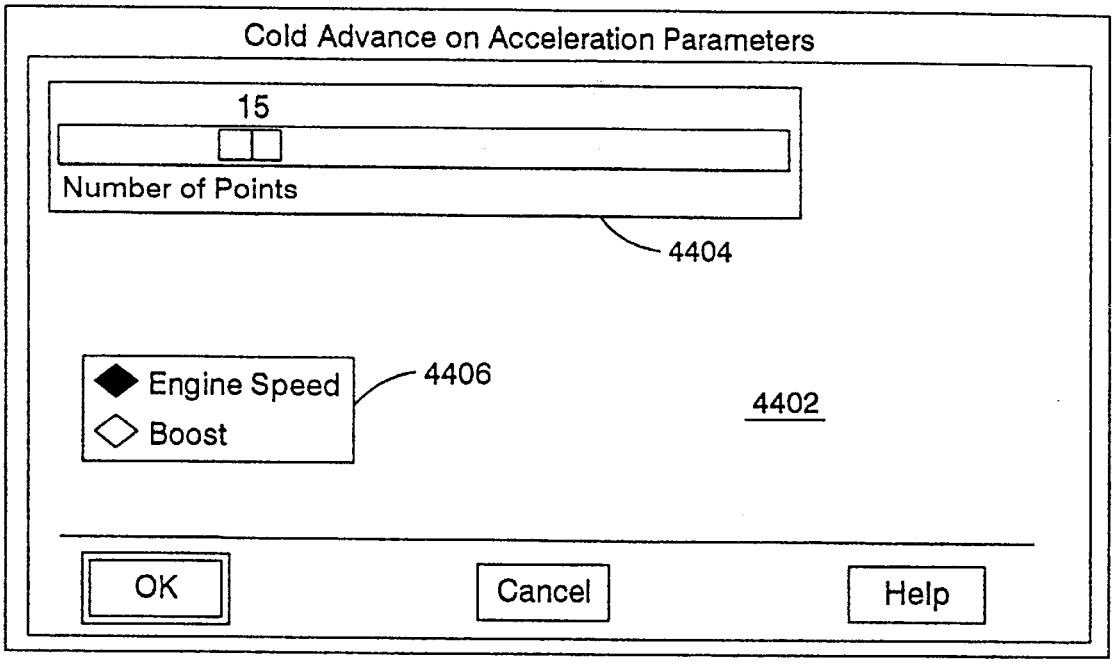
FIG. 44 is a diagrammatic view of a Cold Advance on Acceleration Parameters Window.
Figure 45:
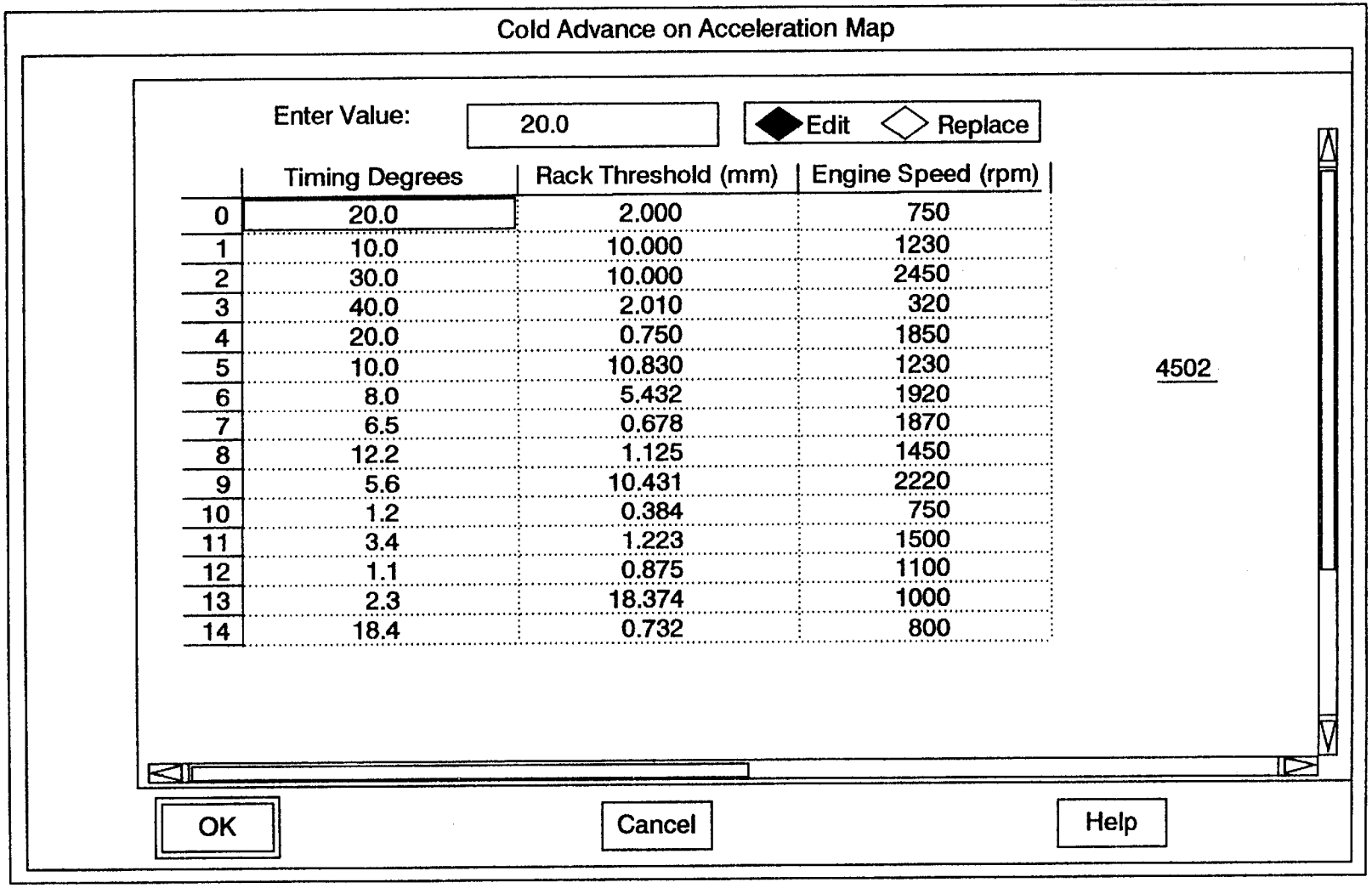
FIG. 45 is a diagrammatic view of a Cold Advance on Acceleration Map Window.

With particular reference to FIGS. 44–45, the Cold Advance on Acceleration Features include cold advance on acceleration parameters and a cold advance on acceleration map. A Cold Advance on Acceleration Parameters Window 4402 allows entry of parameters. In the preferred embodiment, the Cold Advance on Acceleration Parameters Window 4402 includes a slider bar 4404 and a radio box 4406 for sizing the advance on acceleration map and for determining whether the map will contain engine speed or boost values, respectively. A Cold Advance on Acceleration Map Window 4502 allows entry of the rail pressure advance on acceleration map. Generally, the cold engine AOA features are used to advance fuel injection timing when the fuel to air ratio is rich and thereby reduce emissions.

Figure 46:
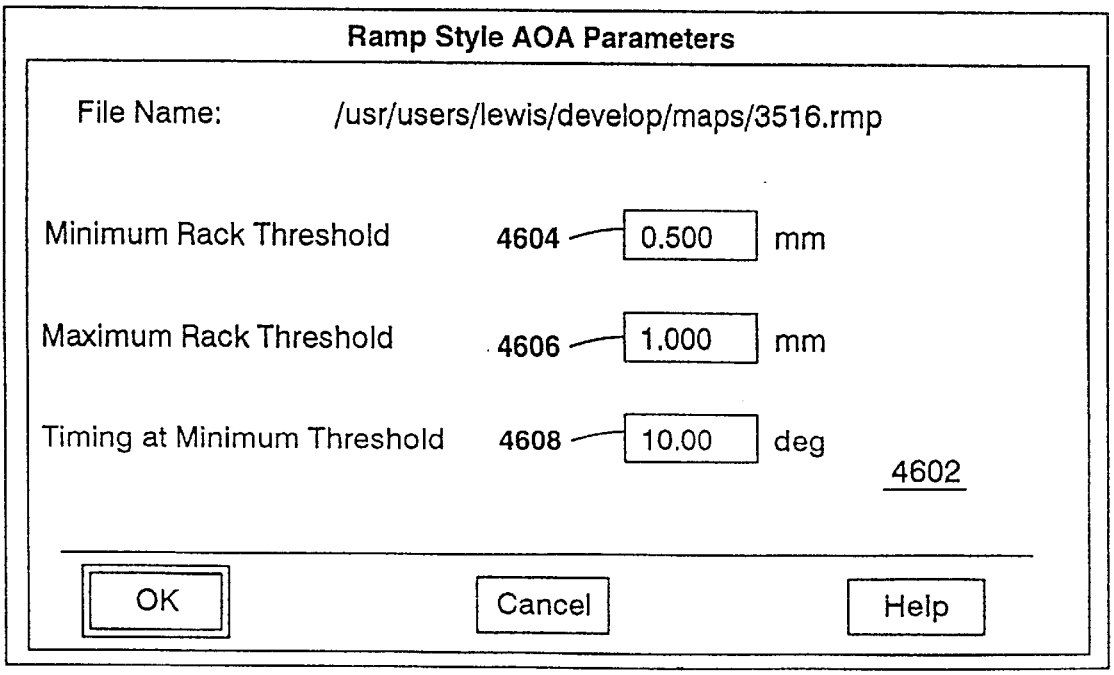
FIG. 46 is a diagrammatic view of a Ramp Style Advance on Acceleration Parameters Window.

With particular reference to FIG. 46, the Ramp Style Advance on Acceleration (AOA) Features include ramp style advance on acceleration parameters. A Ramp Style AOA Parameters Window 4602 includes three text entry fields 4604,4606,4608. In the preferred embodiment, the ramp style AOA parameters include minimum rack threshold, maximum rack threshold and timing at minimum threshold.

Figure 47:
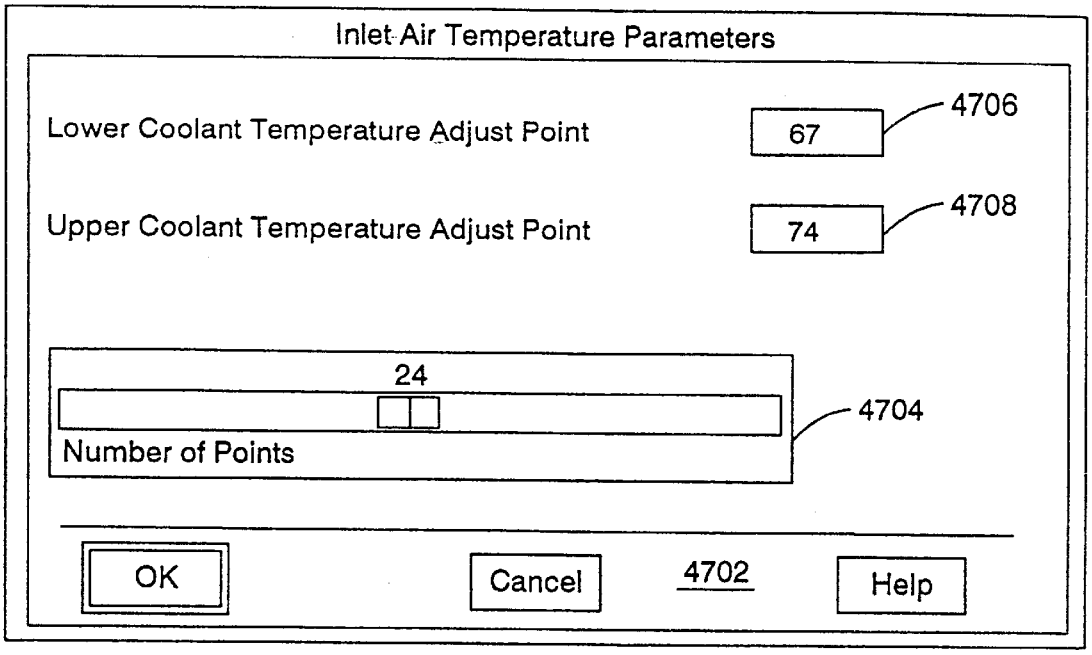
FIG. 47 is a diagrammatic view of an Inlet Air Temperature Parameters Window.
Figure 48:
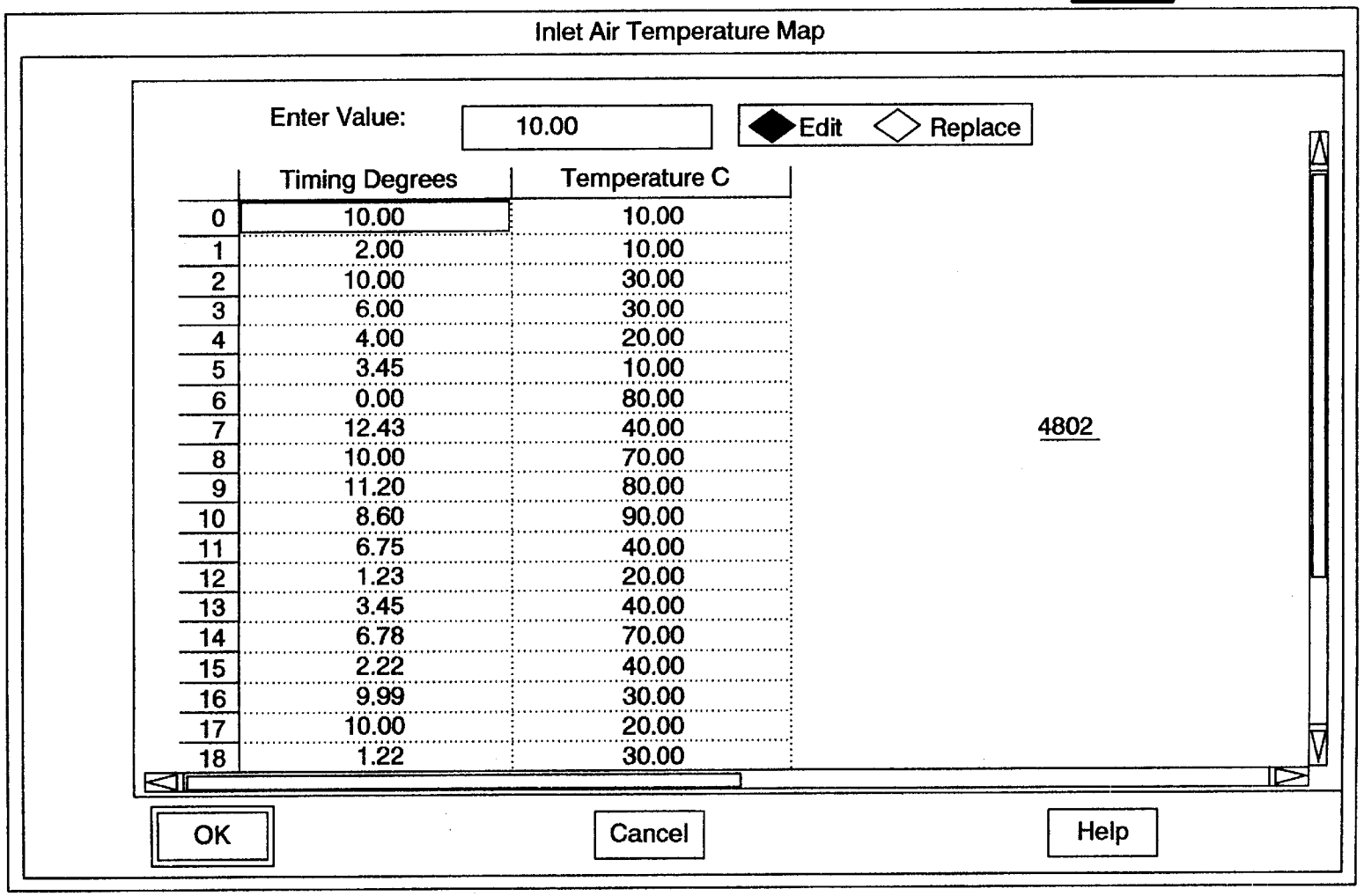
FIG. 48 is a diagrammatic view of an Inlet Air Temperature Map Window.

With particular reference to FIGS. 47–48, the Air Temperature Features include inlet air temperature parameters and an inlet air temperature map. An Inlet Air Temperature Parameters Window 4702 allows entry of parameters. In the preferred embodiment, the Inlet Air Temperature Parameters Window 4702 includes a slider bar 4704 and first and second text entry boxes 4706,4708 for sizing the inlet air temperature map and for entering a lower coolant temperature adjust point and an upper coolant adjust point, respectively. An Inlet Air Temperature Map Window 4802 allows entry of the inlet air temperature map.

Figure 49:
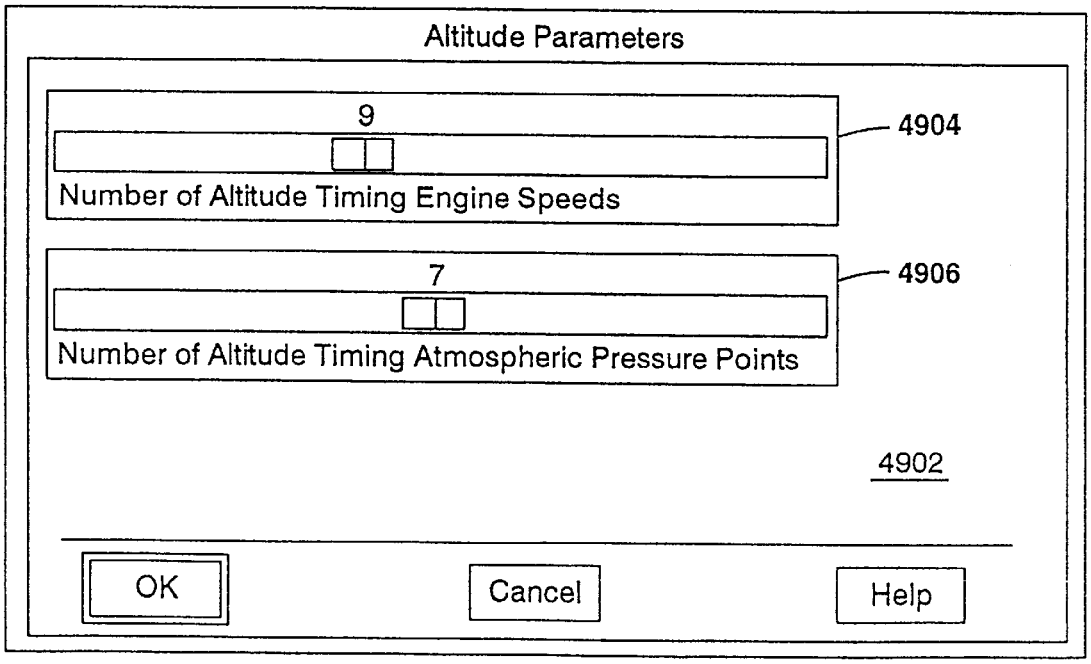
FIG. 49 is a diagrammatic view of an Altitude Timing Parameters Window.
Figure 50:
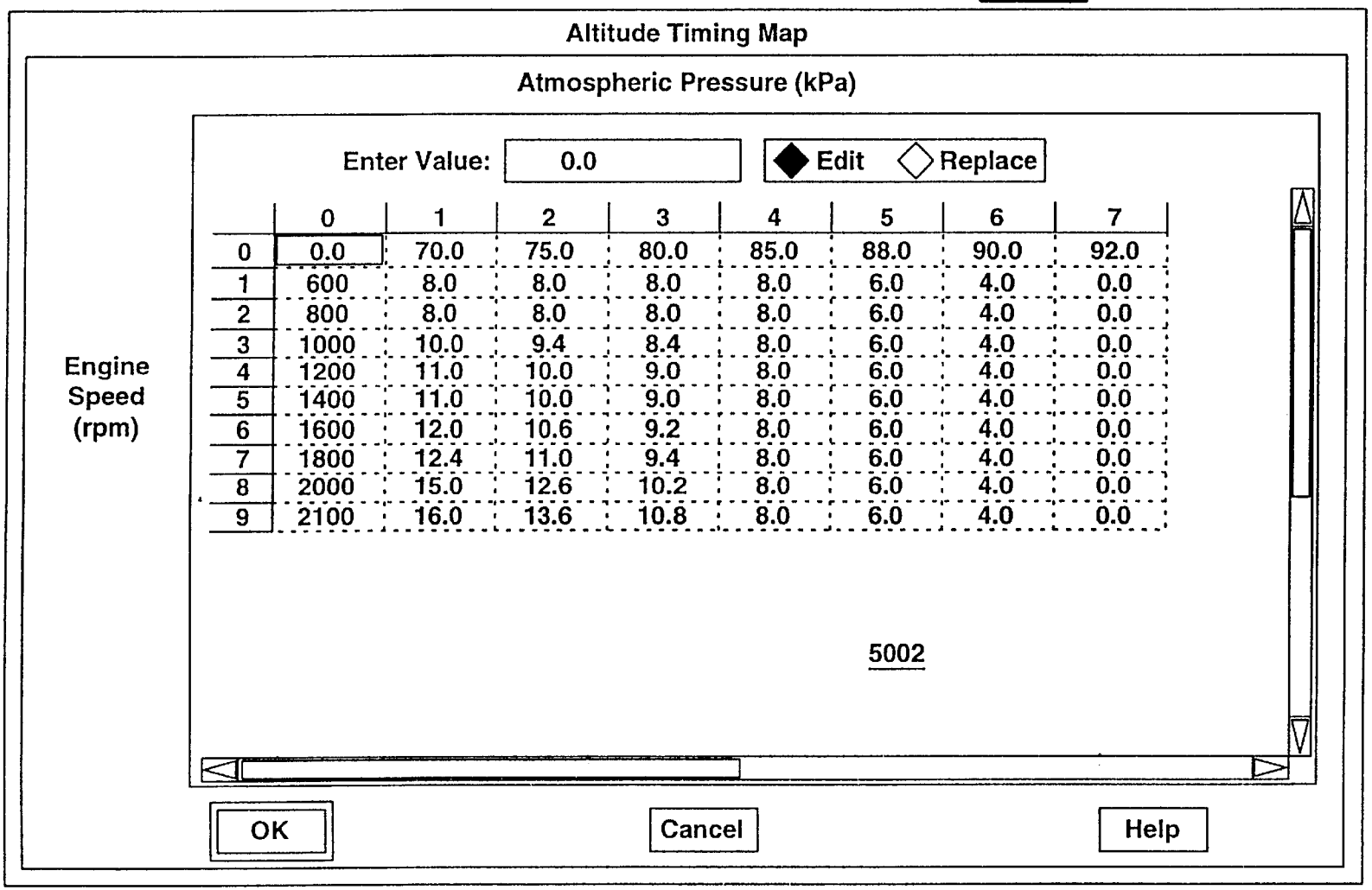
FIG. 50 is a diagrammatic view of an Altitude Timing Map Window.

With particular reference to FIGS. 49–50, the Altitude Timing Features include altitude timing parameters and an altitude timing map. An Altitude Parameters Window 4902 allows entry of parameters. In the preferred embodiment, the Altitude Timing Parameters Window 4902 includes first and second slider bars 4904,4906 for sizing the altitude timing map. An Altitude Timing Map Window 5002 allows entry of the altitude timing map.

Figure 51:
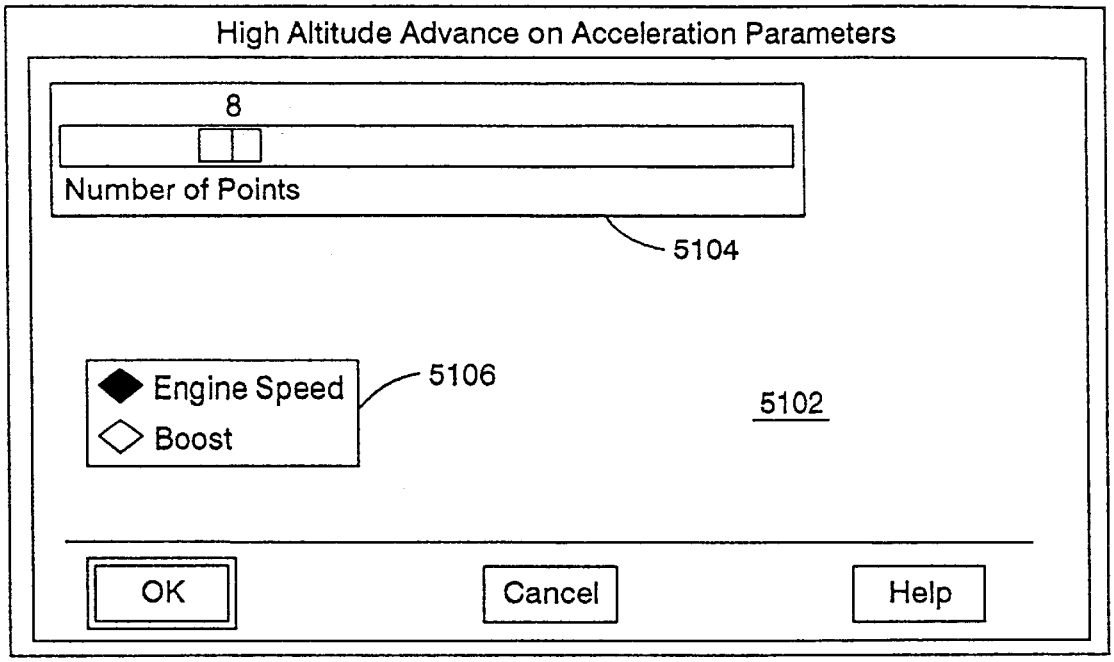
FIG. 51 is a diagrammatic view of a High Altitude Advance on Acceleration Parameters Window.
Figure 52:
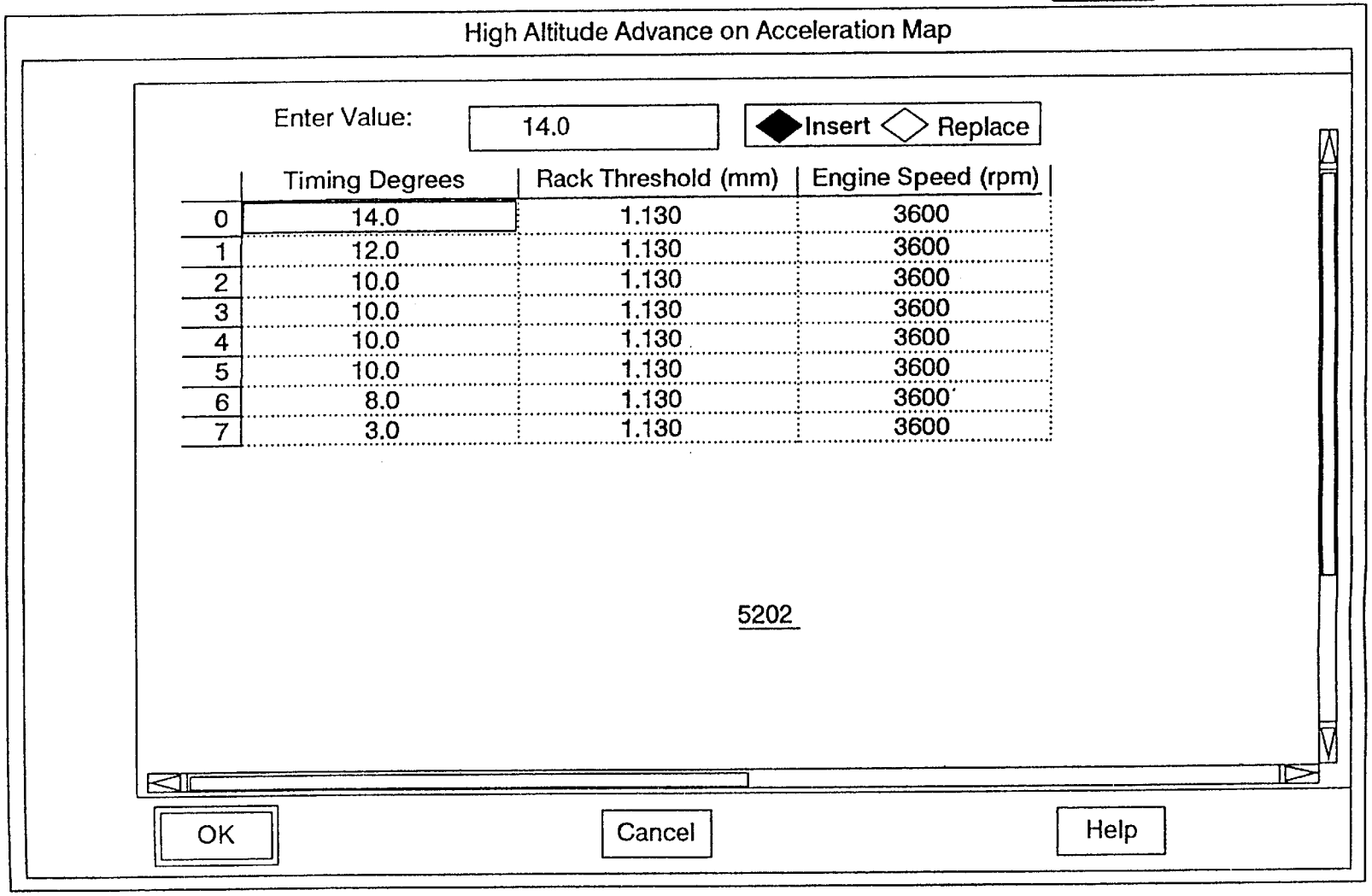
FIG. 52 is a diagrammatic view of a High Altitude Advance on Acceleration Map Window.

With particular reference to FIGS. 51–52, the High Altitude Advance on Acceleration (AOA) Features include high altitude AOA parameters and a high altitude AOA map. A High Altitude AOA Parameters Window 5102 allows entry of parameters. In the preferred embodiment, the High Altitude AOA Parameters Window 5102 includes a slider bar 5104 and a radio box 5106 for sizing the high altitude AOA and for determining whether the map will contain engine speed or boost values, respectively. A High Altitude Advance on Acceleration Map Window 5202 allows entry of the High Altitude AOA Window 5202.

c. Speed Features

Figure 53:
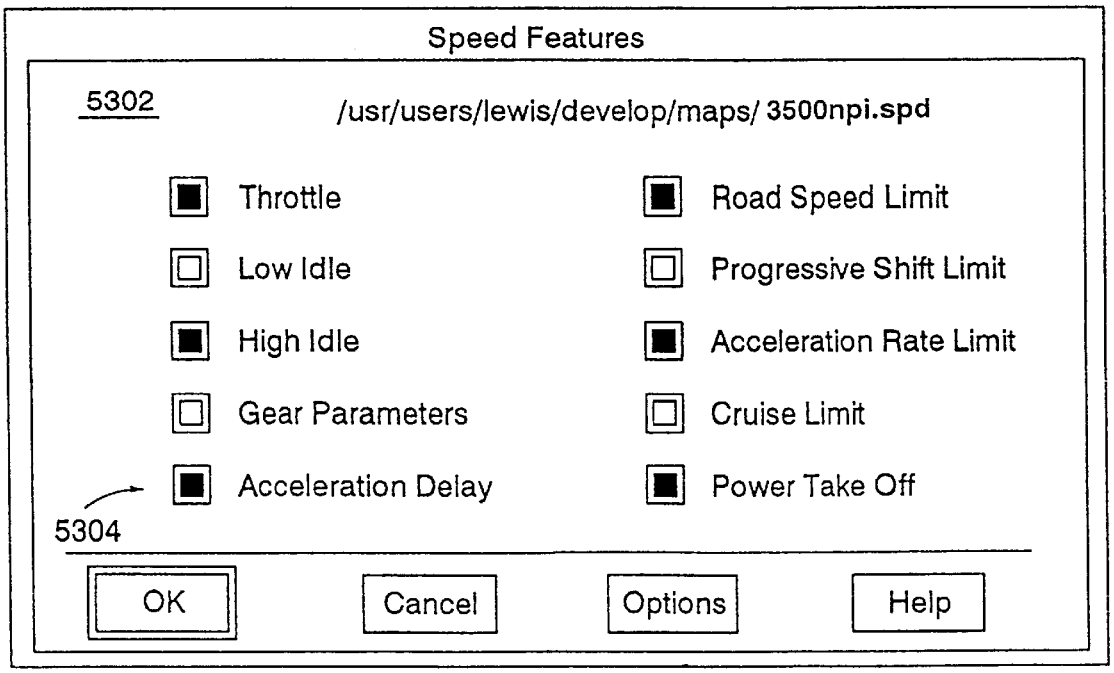
FIG. 53 is a diagrammatic view of a Speed Features Window.

As stated above, the speed features are features that are used to control the desired engine speed. With particular reference to FIG. 53, a Speed Features Window 5302 includes a plurality of toggle buttons 5304 for enabling and disabling various speed functions. The available speed functions are throttle, low idle, high idle, gear parameters, acceleration delay, road speed limit, progressive shift limit, acceleration rate limit, cruise limit, and power take off.

d. Engine Core Features

Figure 54:
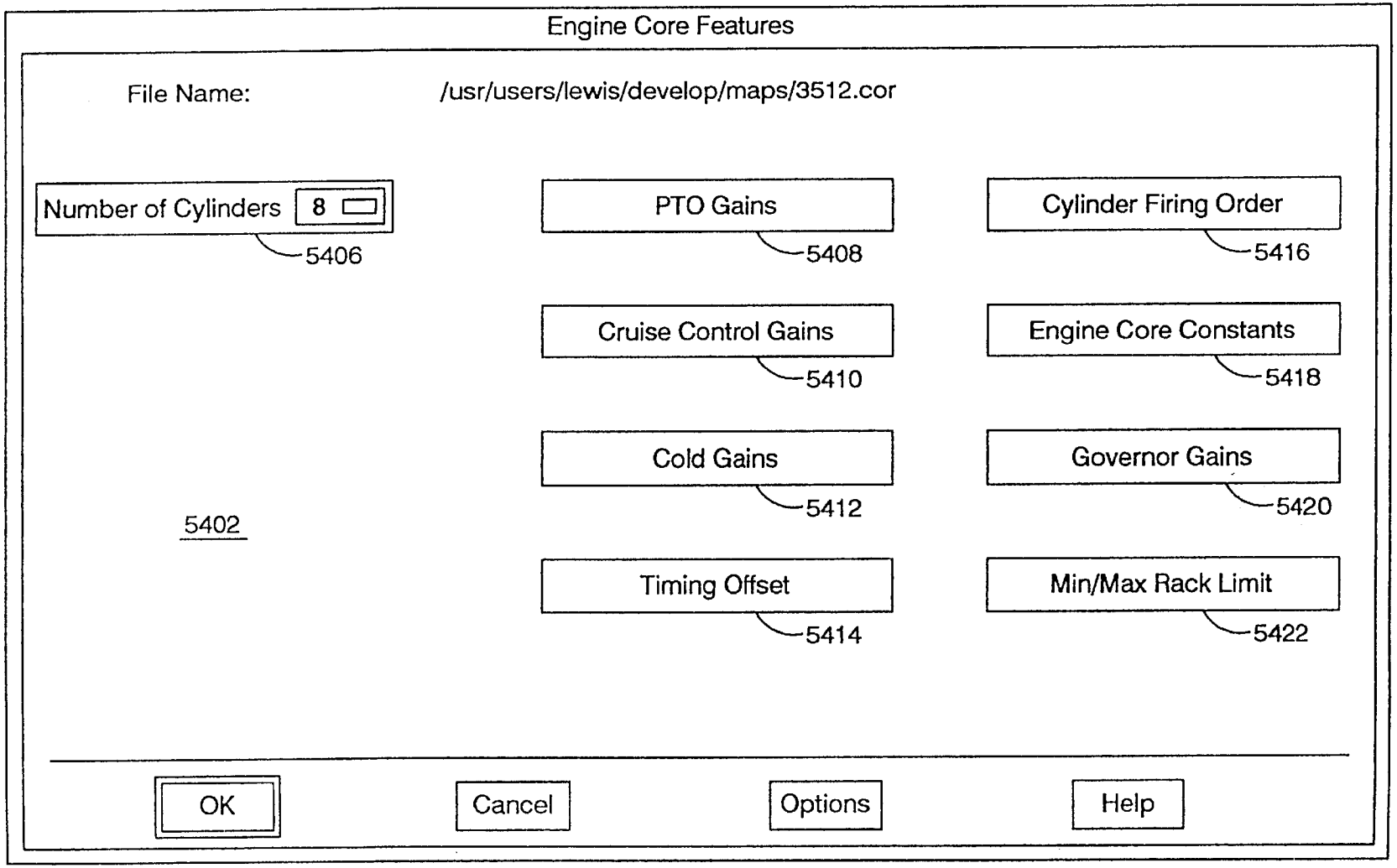
FIG. 54 is a diagrammatic view of an Engine Core Features Window.

As stated above, the engine core features control the engine's governor. With reference to FIG. 54, an Engine Core Features Window 5402 includes a series of pushbuttons.

Actuation of a Number of Cylinders button 5406 displays an option list containing a list of valid cylinders.

Actuation of PTO Gains, Cruise Control Gains, and Cold Gains buttons, 5408,5410,5412 displays corresponding windows which allow entry of various PTO, cruise control, and cold gains. The PTO Gains, Cruise Control Gains and Cold Gains buttons 5408,5410,5412 are optional.

Actuation of a Timing Offset button 5414 displays a series of windows for modifying the size and content of an engine core timing offset map.

Actuation of a Cylinder Firing Order button 5416 displays a window for modifying the order in which cylinders fire.

Actuation of an Engine Core Constants button 5418 displays a window for entering values for engine core constants. In the preferred embodiment, the engine core constants include maximum engine speed (RPM), angle between banks (engine degrees), minimum injection duration (microseconds), minimum time to inject (microseconds), low idle engine speed (RPM), high idle engine speed (RPM), and a rack to duration constant (second - RPM / mm). Additionally, a radio box allows the user to designate whether the engine is running in reverse.

Also, the engine core features includes duration features. The duration features includes duration parameters and a duration map.

e. Engine Modes

As stated above, the engine mode features define specific engine operating modes. Engine mode features may be defined for different applications. The engine mode features include various parameters and, for certain engine applications, a timing map. In the preferred embodiment, the engine mode features are subdivided into Cold Mode Features and Cranking Features. The features are entered or modified in data or map entry windows (not shown).

The cold mode features vary depending upon engine application. For example, for one application the cold mode features include maximum time (minutes), reactivation time (s), coolant temperature switch point (° C.), elev. low idle engine speed (RPM), vehicle speed switch point (mph), cold mode low temperature point (° C.), cold mode high temperature, rack at low temperature point (mm), and rack at high temperature point (mm). And in another application, the cold mode features include maximum timing for low speeds (deg BTDC), midpoint timing for low speeds (deg BTDC), maximum timing for low speeds (deg BTDC), maximum timing for high speeds (deg BTDC), midpoint timing for high speeds (deg BTDC), minimum timing for high speeds (deg BTDC), minimum coolant temperature (° C.), midpoint coolant temperature (° C.), maximum coolant temperature (° C.), cold mode low engine speed (RPM), and cold mode high engine speed (RPM).

The listed cold mode constants are used to define cold mode operation. In some applications, a cold mode map is required. The cold mode map maps engine timing to temperature.

Generally, crank features are used to reduce smoke and rough starting by imposing an additional fuel limit when the engine is started.

f. Service Features

As stated above, the service features configure the interface to the ECAP service tool. With reference to FIGS. 55–71, the service features are subdivided into interlock features, event features, and fuel rate features.

Figure 55:
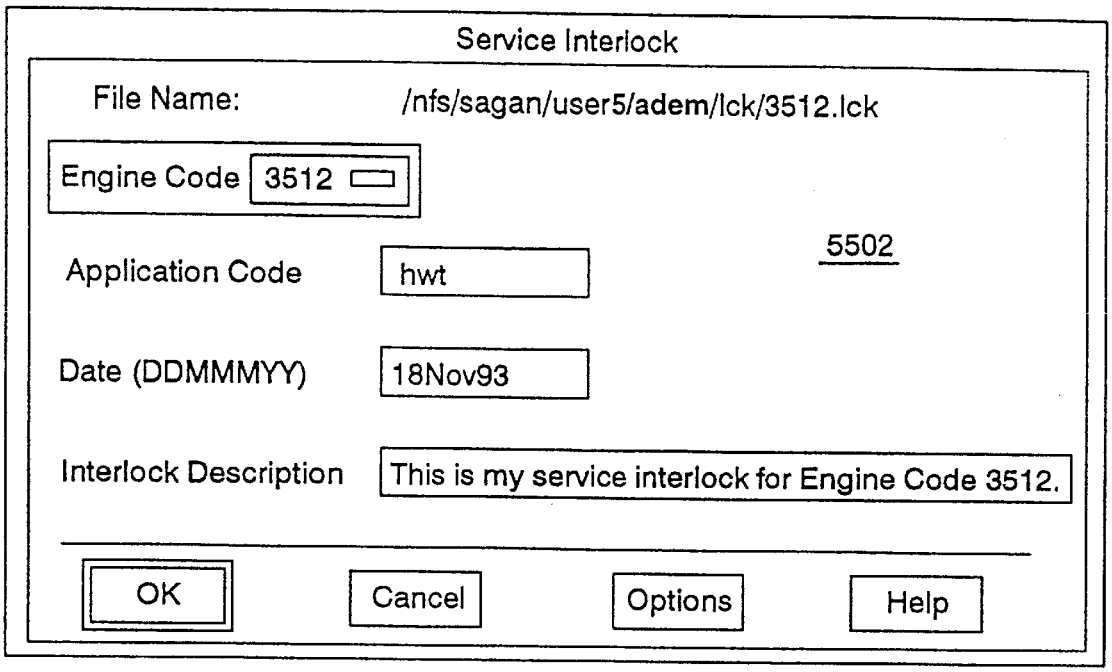
FIG. 55 is a diagrammatic view of a Service Interlock Window.

With particular reference to FIG. 55, a Service Interlock Window 5502 allows entry of an Application Code, the date, and an interlock description. Generally, interlock features are used to prevent unauthorized use of a personality module or the accidental use of the wrong personality module.

Figure 56:
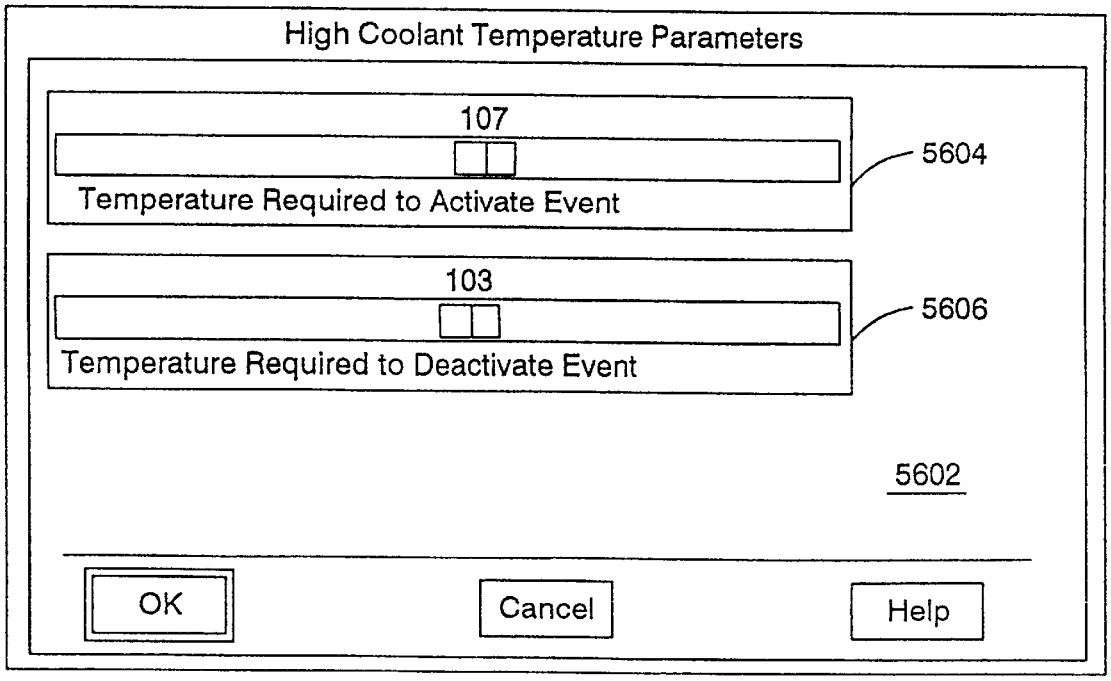
FIG. 56 is a diagrammatic view of a High Coolant Temperature Parameters Window.
Figure 57:
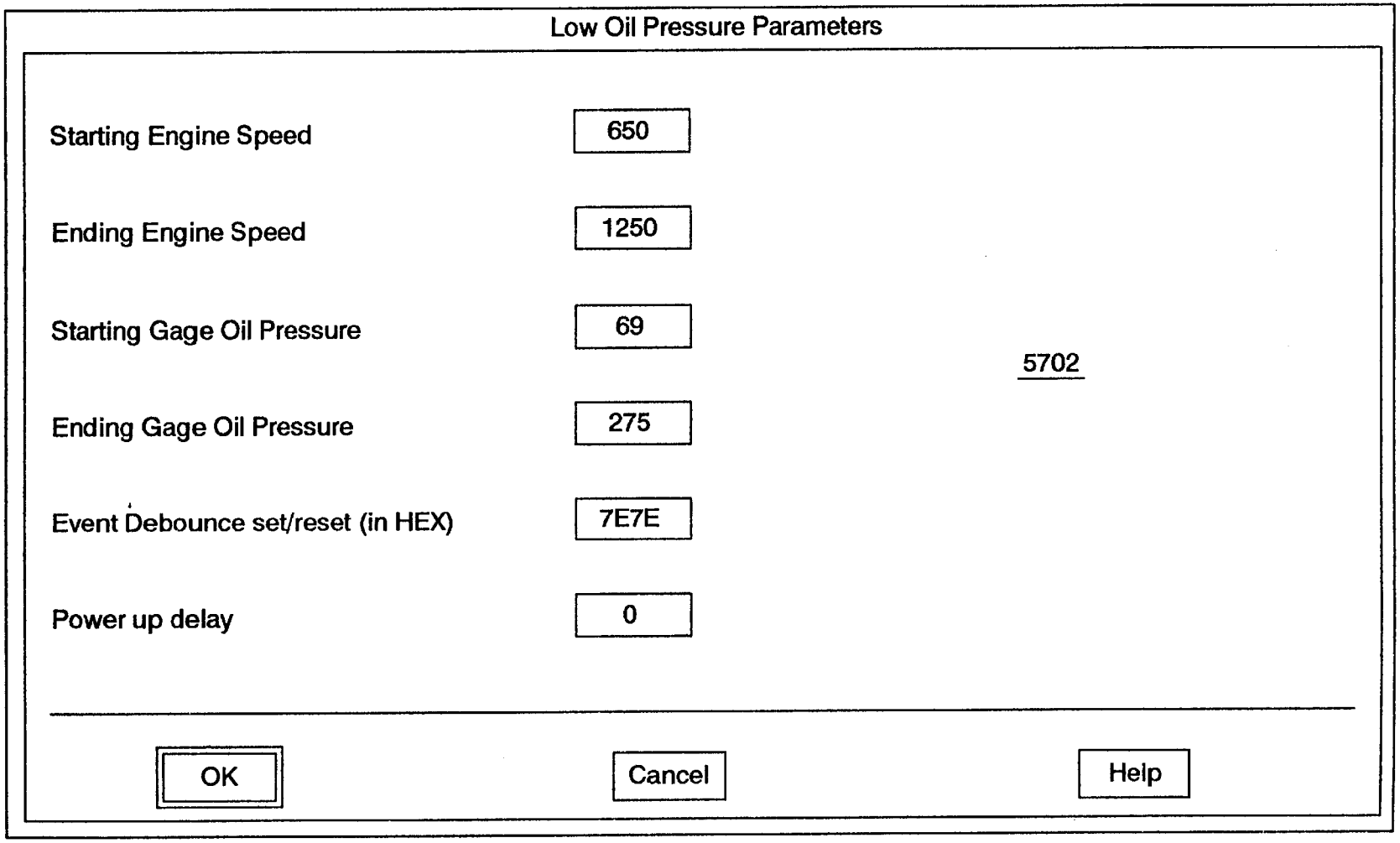
FIG. 57 is a diagrammatic view of a Low Oil Pressure Parameters Window.

With particular reference to FIGS. 56–57, the engine event features allow certain events to be defined, e.g., high coolant temperature, low oil pressure, engine speed and supply voltages. A High Coolant Temperature Parameters Window 5602 includes first and second slider bars 5604, 5606 for setting a temperature required to activate event and a temperature required to deactivate event, respectively. A Low Oil Pressure Parameters Window 5702 allows entry of low oil pressure parameters. In the preferred embodiment, the low oil pressure parameters include starting engine speed, ending engine speed, starting gage oil pressure, ending gage oil pressure, event debounce set/reset and power up delay.

With particular reference to FIGS. 58–59, the Fuel Rate Features include fuel rate parameters and a fuel rate map. A Fuel Rate Parameters Window 5802 allows the size of the fuel rate map to be changed. A Fuel Rate Map Window 5902 allows entry/modification of the fuel rate map.

g. Peripheral Features

As stated above, the peripheral features define features which are controlled by the engine controller which are not related to the engine. For example, a target engine controller may also control an engine fan. One or more windows allow entry of parameters and/or maps which are used to control the fan. For example, the engine fan features may include an engine fan speed temperature switch point or a map of fan current.

h. Hardware Features

As stated above, the hardware features are used to configure the hardware inputs and outputs of the target controller. The target controller is a generic controller which may be adapted with various hardware options. The list of items for which hardware interface data may be defined includes analog sensors, pulse width modulated inputs and outputs and switch inputs.

2. Inputting the Specifications for a Natural Gas User

If the 3600 Gas User option of the Options >> User Profile is selected, the Application Builder 102 will enable the user to input data required to produce the control software for a 3600 natural gas engine controller. The target natural gas engine controller specifications are input via the Program menu on the Pull Down Menu Bar 204 on the Main Screen of Application Builder 102. For the natural gas engine, the specifications are separated into five (5) categories: Air Features, Fuel Features, Timing Features, Engine Core Features, and Protection Features. Entry of the features is accomplished through corresponding options under the Build Menu of the Main Screen 202.

The air features include maps which control the air flow into the engine. The fuel features control fuel flow into the engine. The timing features control the engine's timing. The engine core features define application specific items, e.g., actuator types. The protection features define the protection features which are to be included for the target controller.

a. Air Features

In the preferred embodiment, the Air Features includes a number of parameters and maps which control air flow into the engine 106.

Figure 60:
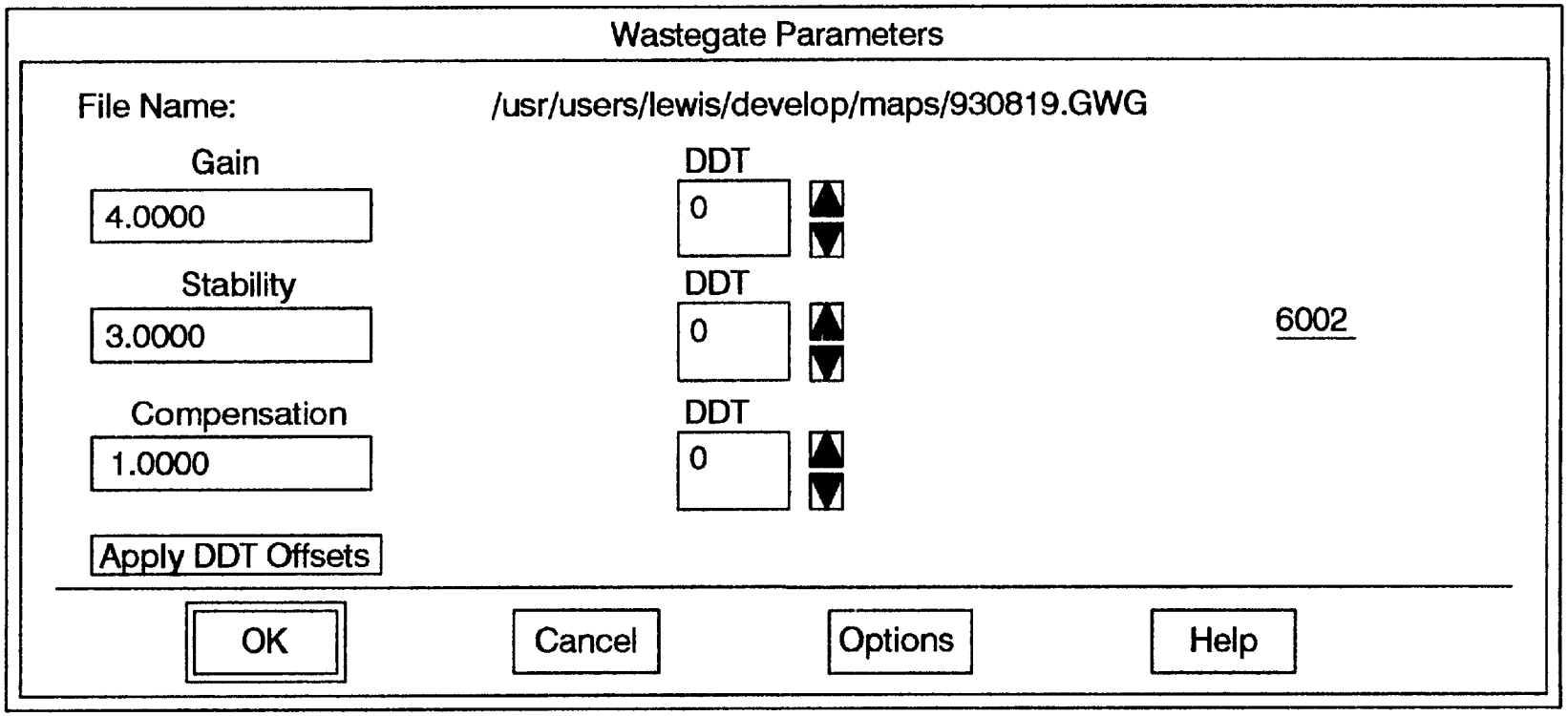
FIG. 60 is a diagrammatic view of a Wastegate Parameters Window.

With reference to FIG. 60, a Wastegate Parameters Window 6002 allows entry/modification of three parameters for the Wastegate actuator 1830. In the preferred embodiment, the three parameters are gain, stability and compensation. The Wastegate Parameters Window 6002 also allows the entry of offsets for each of the parameters.

Figure 61:
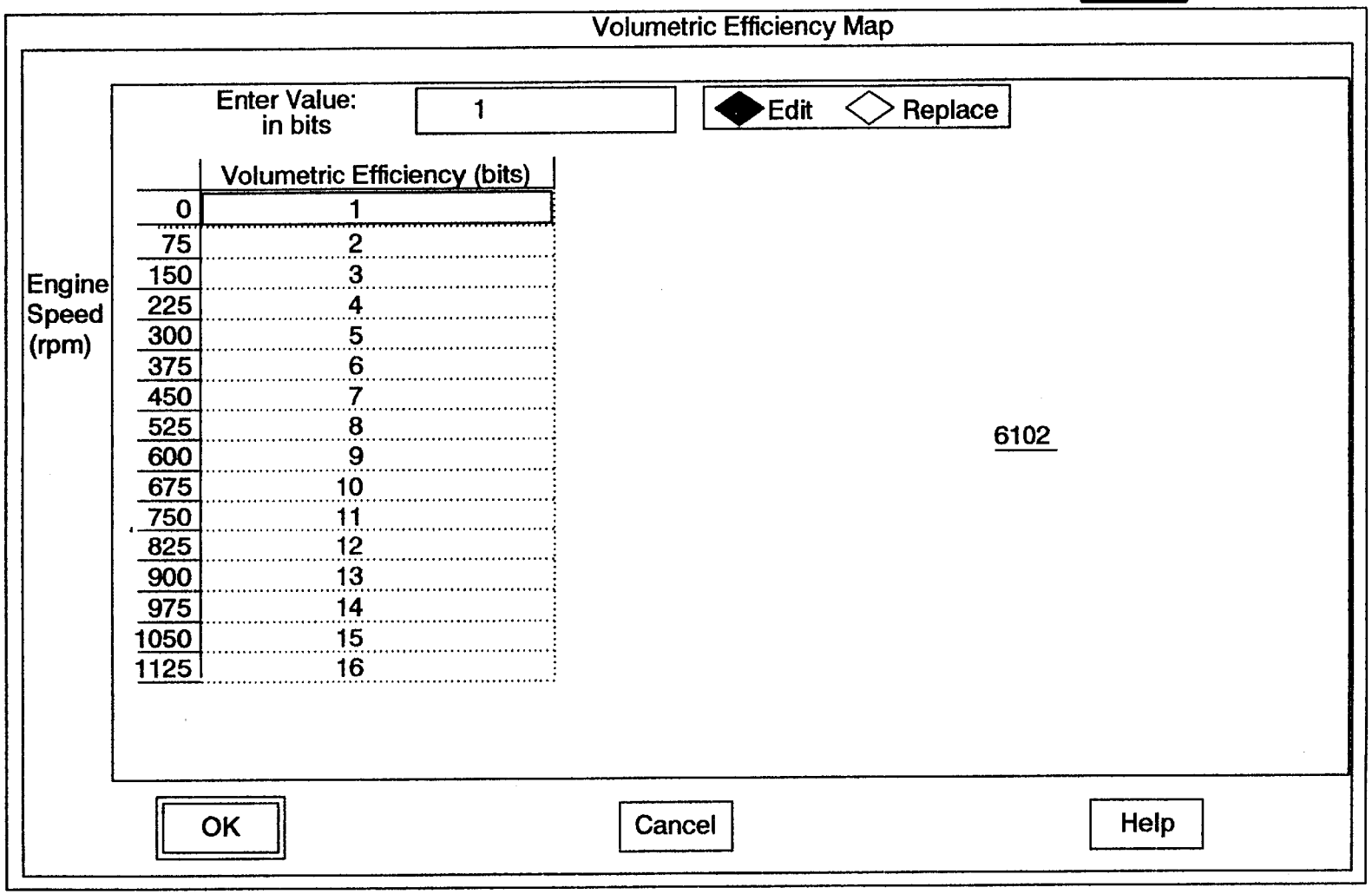
FIG. 61 is a diagrammatic view of a Volumetric Efficiency Map Window.

With reference to FIG. 61, a Volumetric Efficiency Map Window 6102 allows entry/modification of a Volumetric Efficiency Map. The Volumetric Efficiency Map defines how much air is burned in the cylinders of the target engine 106.

Figure 62:
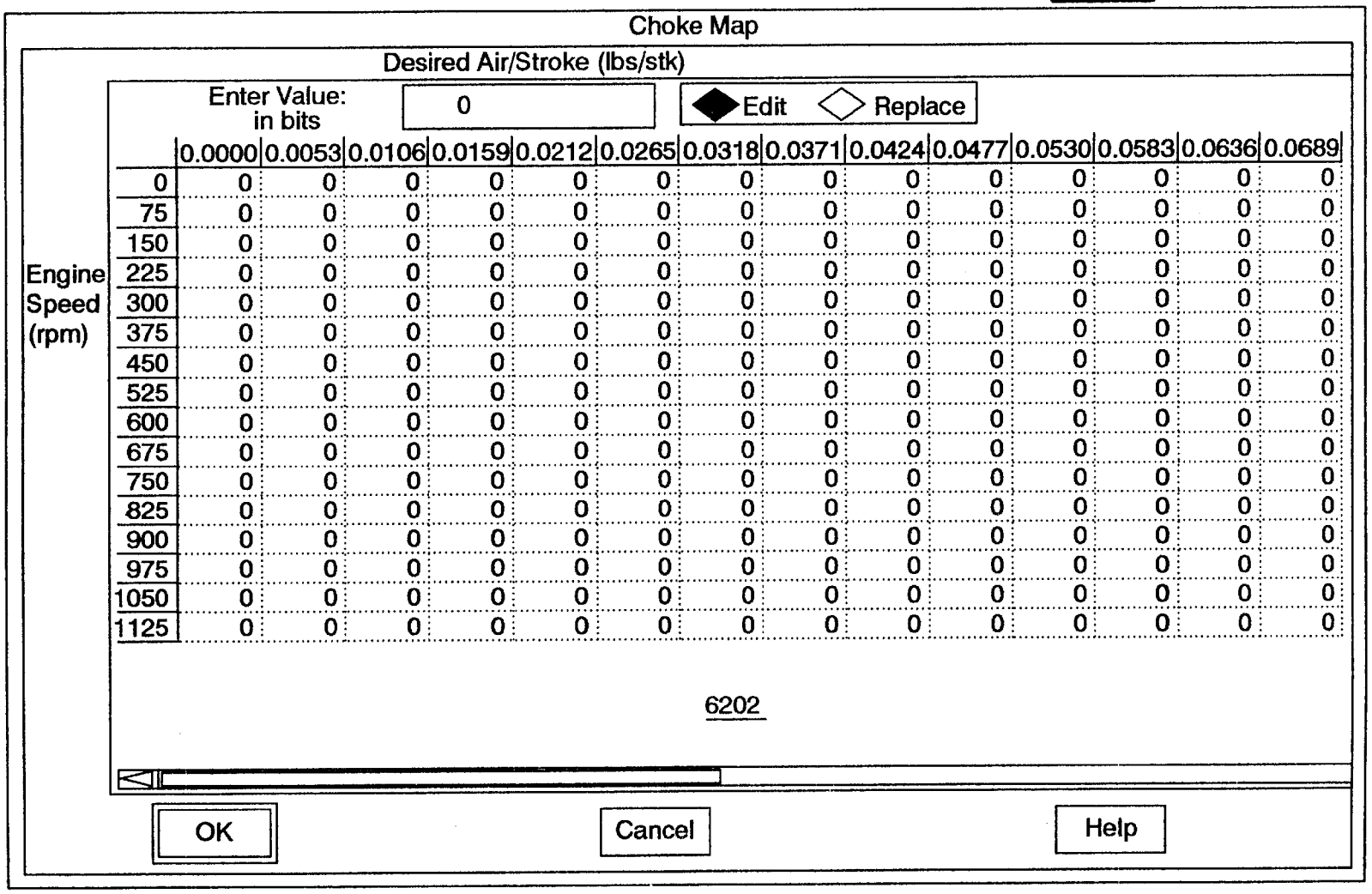
FIG. 62 is a diagrammatic view of a Choke Map Window.

With reference to FIG. 62, a Choke Map Window 6202 allows entry/modification of a Choke Map. The Choke Map is used to position the engine's choke plate.

With reference to FIG. 63, a Combustion Probe Map Window 6302 allows entry/modification of a Combustion Probe Map. The Combustion Probe Map instructs the engine controller 104 how to control the air to fuel ratio based on signals from a combustion probe (not shown) within a cylinder. The combustion probe measures the burn time within the cylinder.

With reference to FIG. 64, an Air/Fuel Map Window 6402 allows entry/modification of an Air/Fuel Map. The Air/Fuel Map controls the base air to fuel ratio for the engine 106.

b. Fuel Features

In the preferred embodiment, the Fuel Features include a number of parameters and maps which control fuel flow into the engine 106.

Figure 65:
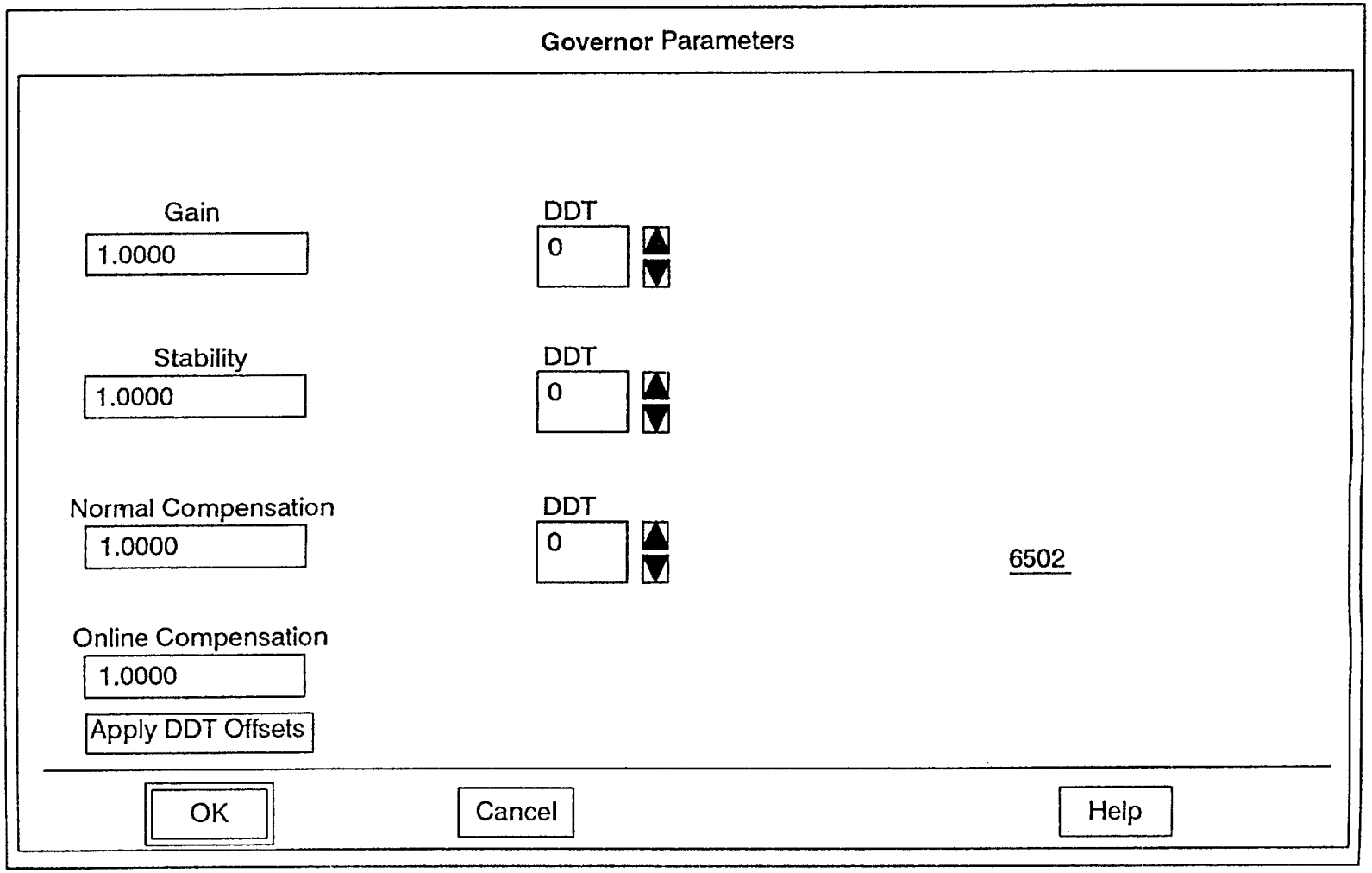
FIG. 65 is a diagrammatic view of a Governor Parameters Window.

With reference to FIG. 65, a Governor Parameters Window 6502 allows entry/modification of a number of governor parameters. As shown, in the preferred embodiment, the parameters include Gain, Stability, and Online Compensation. The Governor Parameters Window 6502 also allows the entry of offsets for each of the parameters.

The Fuel Features also include a number of parameters which are used to configure the engine's fuel parameters for varying ranges of fuel quality. In the preferred embodiment, the parameters include feedback points, BTU setting, and fuel factors.

Figure 66:
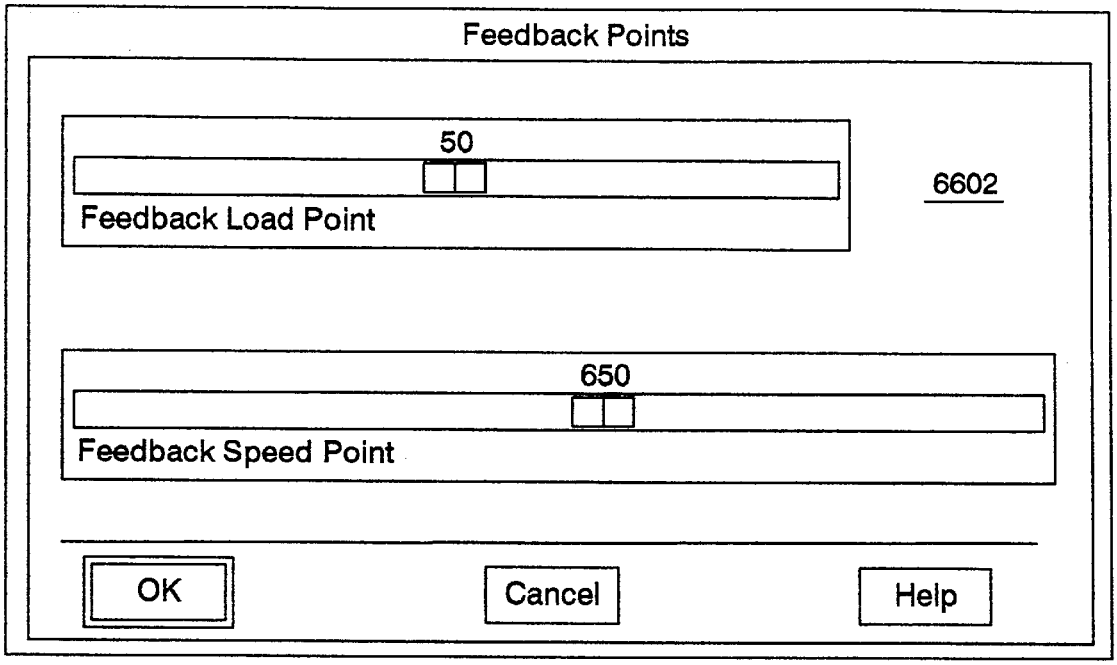
FIG. 66 is a diagrammatic view of a Feedback Points Window.

With reference to FIG. 66, a Feedback Points Window 6602 allows entry/modification of a Feedback Loadpoint and a Feedback Speed Point. Preferably, entry of the two points is accomplished via sliders.

Figure 67:
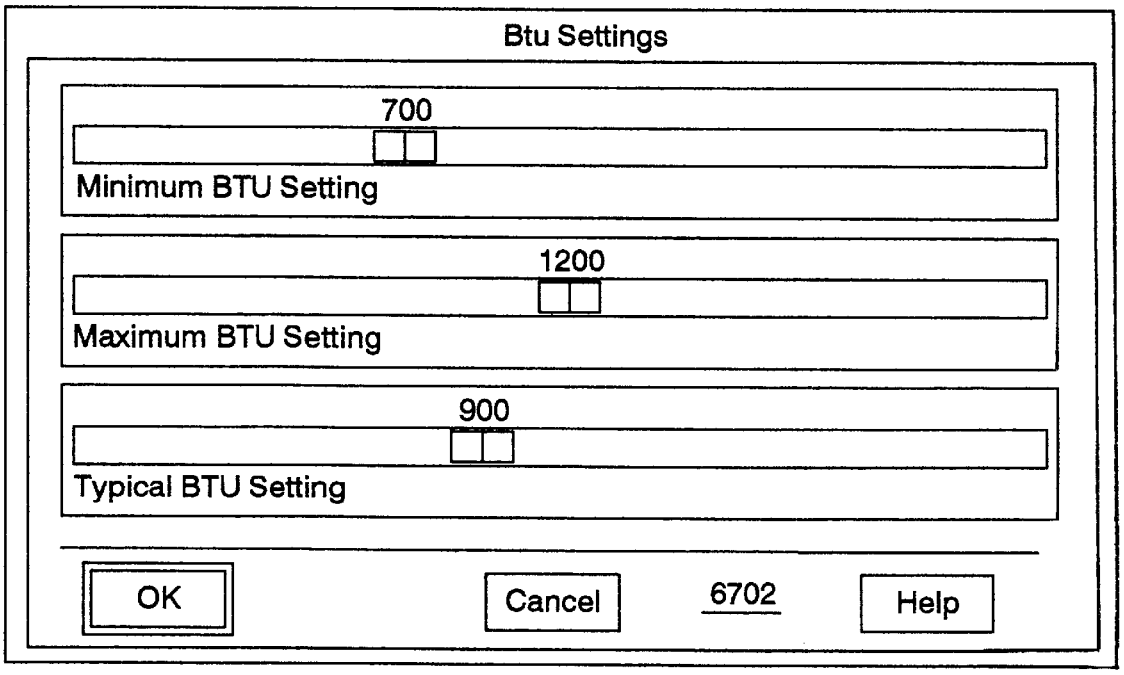
FIG. 67 is a diagrammatic view of a BTU Settings Window.

With reference to FIG. 67, a BTU Settings Window 6702 allows entry/modification of a Minimum BTU Setting, a Maximum BTU Setting, and a Typical BTU Setting. Preferably, entry of the three settings is accomplished via sliders.

Figure 68:
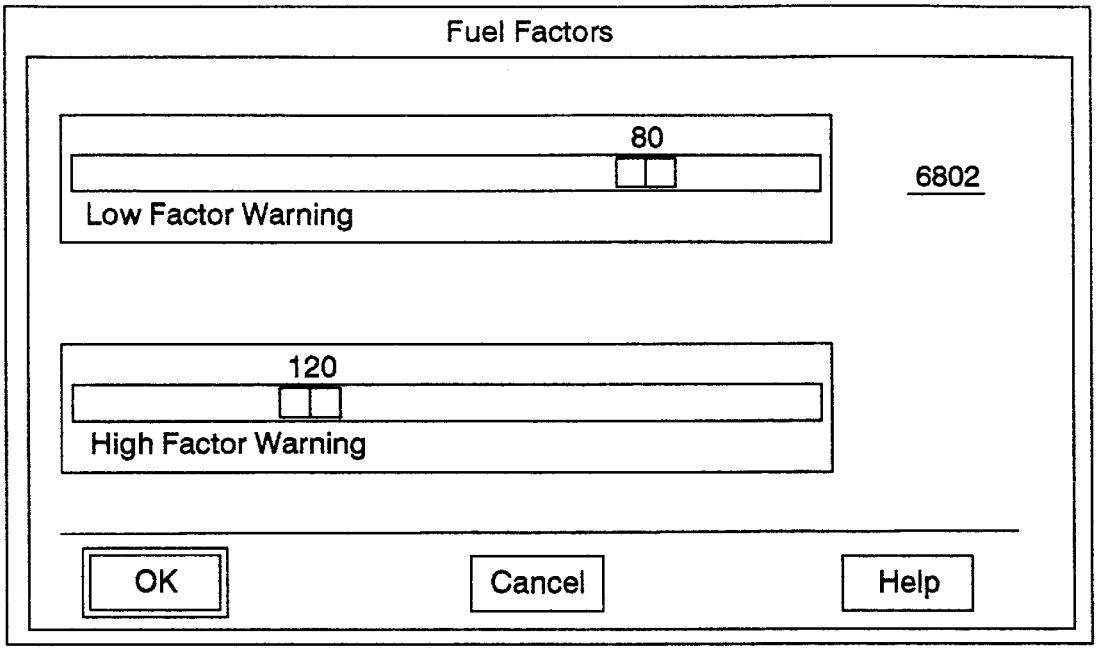
FIG. 68 is a diagrammatic view of a Fuel Factors Window.

With reference to FIG. 68, a Fuel Factors Window 6802 allows entry/modification of a Low Factor Warning and a High Factor Warning. Preferably, entry of the two warnings is accomplished via sliders.

The Fuel Features also include three maps: a Transient Air/Fuel Map, a Torque Limit Map, and an Idle Fuel Map.

With reference to FIG. 69, a Transient Air/Fuel Map Window 6902 allows entry/modification of the Transient Air/Fuel Map. The Transient Air/Fuel Map tells the engine controller how rich the engine is allowed to run. i.e., the rich limit during loading of the engine (load acceptance).

Figure 70:
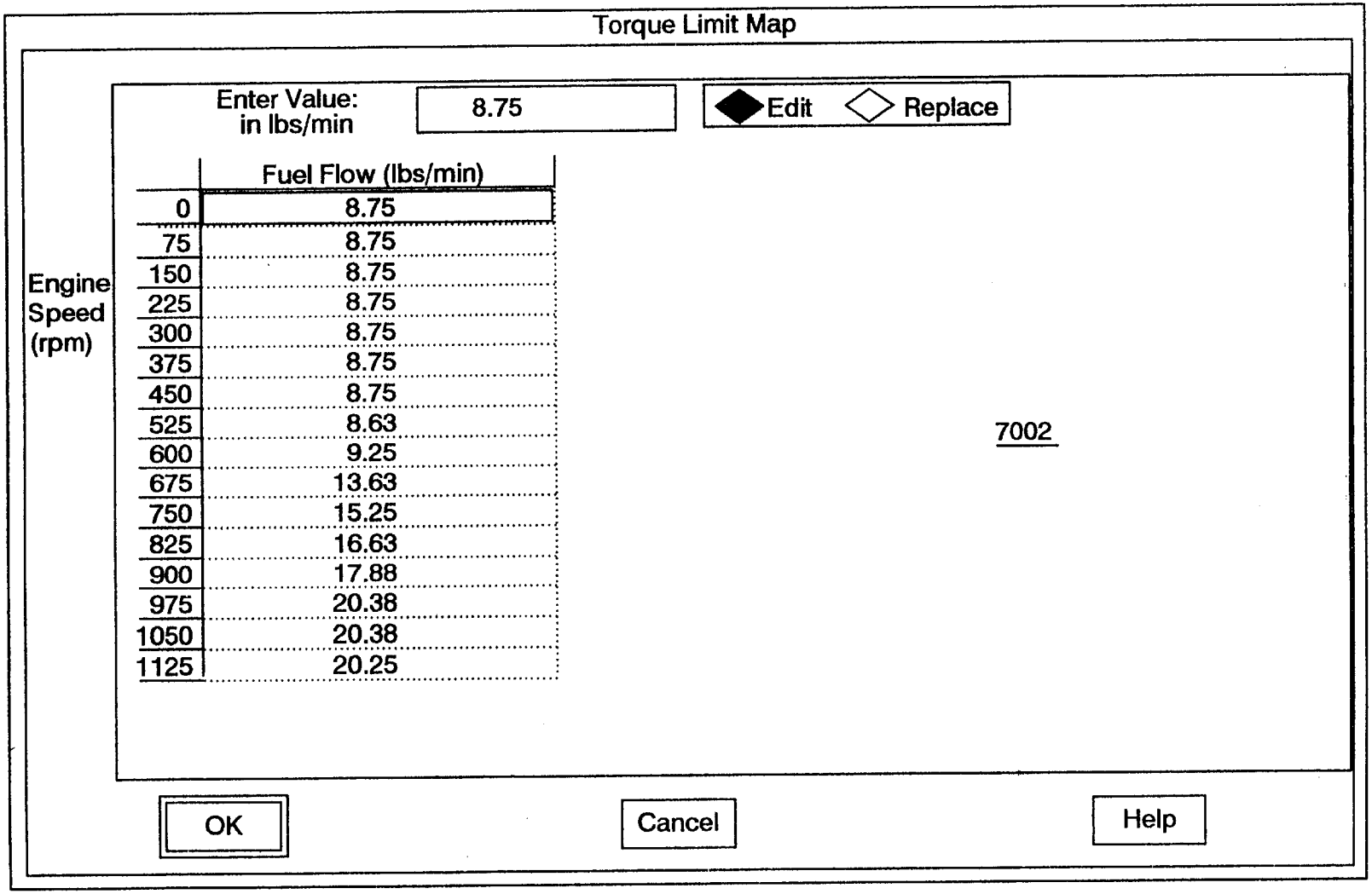
FIG. 70 is a diagrammatic view of a Torque Limit Map Window.

With reference to FIG. 70, a Torque Limit Map Window 7002 allows entry/modification of the Torque Limit Map. The Torque Limit Map defines maximum fuel for the engine power rating.

Figure 71:
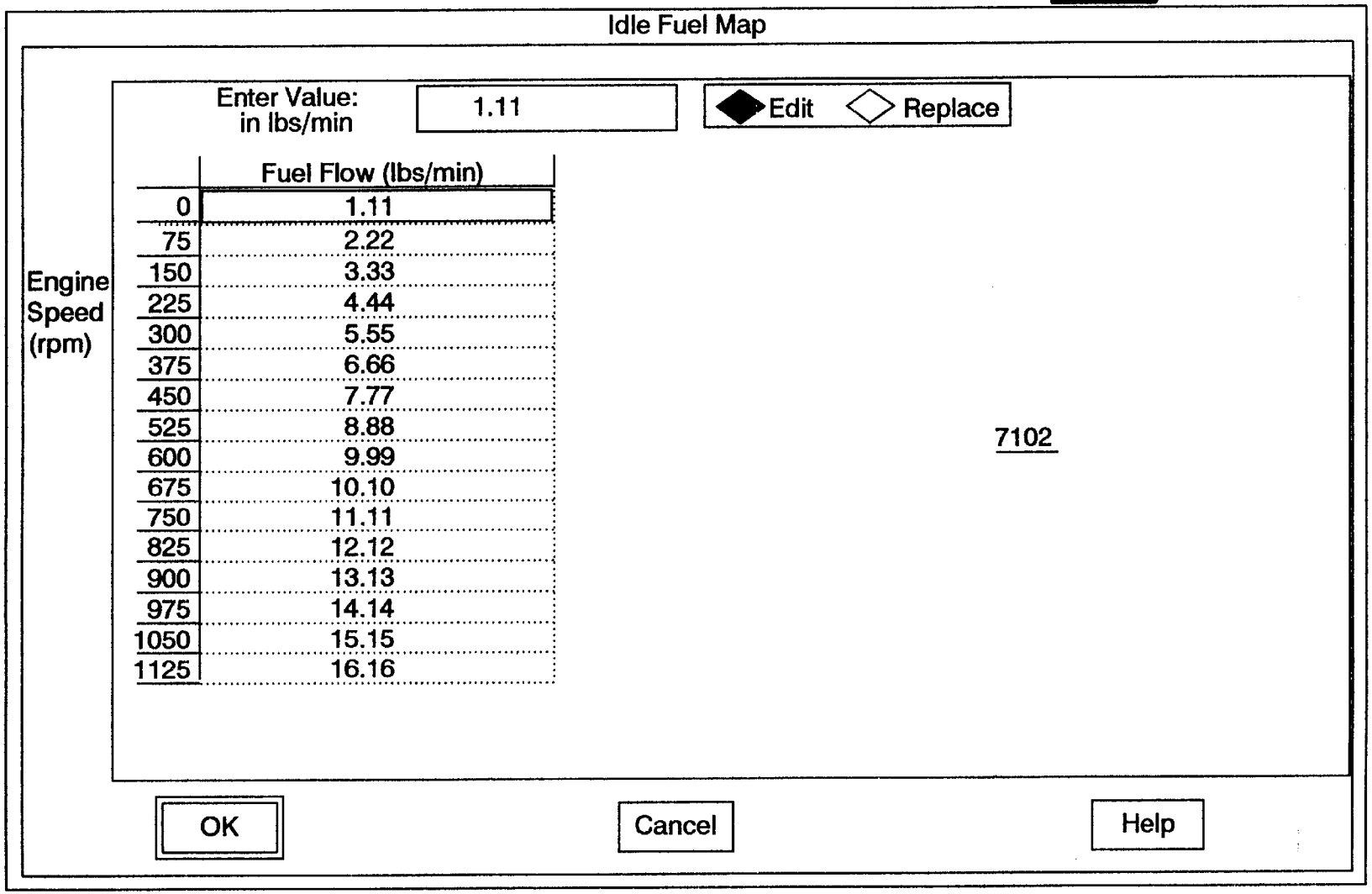
FIG. 71 is a diagrammatic view of an Idle Fuel Map Window.

With reference to FIG. 71, an Idle Fuel Map Window 7102 allows entry/modification of the Idle Fuel Map. The Idle Fuel Map defines no-load fuel flow.

c. Timing Features

In the preferred embodiment, the Timing Features include a number of parameters and maps which control the timing of the engine 106.

Figure 72:
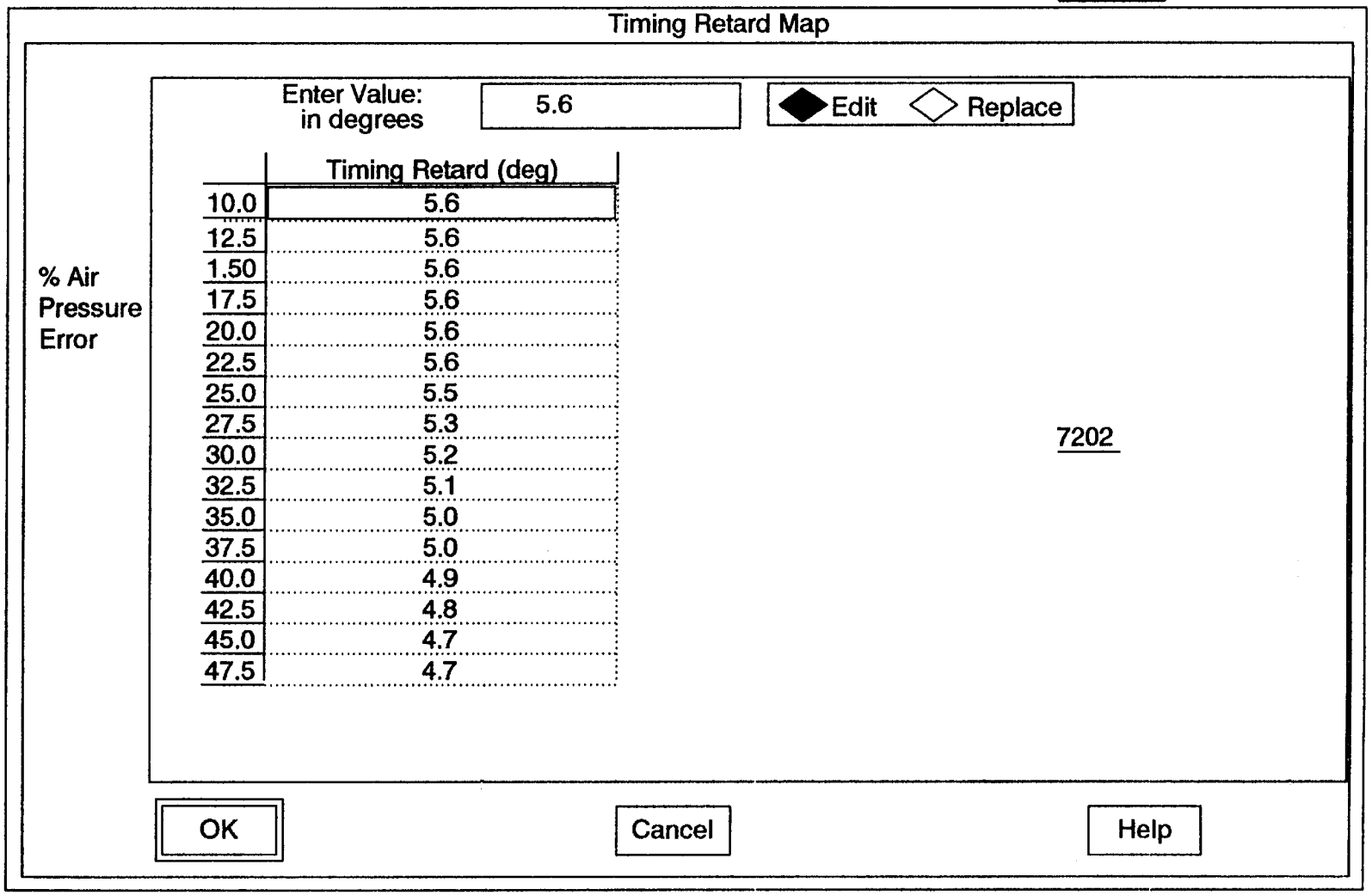
FIG. 72 is a diagrammatic view of a Timing Retard Map Window.

With reference to FIG. 72, a Timing Retard Map Window 7202 allows entry/modification of a Timing Retard Map.

Figure 73:
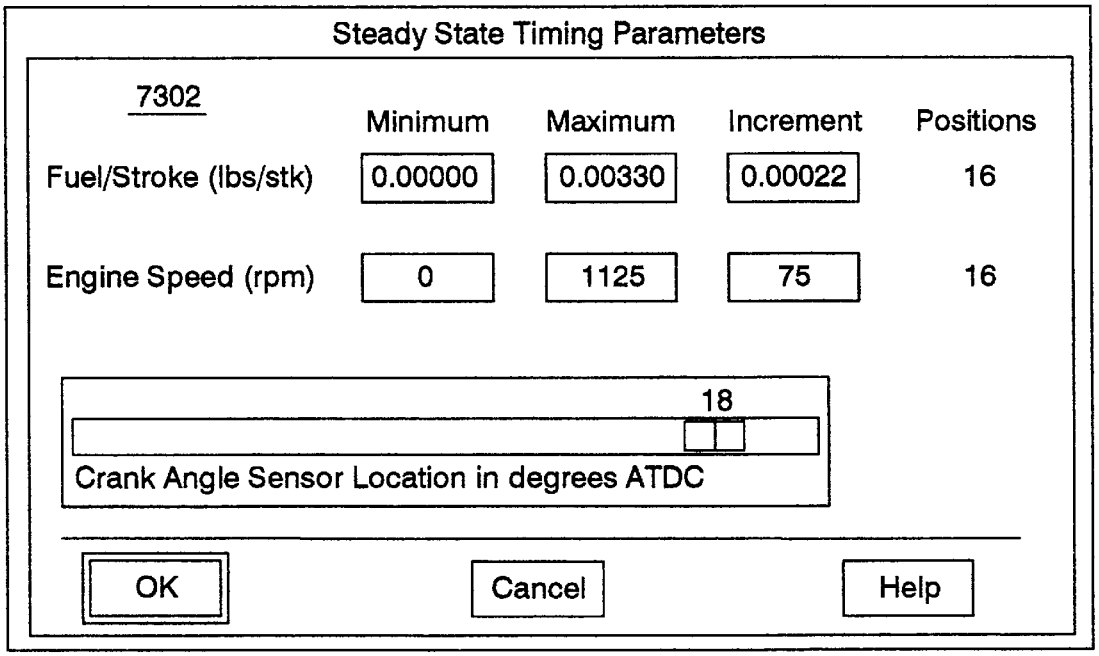
FIG. 73 is a diagrammatic view of a Steady State Timing Parameters Window.

With reference to FIG. 73, a Steady State (Base) Timing Parameters Window 7302 allows entry of the location of a crank angle sensor measured in degrees from top dead center (TDC).

Figure 74:
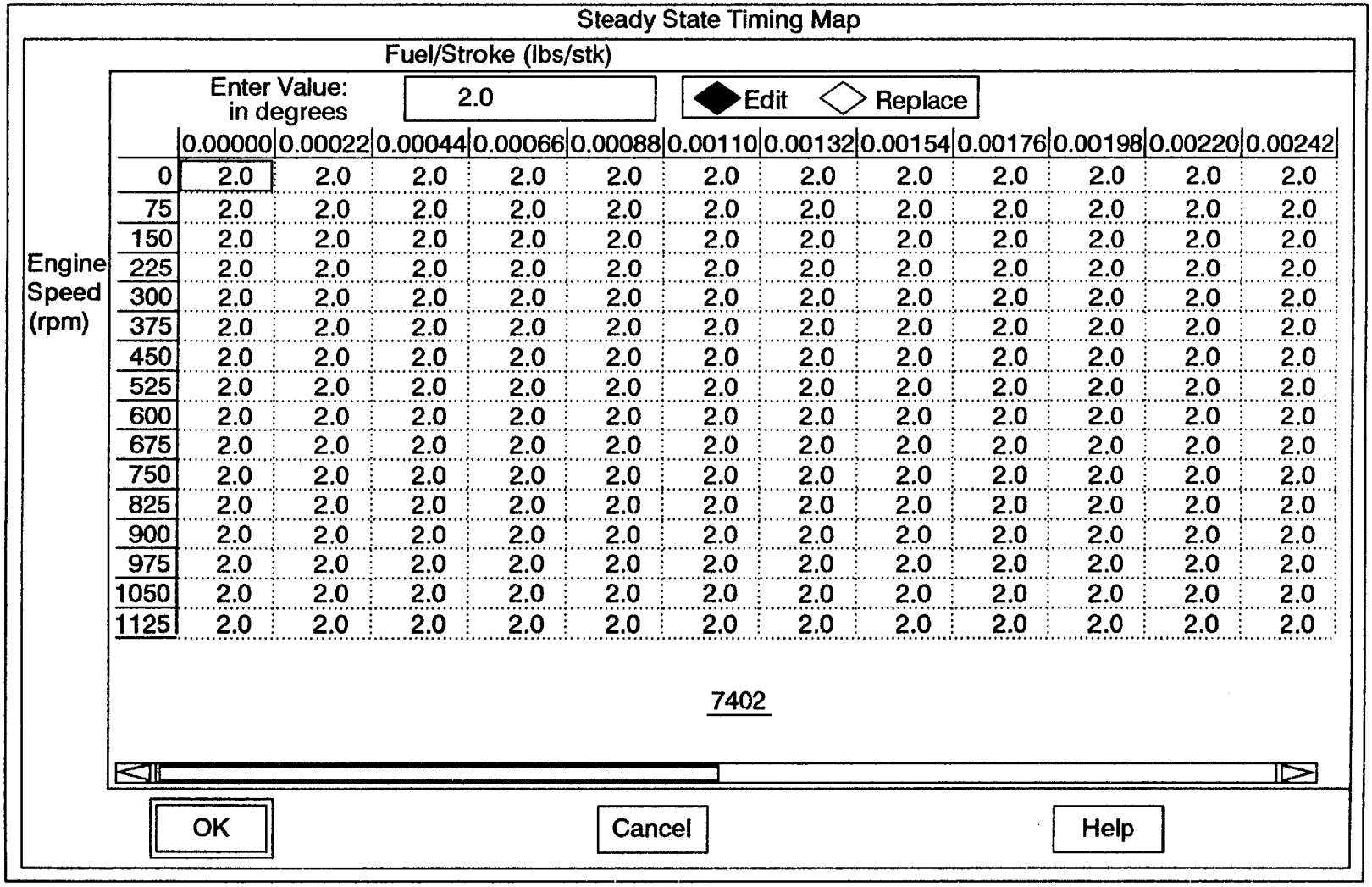
FIG. 74 is a diagrammatic view of a Steady State Timing Map Window.

With reference to FIG. 74, a Steady State Timing Map Window 7402 allows entry/modification of the Steady State Timing Map. The Steady State Timing Map defines the engine's base or steady state timing.

d. Engine Core Features

In the preferred embodiment, the Engine Core Features include a number of parameters which define application specific items.

Figure 75:
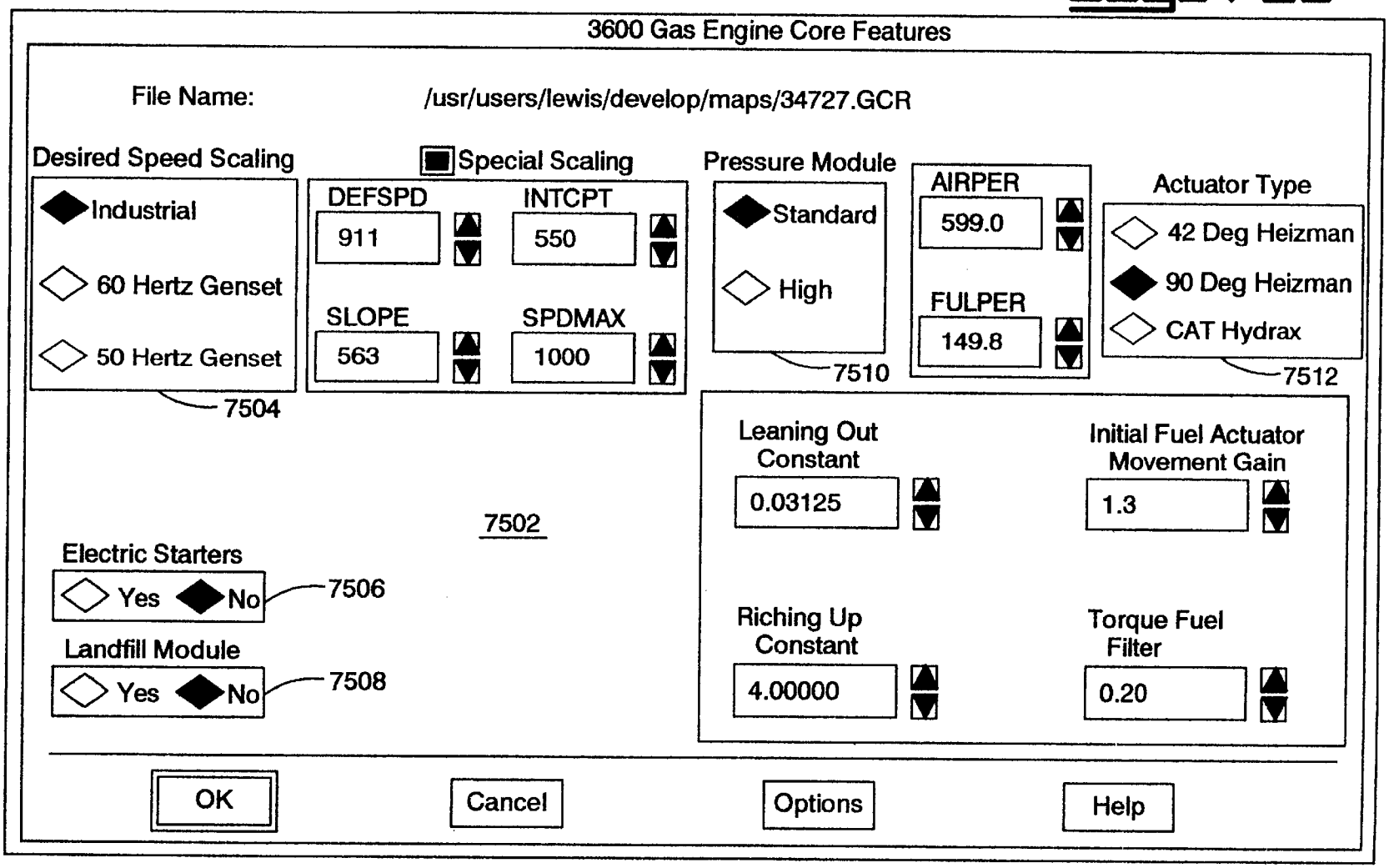
FIG. 75 is a diagrammatic view of an Engine Core Features Window.
Figure 7B:
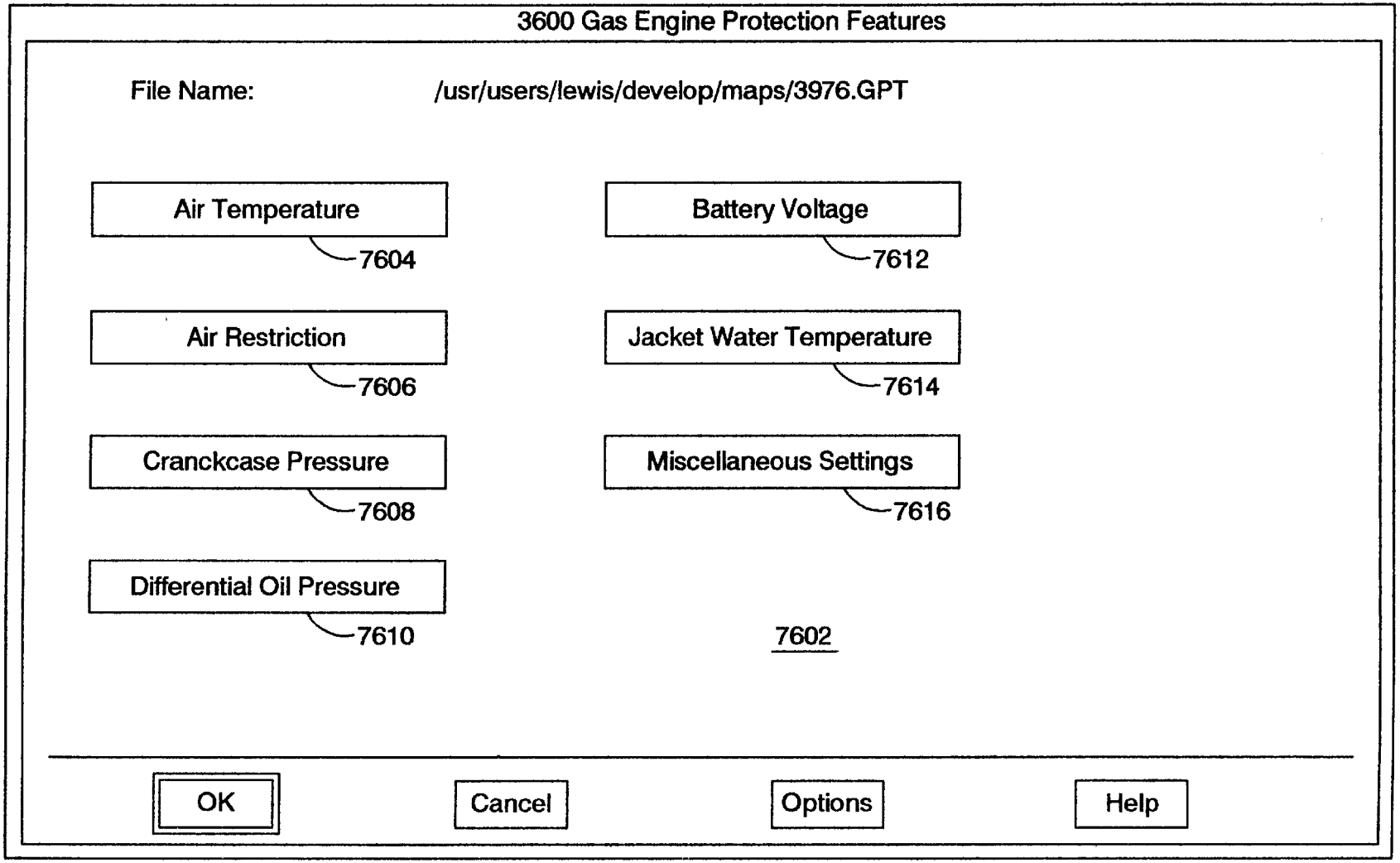
FIG. 7 is a diagrammatic view of an option menu.

With reference to FIG. 75, an Engine Core Features Window 7502 allows entry/modification of the engine core features. In the preferred embodiment, the Engine Core Features Window 7502 includes a Desired Speed Scaling Radio Box 7504 for specifying the desired speed scaling, an Electric Starters Radio Box 7506 for specifying whether the target controller includes electric starters, and a Landfill Module Radio Box 7508 for specifying whether the target controller is to include a Landfill Module. Two other Radio Boxes 7510, 7512 are used to define a pressure module (as Standard or High) and the type of actuator used for choke, wastegate and governor control. Additionally, the Engine Core Features Window 7502 allows definition of a number of constants.

e. Protection Features

In the preferred embodiment, the Protection Features include a number of parameters for which alarm and shutdown indicator values can be defined. Additionally, the Protection Features include a number of miscellaneous parameters. In the preferred embodiment, alarm and shutdown values are definable for the following parameters: air temperature, air restriction, crankcase pressure, differential air pressure, battery voltage, jacket water temperature. With reference to FIG. 76, a Protection Features Window 7602 includes a plurality of pushbuttons corresponding to each of the parameters listed above. Activation of a pushbutton results in the display of a corresponding window as described below.

Figure 77:
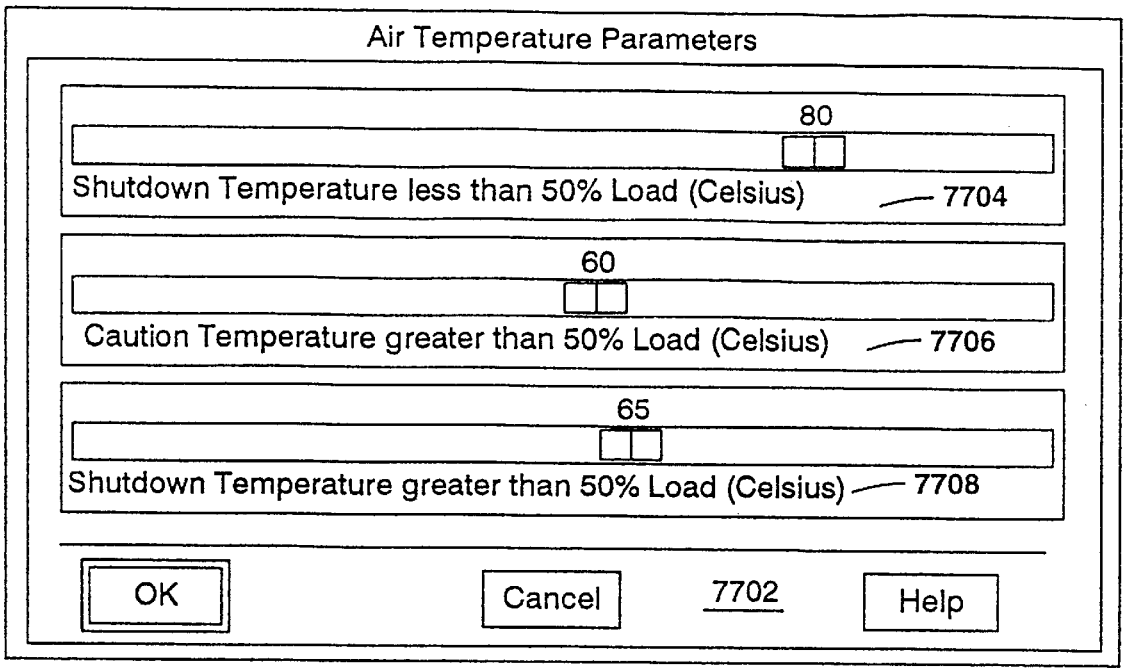
FIG. 77 is a diagrammatic view of an Air Temperature Parameters Window.

With reference to FIG. 77, an Air Temperature Parameters Window 7702 is displayed upon activation of an air temperature button 7604. The Air Temperature Parameters Window 7702 includes three sliders 7704,7706,7708 for setting a shutdown temperature when the engine 104 is at less than 50% load, a caution temperature when the engine is at greater than 50% load, and a shutdown temperature when the engine is at greater than 50% load, respectively.

Figure 78:
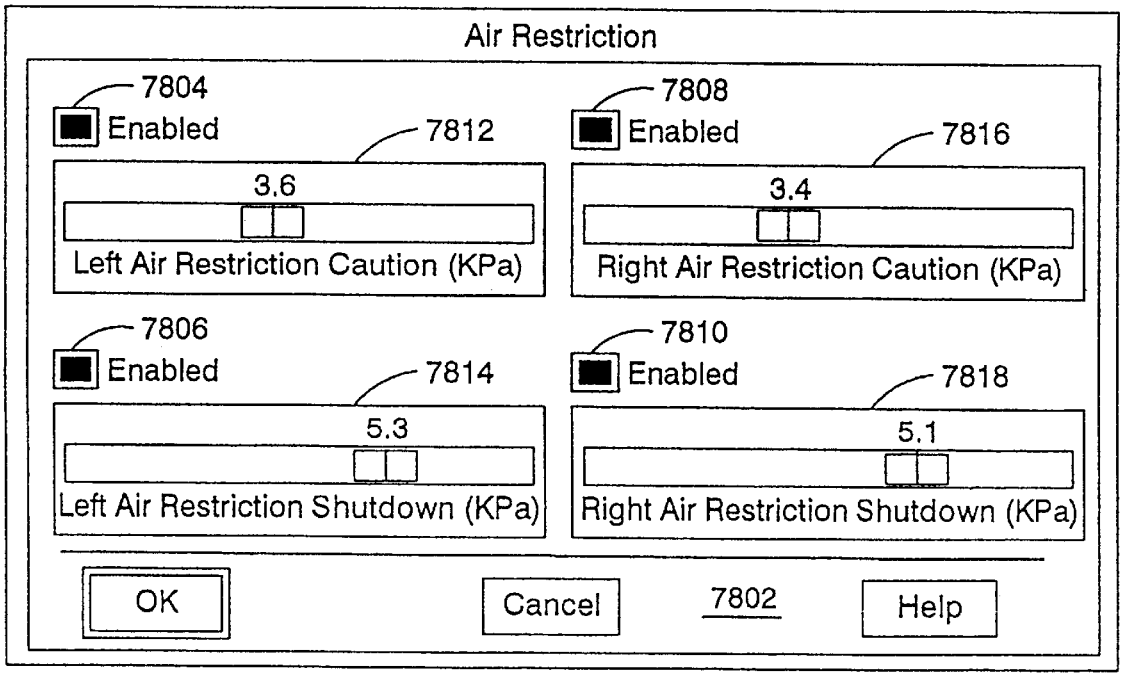
FIG. 78 is a diagrammatic view of an Air Restriction Window.

With reference to FIG. 78, an Air Restriction Window 7802 is displayed upon activation of an air restriction button 7606. The Air Restriction Window 7802 includes four toggle buttons 7804,7806,7808,7810 and corresponding sliders 7812,7814,7816,7818 for enabling and setting a left air restriction caution, a left air restriction shutdown, a right air restriction caution, and a right air restriction shutdown, respectively.

Figure 79:
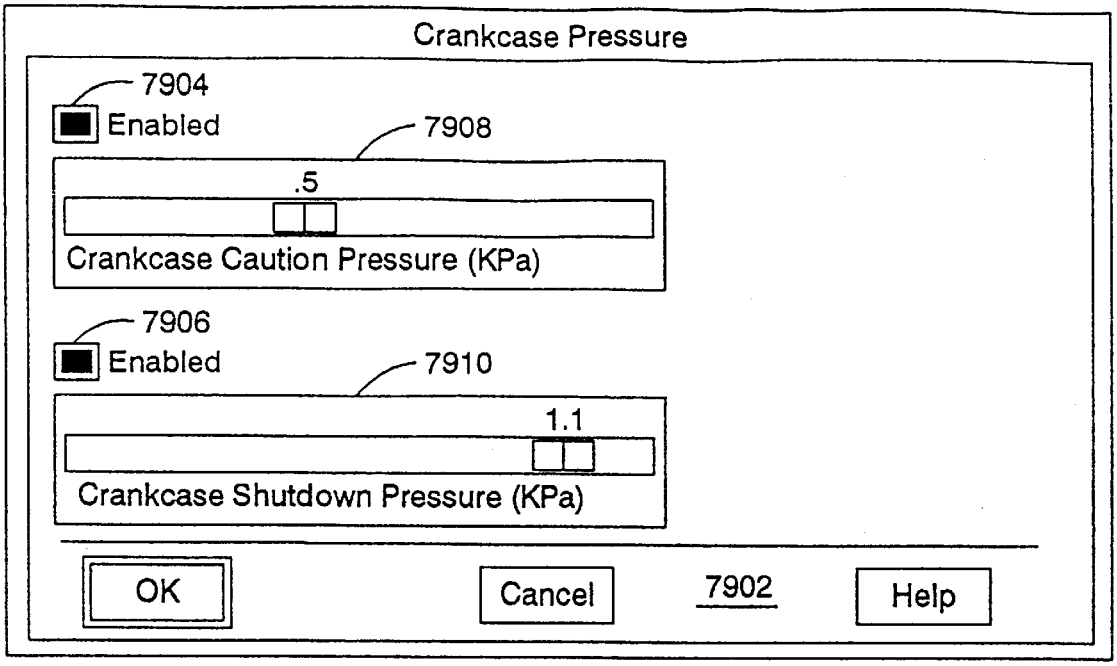
FIG. 79 is a diagrammatic view of a Crankcase Pressure Window.

With reference to FIG. 79, a Crankcase Pressure Window 7902 is displayed upon activation of a crankcase pressure button 7608. The Crankcase Pressure Window 7902 includes two buttons 7904,7906 and corresponding sliders 7908,7910 for enabling and setting a crankcase caution pressure and a crankcase shutdown pressure, respectively.

Figure 80:
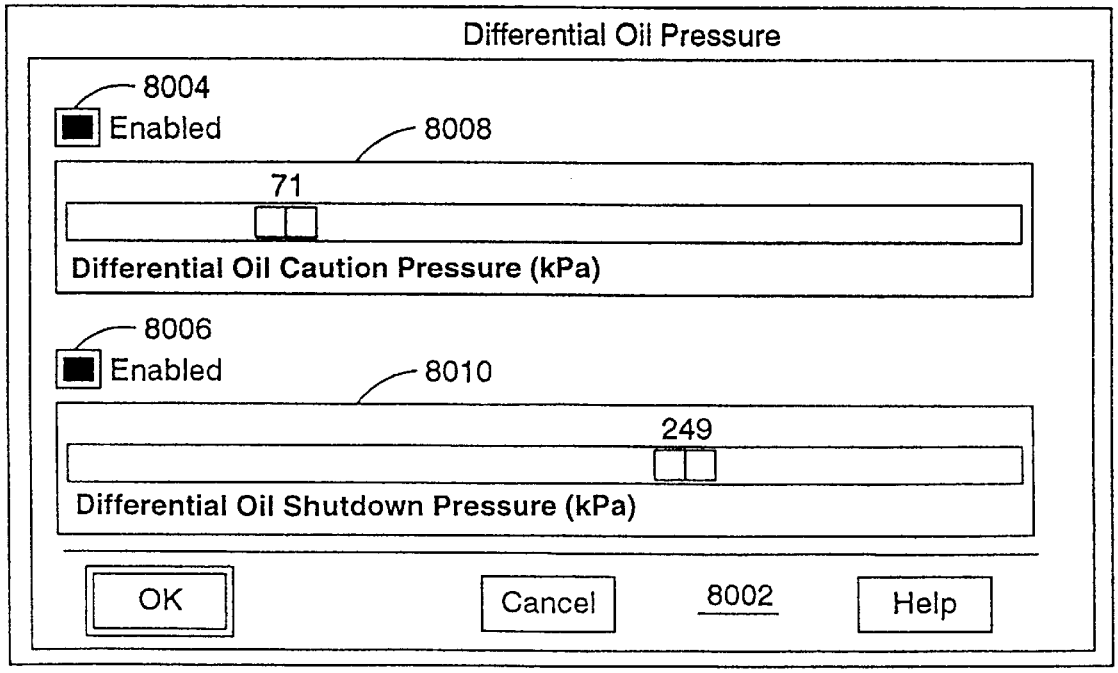
FIG. 80 is a diagrammatic view of a Differential Oil Pressure Window.

With reference to FIG. 80, a Differential Oil Pressure Window 8002 is displayed upon activation of a differential oil pressure button 7610. The Differential Oil Pressure Window 8002 includes two buttons 8004,8006 and corresponding sliders 8008,8010 for enabling and setting a differential oil caution pressure and a differential oil shutdown pressure, respectively.

Figure 81:
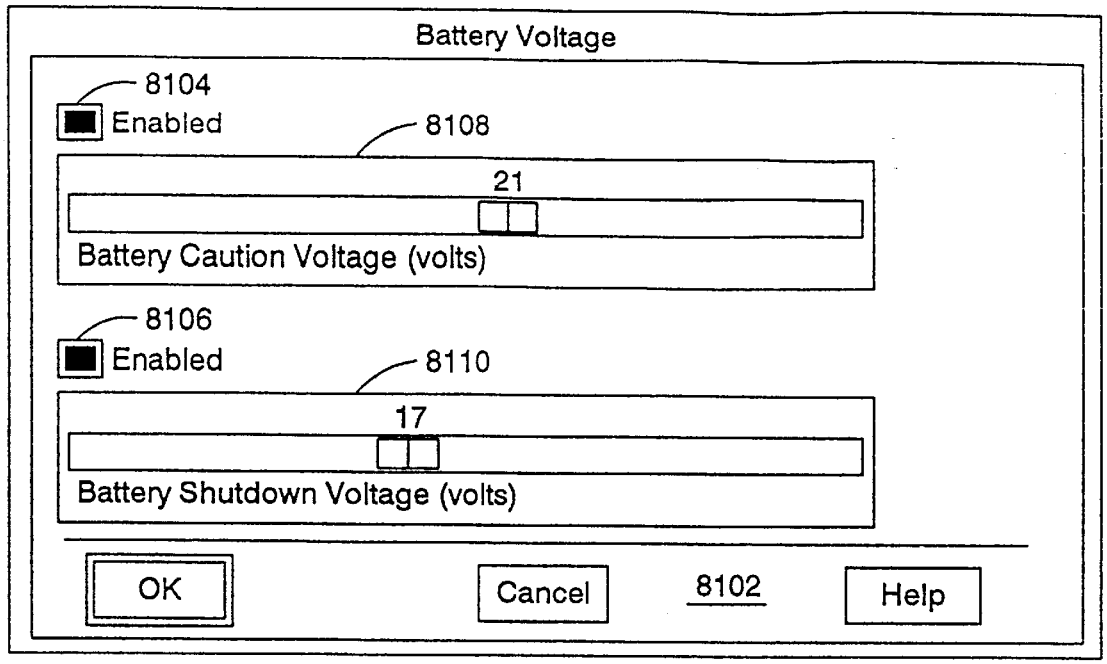
FIG. 81 is a diagrammatic view of a Battery Voltage Window.

With reference to FIG. 81, a Battery Voltage Window 8102 is displayed upon activation of a battery voltage button 7612. The Battery Voltage Window 8102 includes two buttons 8104,8106 and corresponding sliders 8108,8110 for enabling and setting a battery caution voltage and a battery shutdown voltage, respectively.

Figure 82:
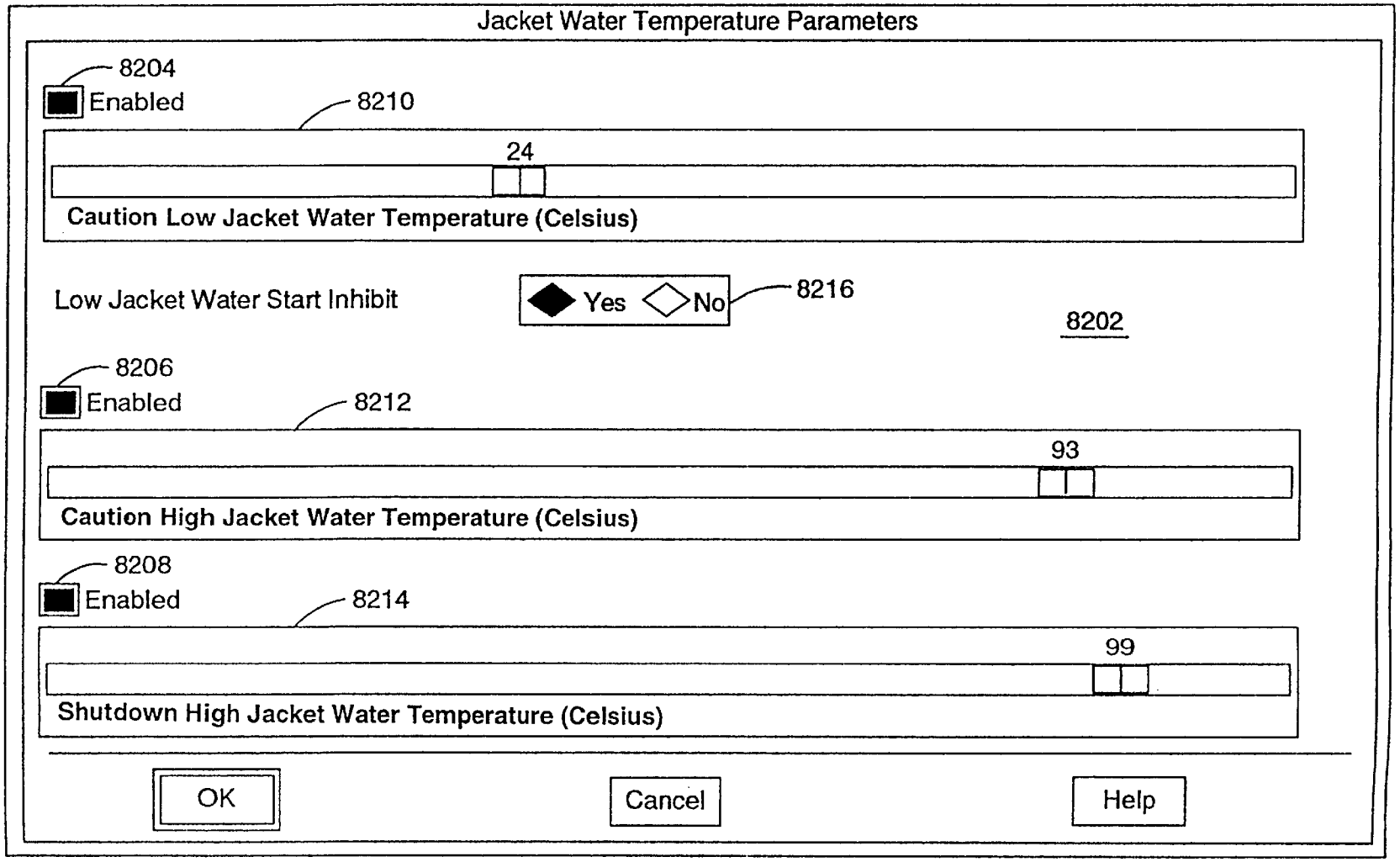
FIG. 82 is a diagrammatic view of a Jacket Water Temperature Parameters Window.

With reference to FIG. 82, a Jacket Water Temperature Parameters Window 8202 is displayed upon activation of a jacket water temperature button 7614. The Jacket Water Temperature Parameters Window 8202 includes three buttons 8204,8206,8208 and corresponding sliders 8210,8212, 8214 for enabling and setting a caution low jacket water temperature, a caution high jacket water temperature, and a shutdown high jacket water temperature, respectively.

Additionally, a radio box 8216 enables a low jacket water start inhibit function.

Figure 83:
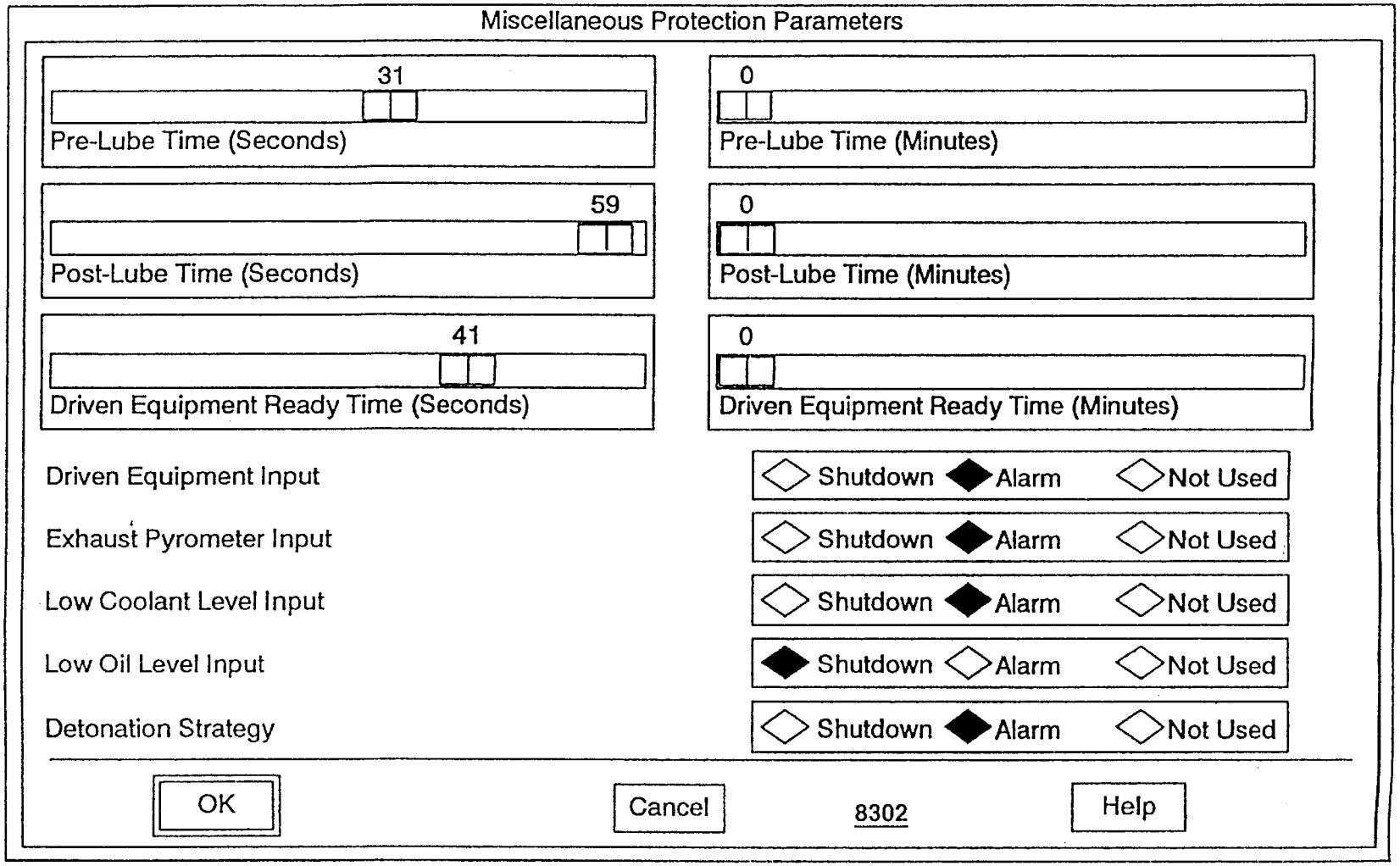
FIG. 83 is a diagrammatic view of a Miscellaneous Protection Parameters Window.

With reference to FIG. 83, a Miscellaneous Protection Parameters Window 8302 allows a number of miscellaneous protection parameters to be defined and/or enabled.

F. Building a Module

After the user has input the target controller's specifications, the Application Builder 102 creates a top level source file for the control software. This is known as building a module.

1. Building a Module for a Diesel Engine Controller

Figure 84:
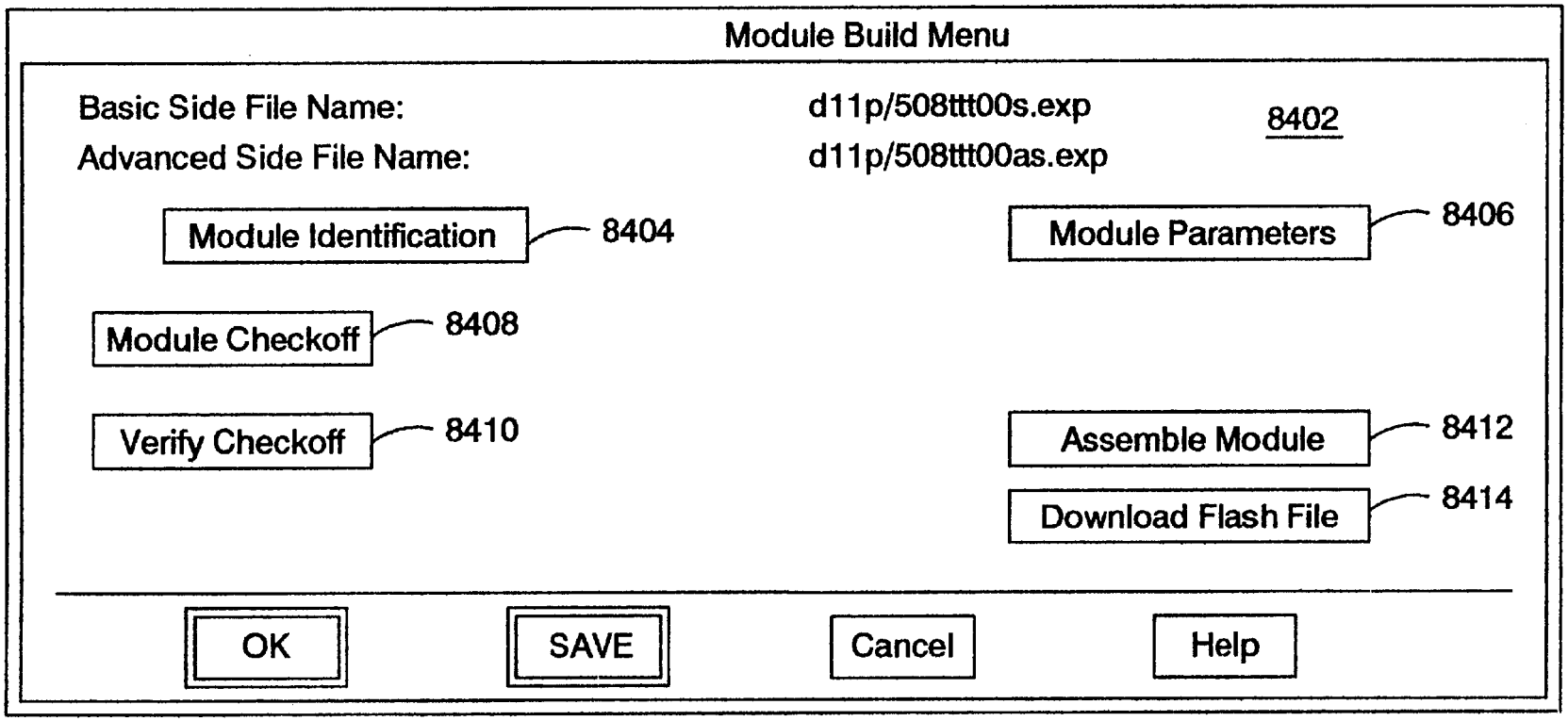
FIG. 84 is a diagrammatic view of a Module Build Menu Window.

After the user has input the target diesel controller's specifications, the Application Builder 102 creates a top level source file for the control software. This is known as building a module. With reference to FIG. 84, a Module Build Menu Screen 8402 is displayed when the user selects the Build option from the main menu. The Module Build Menu Screen 8402 has six (6) main options: Module Identification, Module Parameters, Module Checkoff, Verify Checkoff, Assemble Module, and Download Flash File. Each option is accessed via respective pushbuttons 8404, 8406,8408,8410,8412,8414. Each option may operate differently for different target controllers. However, the general operation is the same. Thus, building a module is discussed in relation to a diesel user.

Figure 85:
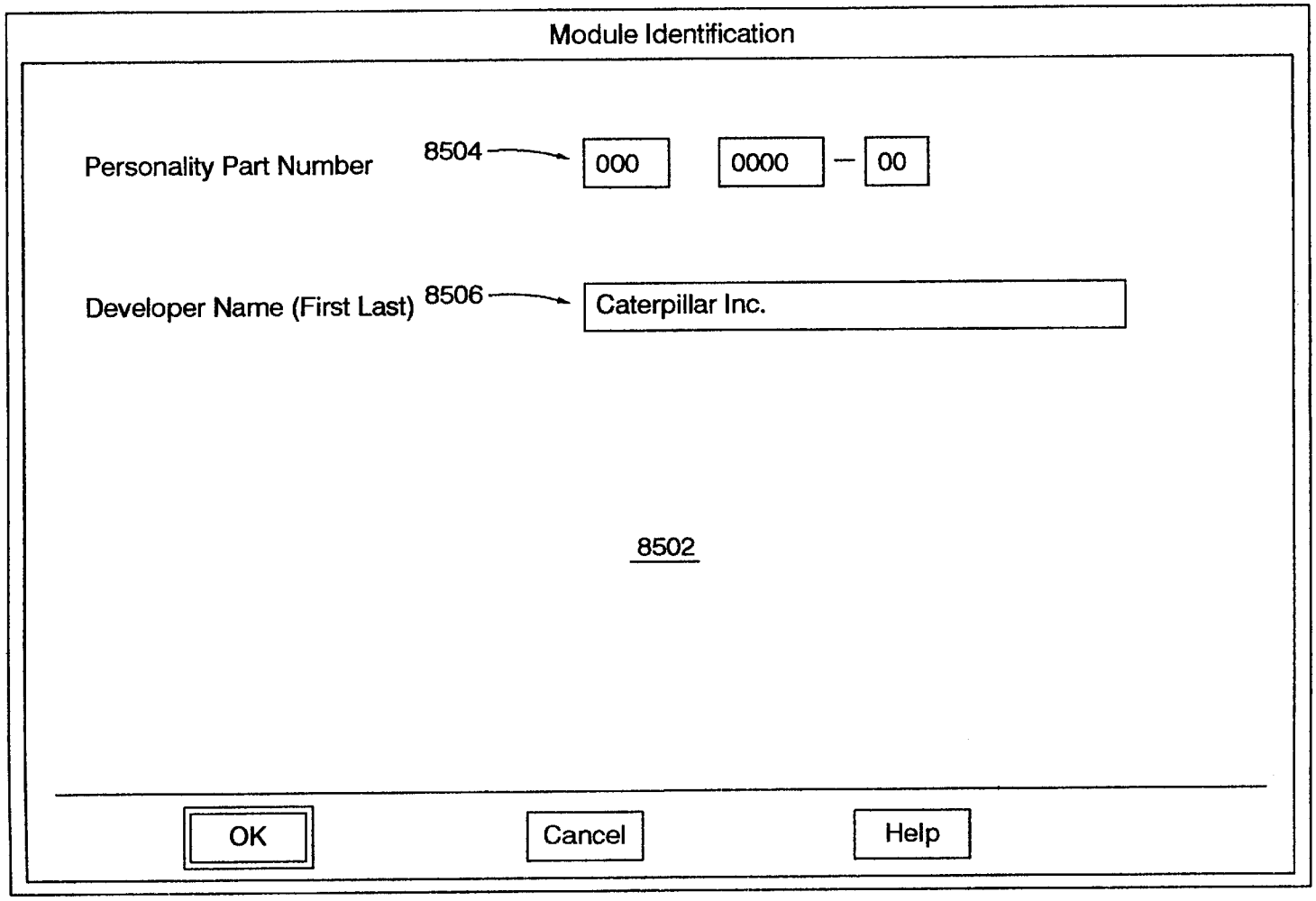
FIG. 85 is a diagrammatic view of a Module Identification Window.
Figure 8B:
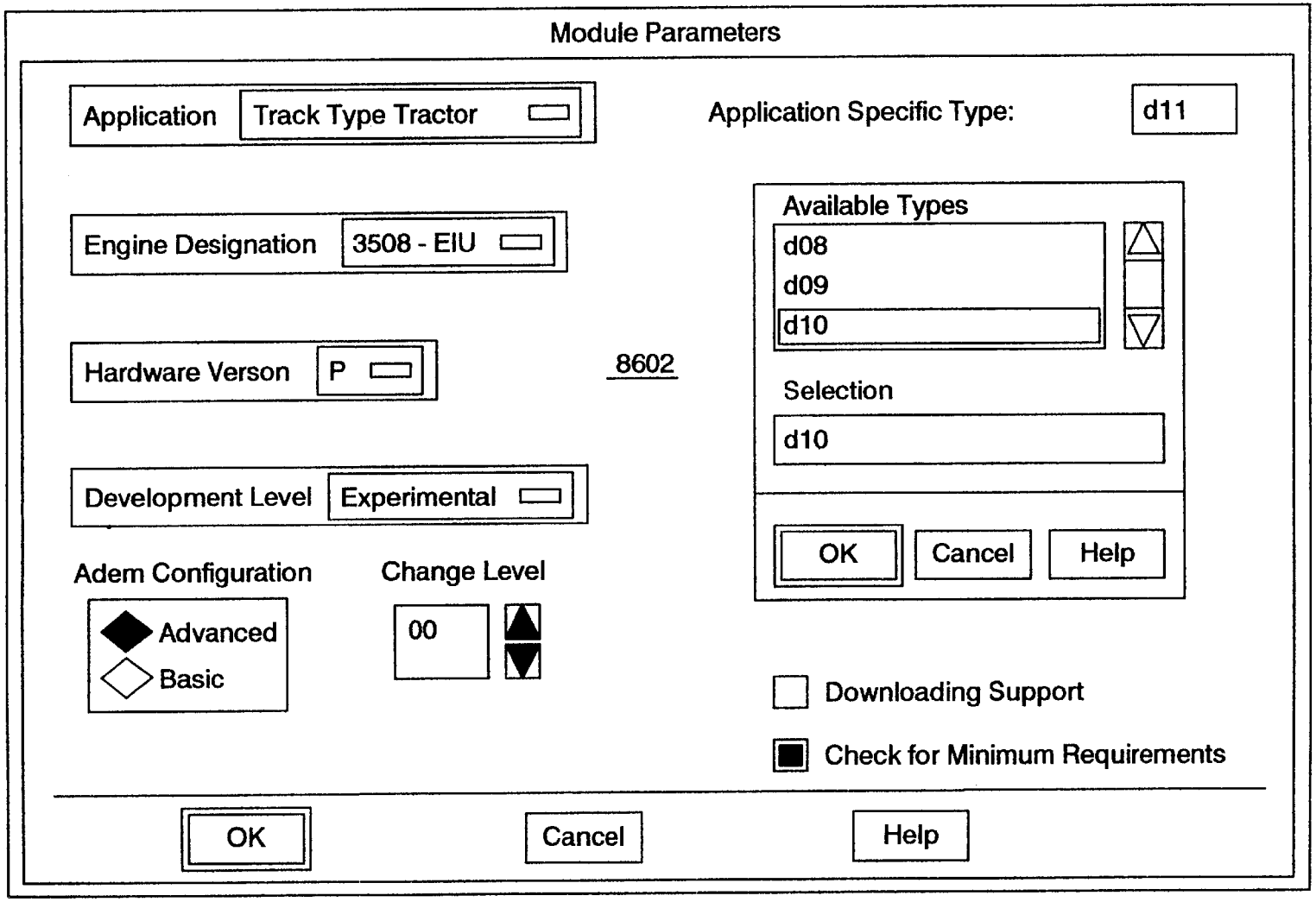
FIG. 8 is a diagrammatic view of a slider.

With reference to FIG. 85, when the Module Identification Pushbutton 8404 is actuated for the diesel engine user, a Module Identification Window 8502 is displayed. The Module Identification Window 8502 includes several text entry fields which are primarily used for production users (see PART VI.G.). A Personality Part Number text field 8504 is used to identify the particular module being developed. A Developer Name text field 8506 is used to identify the user.

With reference to FIG. 86, a Module Parameters Window 8602 is displayed when the user selects the Module Parameters Pushbutton 8406 from the Module Build Menu 8402. The Module Parameters Window 8602 is used to define the current application for the target controller software. It allows the application, e.g., a track type tractor; the engine designation, e.g., 3508 EUI; the hardware version; and the Development Level, e.g., Experimental; to be set. Additionally, a change level may be set which serves to distinguish modules having the same Personality Part Number.

With reference to FIGS. 87–88, if the Module Checkoff Pushbutton 8408 on the Module Build Menu 8402 is chosen, a Checkoff Submenu 8702 is displayed. The Submenu 8702 has two options: Checkoff Basic Side Features 8704 and Checkoff Advanced Side Features 8706. A Basic Sub-submenu 8708 displays a list of basic features. An Advanced Sub-submenu 8802 displays a list of advanced features.

Selection of one of the features under either sub-submenu displays a Checkoff menu. For example with reference to FIG. 89, if Fuel Features is chosen from the Basic Sub-submenu 8708 a Fuel Features Checkoff Menu 8902 is displayed. The Fuel Features Checkoff Menu 8902 includes a list of the Fuel Features and corresponding toggle buttons 8904. Those features that have been previously defined are enabled and the location of the file containing the data (constants and/or maps) are displayed. From this menu, additional fuel features can be enabled or disabled.

Figure 90:
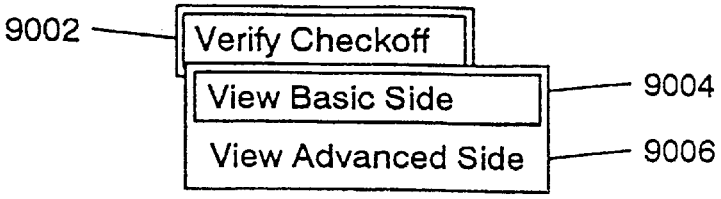
FIG. 90 is a diagrammatic view of the Verify Checkoff menu structure.

If the Verify Checkoff pushbutton 8410 is actuated, a Verify Checkoff Submenu 9002 is displayed. The Verify Checkoff Submenu 9002 includes two options: View Basic Side 9004 and View Advanced Side 9006. The view options display a summary of all enabled functions and the location of data files. For example, with reference to FIG. 90, if the View Basic Side 9004 option is chosen a Basic View Module Window 9102 is displayed.

When the user selects the Assemble Module Pushbutton 8412, the Application Builder 102 begins the assembly process. A file known as the balance file is appended to the source file. The balance file contains data which is not selected or defined through Application Builder 102. After the balance file has been added, a module assembly process is begun. During the assembly process, maps, constants, and other data, i.e., the specifications of the target controller, are compiled into code for the target microprocessor. The compiled code is known as the machine code. During the module assembly process, the code contained in the combined source and balance files is assembled into machine code.

Figure 92:
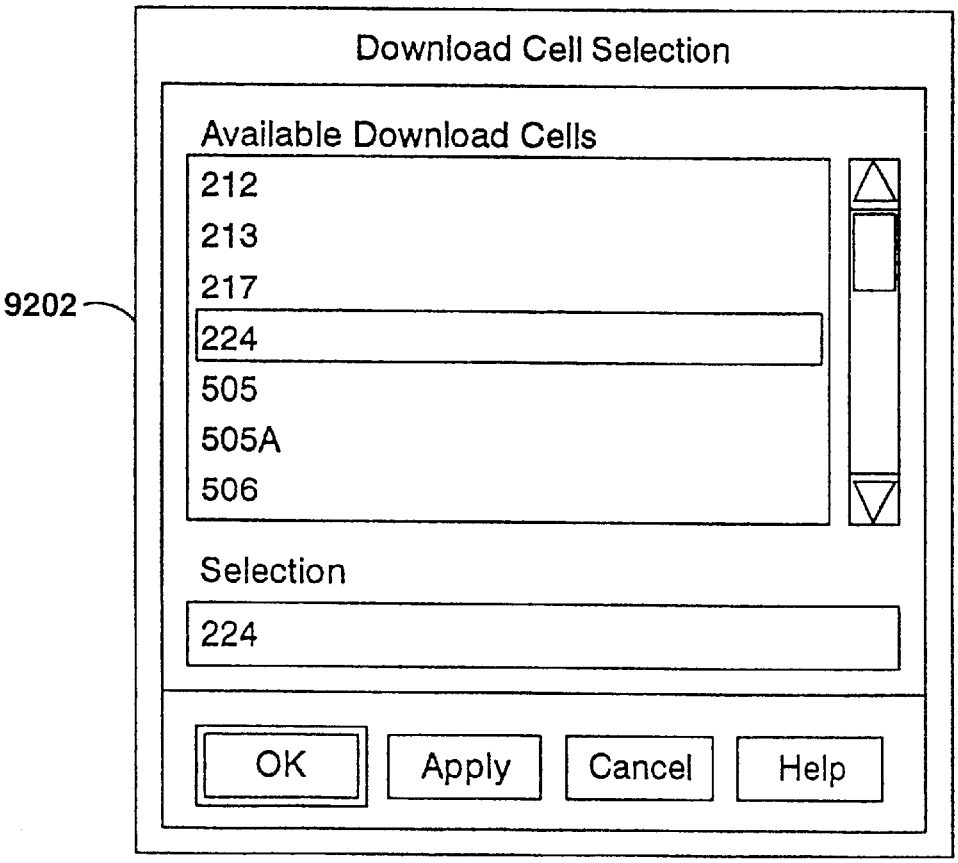
FIG. 92 is a diagrammatic view of a Download Cell Selection Popup.
Figure 91:
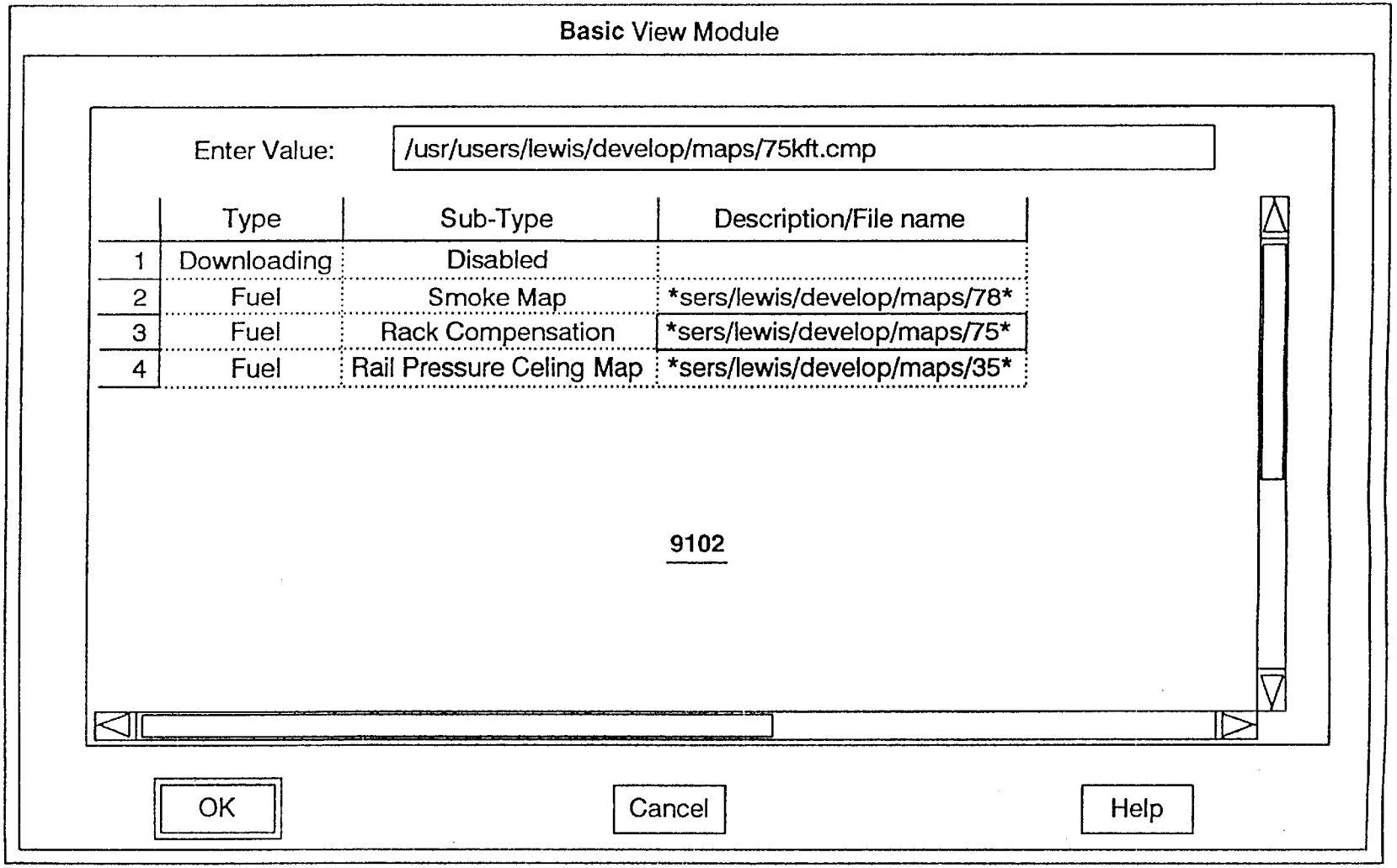
FIG. 91 is a diagrammatic view of a Basic View Module Window.

Additionally, if the Application Builder 102 is configured as a Diesel User, the Download Flash File Pushbutton 8414 is used for downloading the assembled machine code to a test cell. With reference to FIG. 92, activation of the Download Flash File Pushbutton 8414 displays a Download Cell Selection Dialog Popup 9202. The Download Cell Selection Dialog Popup 9202 enables a specific test cell to be selected.

2. Building a Module for a Natural Gas Engine Controller

Figure 93:
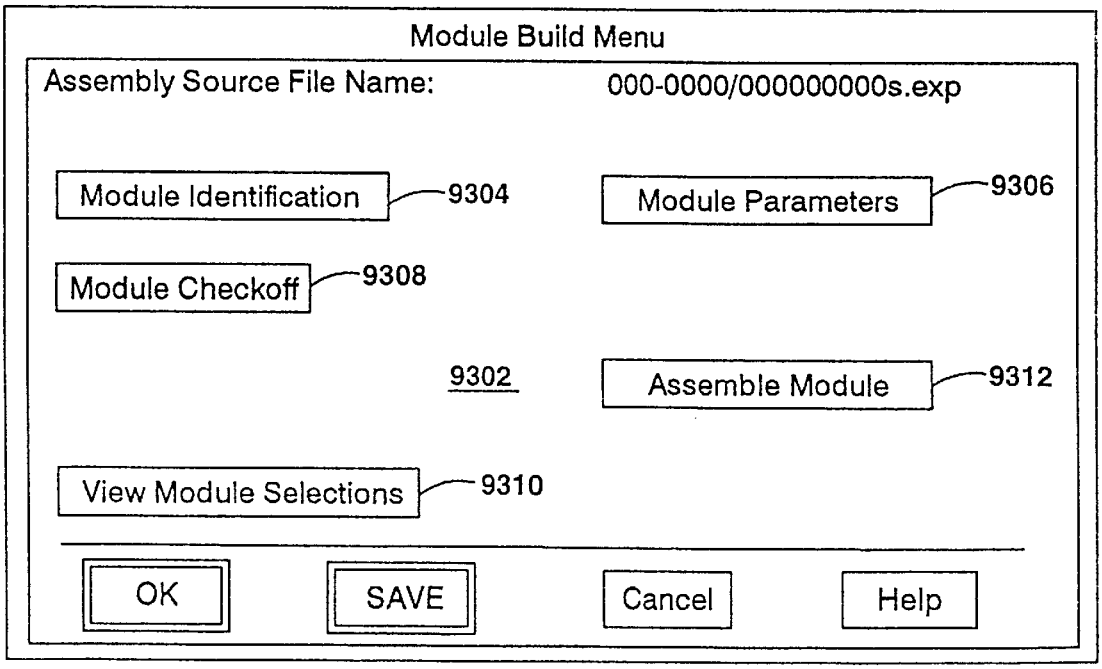
FIG. 93 is a diagrammatic view of a Module Build Menu.

With reference to FIG. 93, a Module Build Menu Screen 9302 is displayed when the user selects the Build option from the main menu. The Module Build Menu Screen 9302 has five (5) main options: Module Identification, Module Parameters, Module Checkoff, View Module Selections, and Assemble Module. Each option is accessed via respective pushbuttons 9304,9306,9308,9310,9312.

Figure 94:
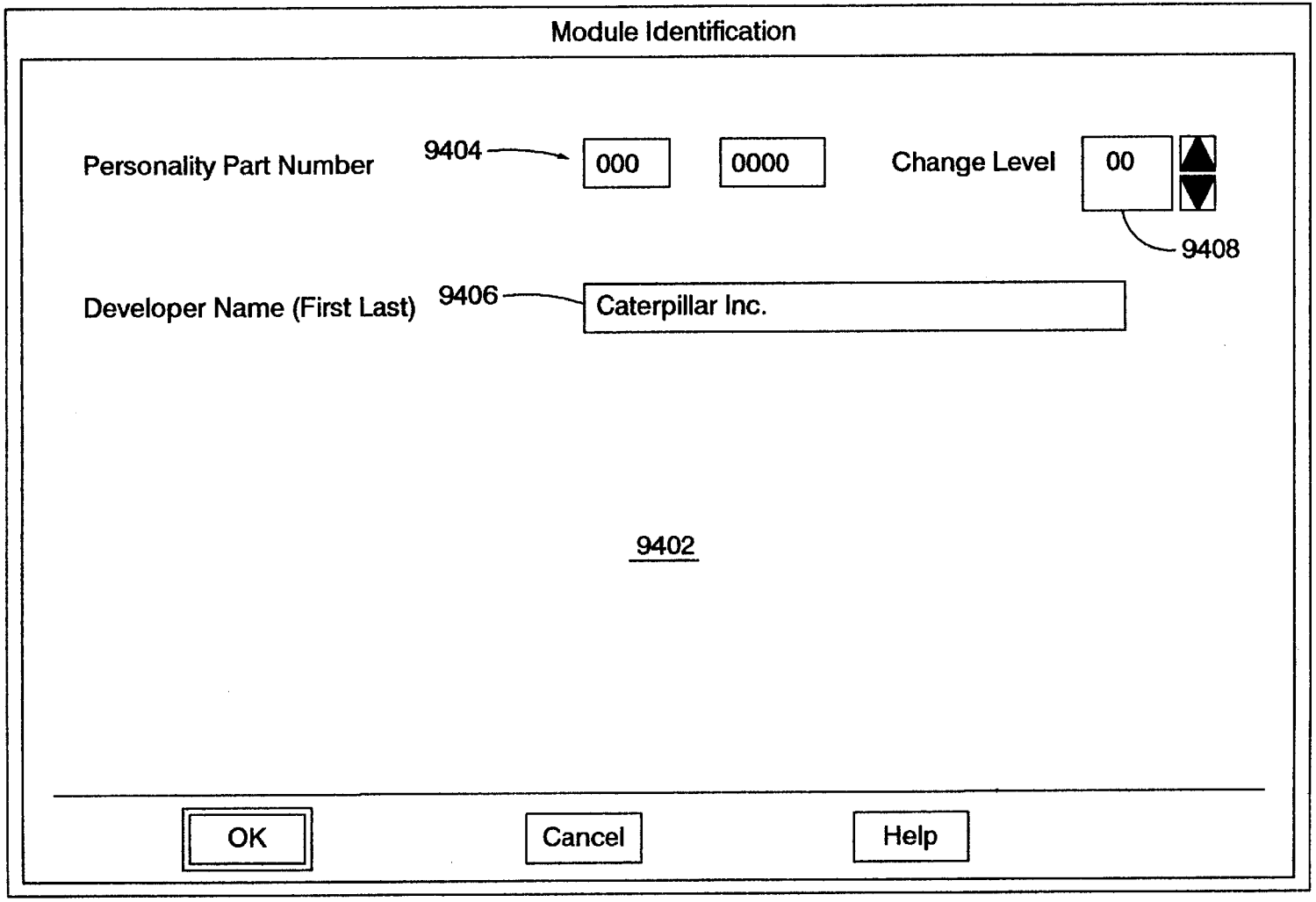
FIG. 94 is a diagrammatic view of a Module Identification Window.

With reference to FIG. 94, when the Module Identification Pushbutton 9304 is actuated, a Module Identification Window 9402 is displayed. The Module Identification Window 9402 includes several text entry fields which are used primarily in the move to production process (see PART VI.G.). A Personality Part Number text field 9404 is used to identify the particular module being compiled. A Developer Name text field 9406 is used to identify the user. Additionally, a text box 9408 allows entry of a change level (see Part VI.G.).

Figure 95:
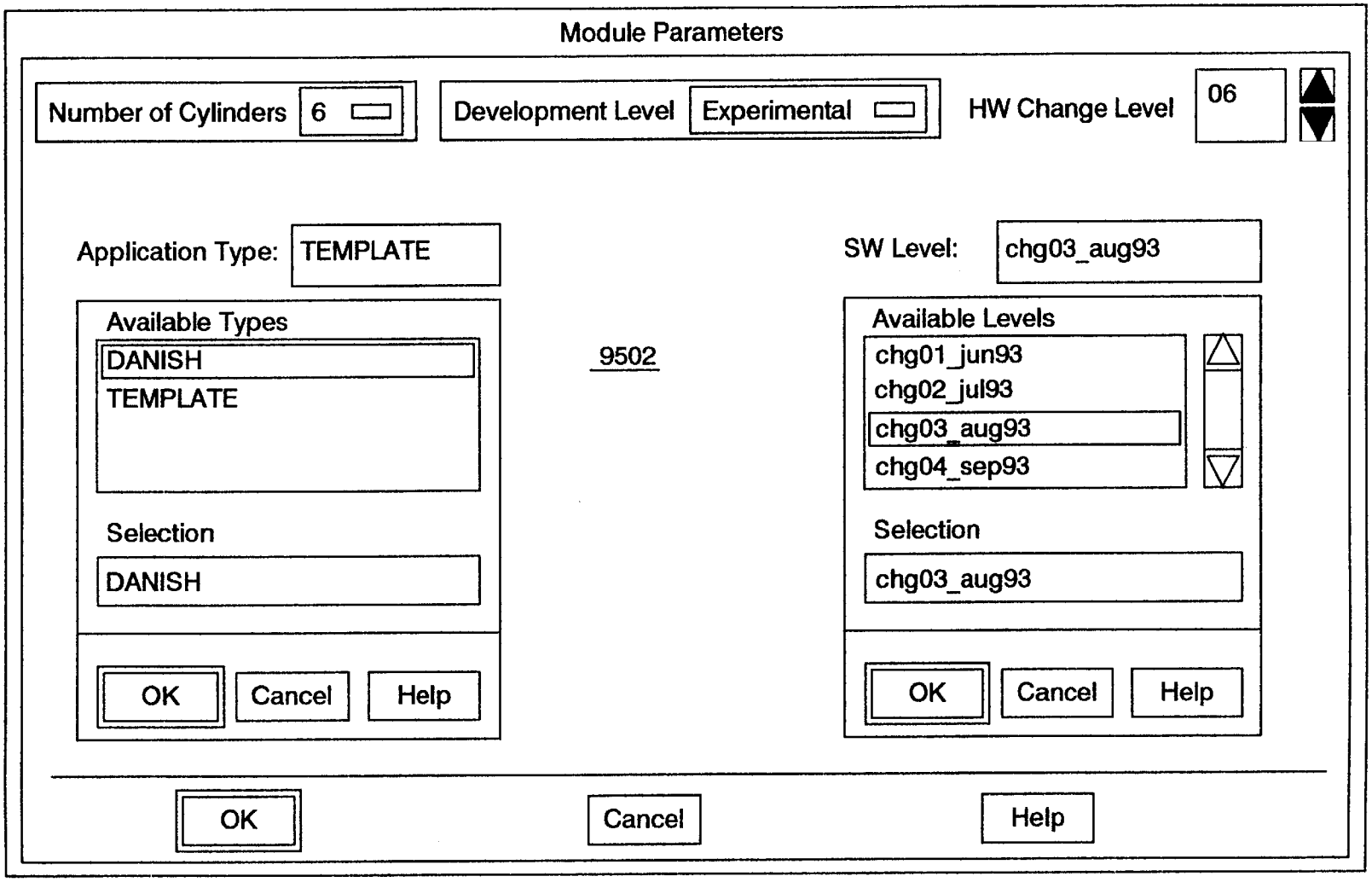
FIG. 95 is a diagrammatic view of a Module Parameters Window.

With reference to FIG. 95, a Module Parameters Window 9502 is displayed when the user selects the Module Parameters Pushbutton 9306 from the Module Build Menu 9302. The Module Parameters Window 9502 is used to define the current application for the target controller software. It allows the number of cylinders of the target engine, the Development Level, e.g., Experimental, a hardware change level, a software change level and the engine application type to be set.

Figure 96:
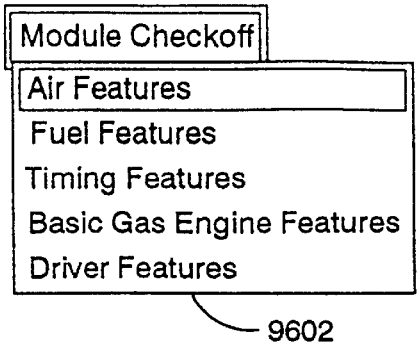
FIG. 96 is a diagrammatic view of a Module Checkoff Submenu.

With reference to FIG. 96, if the Module Checkoff Pushbutton 9308 is activated, a Checkoff Submenu 9602 is displayed. The Submenu 9602 displays a list of the available features.

Figure 97:
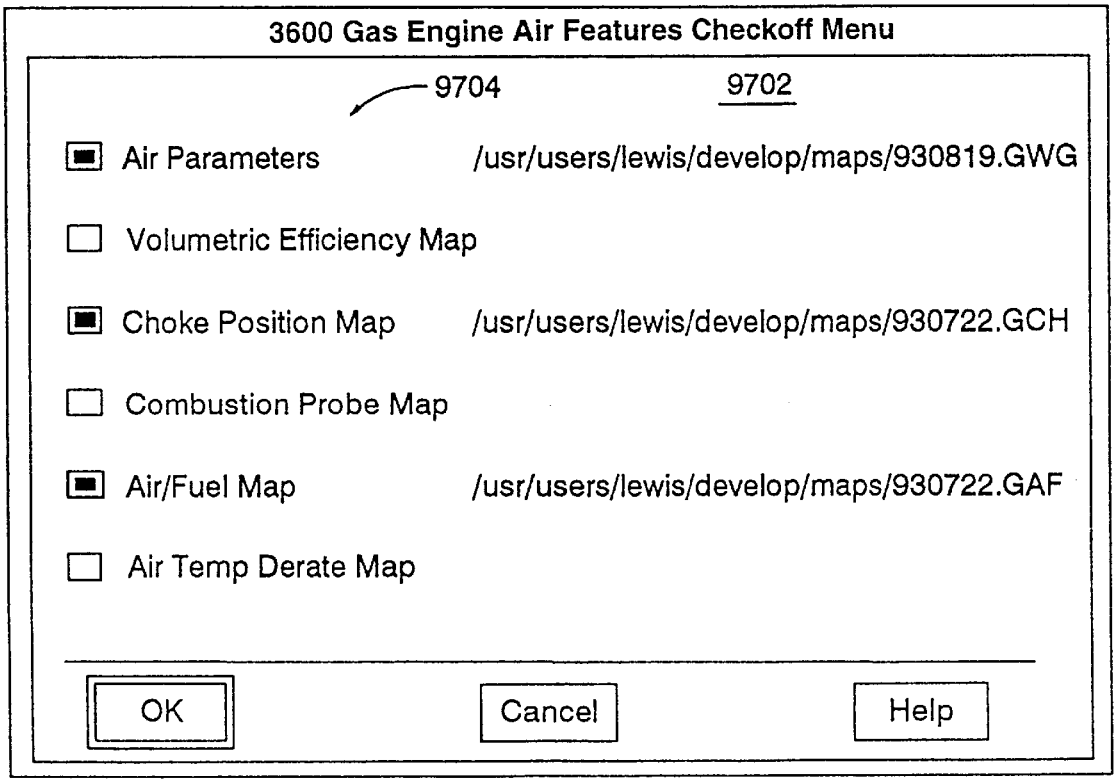
FIG. 97 is a diagrammatic view of an Air Features Checkoff Menu.

Selection of one of the features under the submenu displays a Checkoff menu. For example, with reference to FIG. 97, if Air Features is chosen from the submenu 9602 an Air Features Checkoff Menu 9702 is displayed. The Air Features Checkoff Menu 9702 includes a list of the Air Features and corresponding toggle buttons 9704. Those features that have been previously defined are enabled and the location of the file containing the data (constants and/or maps) are displayed. From this menu, additional features can be enabled or disabled.

Figure 98:
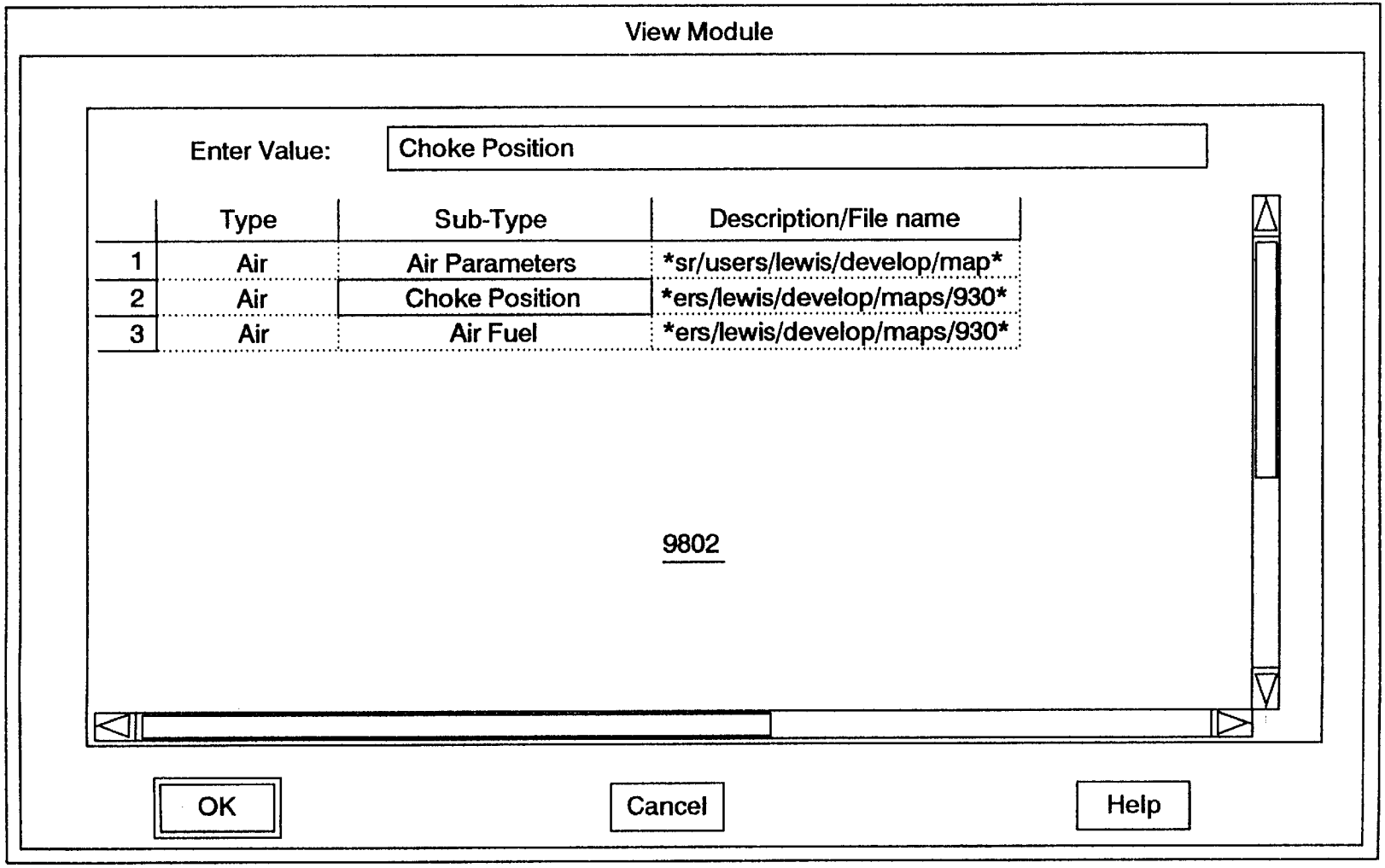
FIG. 98 is a diagrammatic view of a View Module Window.

With reference to FIG. 98, when the user selects the View Module button 9310 a View Module Window 9802 is displayed. The View Module Window 9802 displays a list of enabled features.

When the user selects the Assemble Module Selections Pushbutton 9312, the Application Builder 102 begins the assembly process. During the assembly process, maps, constants, and other data, i.e., the specifications of the target controller, are compiled into code for the target microprocessor. The compiled code is known as machine code.

G. Moving to Production

Figure 99:
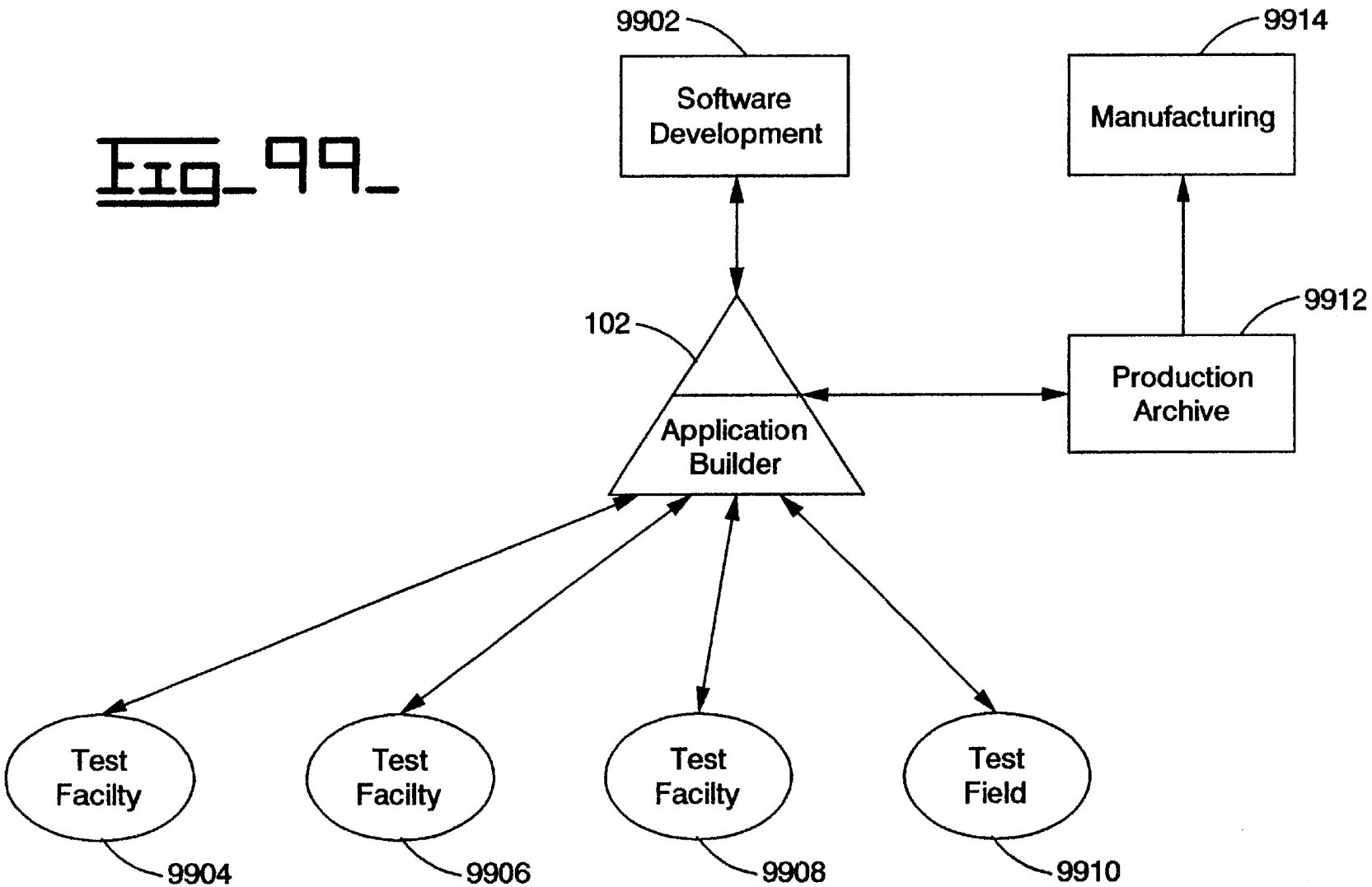
FIG. 99 is a diagrammatic view of Application Builder access.

The Application Builder 102 may be utilized by various users at different locations. Different users may be given different levels of authorization. For example with reference to FIG. 99, engine designs may be tested by software engineers at one location 9902. Engine designs may also be tested at three different test locations: Test Facility 9904, Test Facility 9906, and Test Facility 9908. Additionally, engine designs may be tested from field sights 9910. Users at these different locations may have different authorization. That is, different users may have authorization to modify all or various subsets of the target controller's specifications.

A move to production enables Application Builder 102 to have special authorization to store specification (data) files and production software in a Production Archive 9912. A Production Archive 9912 is a protected subdirectory on a particular workstation. Files located on the Production Archive cannot be modified. There may be more than one Production Archive. In one embodiment, both the specification files and the production software are stored in a production archive. In another embodiment, the specification files are stored in a separate Protected Archive.

The data files and controls software stored in the production archive 9912 serves three main purposes. First, files in the archive cannot be modified or deleted. This, the archive serve as long term storage for production level software. Second, the Production Archive 9912 is accessible at the manufacturing level 9914. Control software for a specific application can be downloaded directly from the Production Archive 9912. This ensures not only the integrity of the control software, but also that the most current version is utilized. And third, the control software and data can be downloaded by other users and used as a baseline for additional variations and modifications to be tested.

The move to production process also sends an automatic electronic mail message to a set of predefined persons as a notification that a module has been saved to the Production Archive 9912. For example, once the Application Builder 102 has stored control software and/or specifications in the Production Archive 9912, Application Builder 102 automatically sends as electronic mail message to software development engineers 9902.

Figure 100:
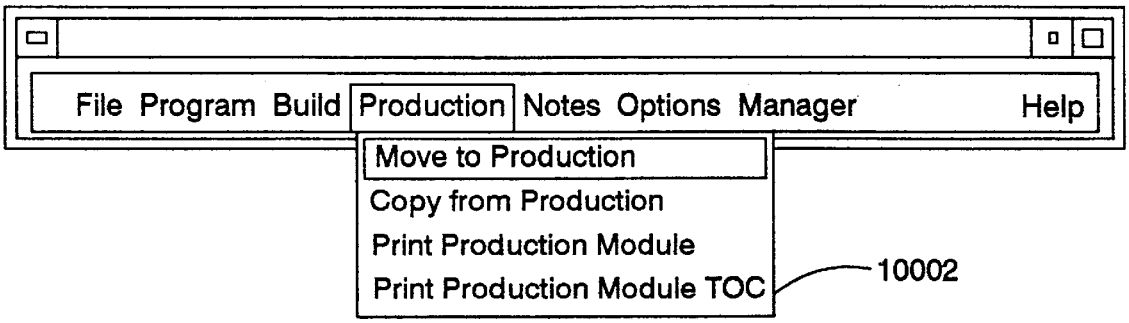
FIG. 100 is a diagrammatic view of the Production Menu structure of the Main Menu.

The Production Archive 9912 is accessed using the Production Menu located on the Pull Down Menu Bar 304 on the Main Screen 302 of Application Builder 102. With reference to FIG. 100, the Production Menu 10002 includes four options: Move to Production, Copy from Production, Print Production Module, and Print Production Module TOC (Table of Contents). The latter three options provide read only access to the Production Archive 9912.

If the Move to Production option is chosen, three checks are completed. First, the accessibility of all referenced data files is confirmed. Second, certain features are required. The required features may change for different applications. A set of required features is known as a minimum set of production requirements. Third, the module and data are checked for specific dependencies.

Figure 101:
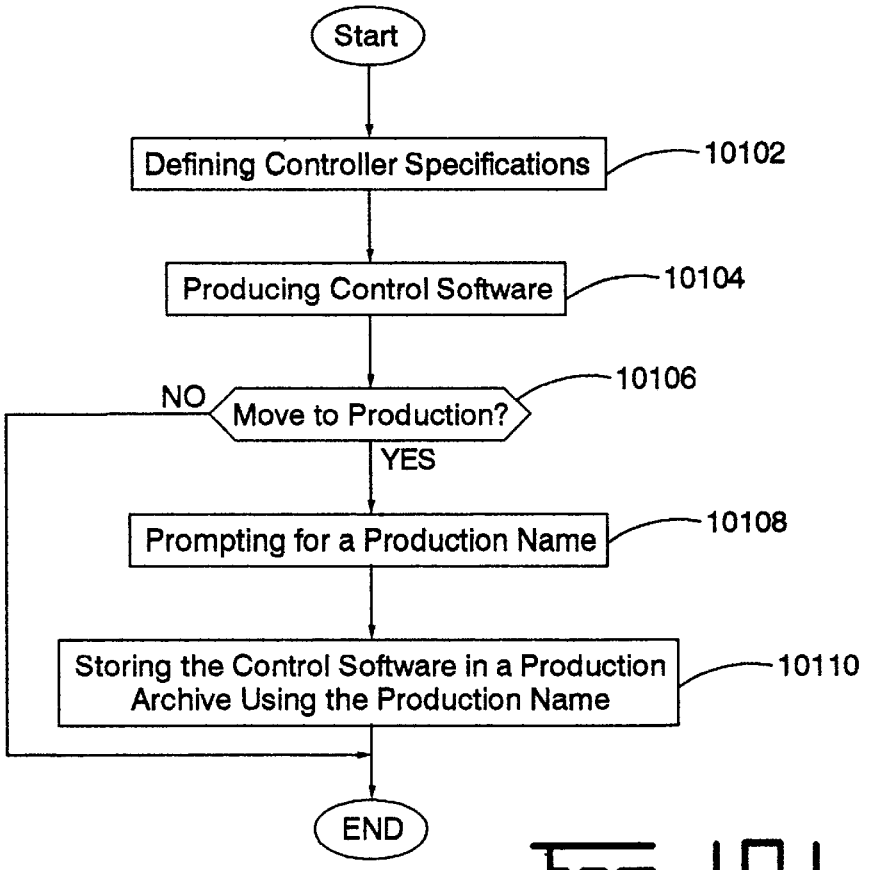
FIG. 101 is a control diagram illustrating a first embodiment of the present invention; and, FIG. 102 is a control diagram illustrating a second embodiment of the present invention.

With reference to FIG. 101, the entire process is generally described. In a first control block 10102, the specifications of the target controller are defined by the user. In a second control block 10104, the control software is produced based on the input specifications. In a decision block 10106, if the Move to Production option has been chosen, the process proceeds to a third control block 10108. In the third control block 10108, the user is prompted for a production name, or a part number. Then in a fourth control block 10110, the control software is stored in the Production Archive 9912 using the assigned production name or part number.

Figure 102:
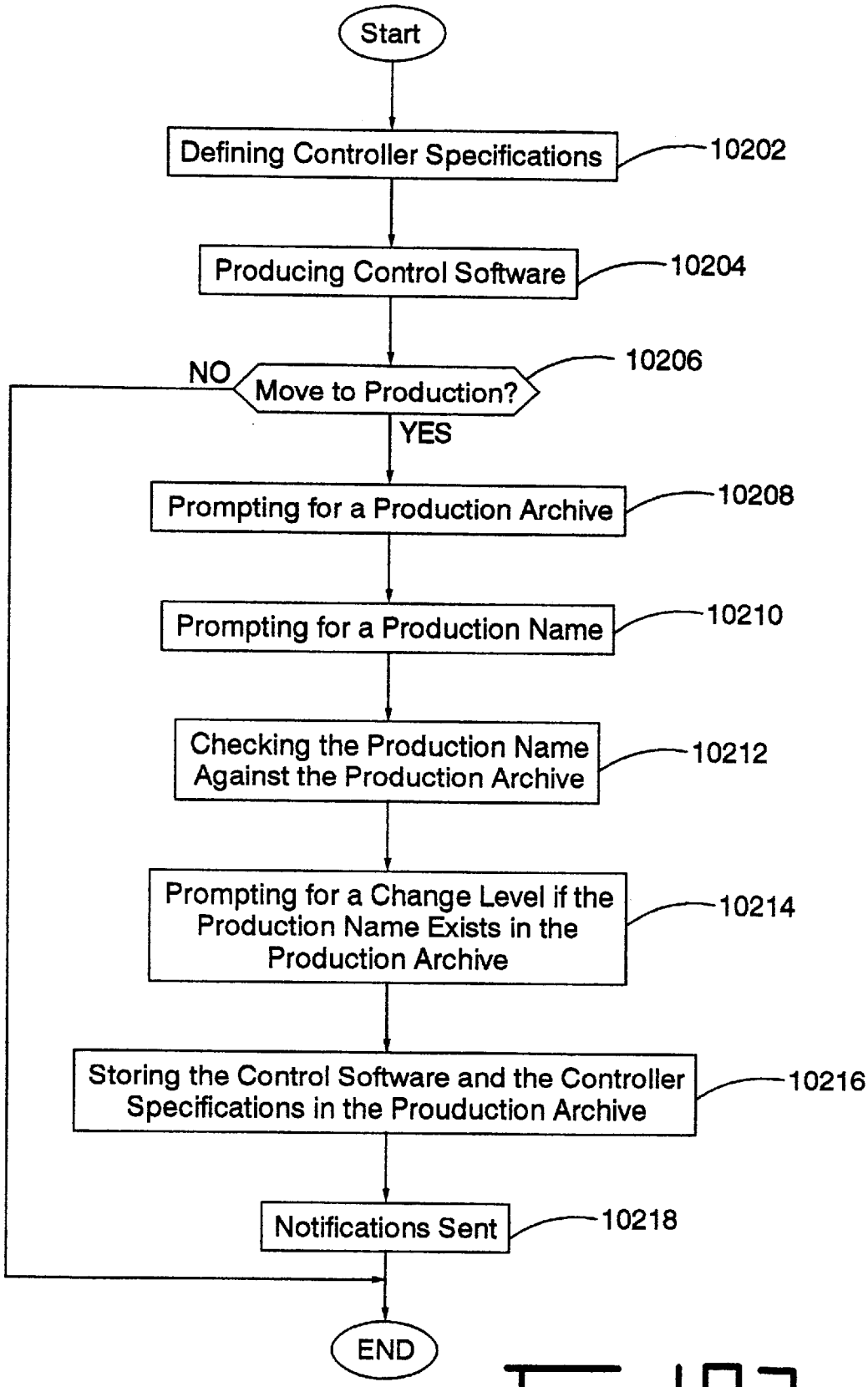

With reference to FIG. 102, a second embodiment of the process is generally described. In a fifth control block 10202, the specifications of the target controller are defined by the user. In a sixth control block 10204, the control software is produced based on the input specifications. In a second decision block 10206, if the Move to Production option has been chosen, the process proceeds to a seventh control block 10208. In the seventh control block 10208, the user is prompted for a production archive. In an eighth control block 10210 the user is prompted for a production name or part number. The input production name is checked against existing part numbers stored in the Production Archive 9912 in a ninth control block 10212. If the part number exists, then the user is prompted for a change level. In a tenth control block 10216, the control software is stored in the Production Archive 9912 using the assigned production name (and change level, if appropriate). Lastly, in an eleventh control block 10218, an electronic mail message is automatically sent to a set of predetermined persons.

VII. Industrial Applicability

With reference to the drawings, and in operation, the Application Builder 102 is adapted to produce the software for a target controller 104. The target controller 104 is adapted to control a controlled device 106.

A user of the Application Builder 102 need not have any programming experience. The user simply inputs the specifications and parameters of target controller 104 and controlled device 106 using the screens of the Application Builder 102. After this process is completed, the Application Builder 102 assembles the machine code for the particular microprocessor(s) on the target controller 104.

The Application Builder 102 is useful in many different situations. The Application Builder 102 may be used in the design of a new application based on the common platform. The Application Builder 102 may also be used to develop and distribute updates to the code for controllers already in use. Additionally, Application Builder 102 may be used during the manufacture of new machines. Not only does each machine model have different requirements, but each individual machine may have different requirements based on machine options, ultimate work site of the machine, and/or customer preference. The Application Builder allows the software to be run on the target controller 104 to be produced without being skilled in engineering.

Other aspects, objects, advantages and uses of this invention can be obtained from a study of the drawings, disclosure, and appended claims.

What is claimed is:

1. A method of operating a computer to produce control software for an electronic controller for a natural gas engine or a diesel engine, the method comprising the steps of:

(1) selecting a target device as one of a diesel engine controller and a natural gas engine controller;

(2) defining a set of specifications of the electronic controller and the selected target device as a function of user input, wherein the selected target device is a natural gas engine and including the substeps of:

(i) defining a set of air features of the electronic controller and the natural gas engine as a function of user input, (ii) defining a set of fuel features of the electronic controller and the natural gas engine as a function of user input, (iii) defining a set of timing features of the electronic controller and the natural gas engine as a function of user input, and (iv) defining a set of engine core features of the electronic controller and the natural gas engine as a function of user input; and (3) producing control software to operate the controller as specified by said specifications.

2. A method, as set forth in claim 1, including the step of defining a set of protection features of the electronic controller and the natural gas engine as a function of user input.

3. A method, as set forth in claim 1, wherein said air features include an air/fuel map.

4. A method, as set forth in claim 1, wherein said fuel features includes governor parameters.

5. A method, as set forth in claim 1, wherein said fuel features includes feedback points, a BTU setting, and fuel factors.

6. A method, as set forth in claim 1, wherein said fuel features includes a transient air/fuel map.

7. A method, as set forth in claim 1, wherein said fuel features include an idle fuel map.

8. A method, as set forth in claim 1, wherein the selected target device is a diesel engine and the step of defining a set of specification of the electronic controller includes the steps of:

(1) defining a set of fuel features of the electronic controller and the diesel engine as a function of user input;

(2) defining a set of timing features of the electronic controller and the diesel engine as a function of user input; and (3) defining a set of speed features of the electronic controller and the diesel engine as a function of user.

9. A method, as set forth in claim 8, wherein the step of defining a set of specifications of the electronic controller includes the step of:

(1) defining a set of engine core features of the electronic controller and the diesel engine as a function of user input.

10. A method, as set forth in claim 8, wherein the step of defining a set of specification of the electronic controller includes the step of:

(1) defining a set of engine mode features of the electronic controller and the diesel engine as a function of the user input.

11. A method, as set forth in claim 8, wherein the step of defining a set of specification of the electronic controller includes the step of:

(1) defining a set of service features of the electronic controller and the diesel engine as a function of user input.

12. A method, as set forth in claim 8, wherein the step of defining a set of specification of the electronic controller includes the step of:

(1) defining a set of peripheral features of the electronic controller and the diesel engine as a function of user input.

13. A method, as set forth in claim 8, wherein the step of defining a set of specification of the electronic controller includes the step of:

(1) defining a set of hardware features of the electronic controller and the diesel engine as a function of user input.

14. A method of operating a computer to produce control software for an electronic controller for a natural gas engine or a diesel engine, the method comprising the steps of:

selecting a target device as one of a diesel engine controller and a natural gas engine controller;

defining a set of specifications of the electronic controller an the selected target device as a function of user input, wherein the selected target device is a natural gas engine and including the substeps of:

defining a set of air features of the electronic controlled and the natural gas engine as a function of used input, defining a set of fuel features of the electronic controller and the natural gas engine as a function of user input, and defining a set of timing features of the electronic controller and the natural gas engine as a function of user input;

defining a set of protection features of the electronic controller and the natural gas engine as a function of user input, where said step of defining a set of protection features includes the substeps of:

enabling protection features for a set of parameters, defining a set of caution values corresponding to said set of parameters, and defining a set of shutdown values corresponding to said set of parameters; and, producing control software to operate the controller as specified by said specifications.

15. A method, as set forth in claim 14, wherein said at set of protection features includes air temperature, air restriction, crankcase pressure, differential oil pressure, battery voltage, jacket water temperature.

16. A method of operating a computer to produce control software for an electronic controller for a natural gas engine or a diesel engine, the method comprising the steps of:

selecting a target device as one of a diesel engine controller and a natural gas engine controller;

defining a set of specifications of the electronic controller an the selected target devices as a function of user input, wherein the selected target device is a natural gas engine and including the substeps of:

defining a set of air features of the electronic controlled and the natural gas engine as a function of used input, defining a set of fuel features of the electronic controller and the natural gas engine as a function of user input, and defining a set of timing features of the electronic controller and the natural gas engine as a function of user input, wherein said air features include wastegate parameters; and producing control software to operate the controller as specified by said specifications.

17. A method of operating a computer to produce control software for an electronic controller for a natural gas engine or a diesel engine, the method comprising the steps of:

selecting a target device as one of a diesel engine controller and a natural gas engine controller;

defining a set of specifications of the electronic controller an the selected target device as a function of user input, wherein the selected target device is a natural gas engine and including the substeps of:

defining a set of air features of the electronic controlled and the natural gas engine as a function of used input, defining a set of fuel features of the electronic controller and the natural gas engine as a function of user input, and defining a set of timing features of the electronic controller and the natural gas engine as a function of user input, wherein said air features include a volumetric efficiency map; and producing control software to operate the controller as specified by said specifications.

18. A method of operating a computer to produce control software for an electronic controller for a natural gas engine or a diesel engine, the method comprising the steps of:

selecting a target device as one of a diesel engine controller and a natural gas engine controller;

defining a set of specifications of the electronic controller an the selected target device as a function of user input, wherein the selected target device is a natural gas engine and including the substeps of:

defining a set of air features of the electronic controlled and the natural gas engine as a function of used input, defining a set of fuel features of the electronic controller and the natural gas engine as a function of user input, and defining a set of timing features of the electronic controller and the natural gas engine as a function of user input, wherein said air features include a choke map; and producing control software to operate the controller as specified by said specifications.

19. A method of operating a computer to produce control software for an electronic controller for a natural gas engine or a diesel engine, the method comprising steps of:

selecting a target device as one of a diesel engine controller and a natural gas engine controller;

defining a set of specifications of the electronic controller an the selected target device as a function of user input, wherein the selected target device is a natural gas engine and including the substeps of:

defining a set of air features of the electronic controlled and the natural gas engine as a function of used input, defining a set of fuel features of the electronic controller and the natural gas engine as a function of user input, and defining a set of timing features of the electronic controller and the natural gas engine as a function of user input, wherein said air features include a combustion probe map; and producing control software to operate the controller as specified by said specifications.

20. A method of operating a computer to produce control software for an electronic controller for a natural gas engine or a diesel engine, the method comprising the steps of:

selecting a target device as one of a diesel engine controller and a natural gas engine controller;

defining a set of specifications of the electronic controller an the selected target device as a function of user input, wherein the selected target device is a natural gas engine and including the substeps of:

defining a set of air features of the electronic controlled and the natural gas engine as a function of used input, defining a set of fuel features of the electronic controller and the natural gas engine as a function of user input, and defining a set of timing feature of the electronic controller and the natural gas engine as a function of user input, wherein said fuel features include a torque limit map, and producing control software to operate the controller as specified by said specifications.

21. A method of operating a computer to produce control software for an electronic controller for a natural gas engine or a diesel engine, the method comprising the steps of:

selecting a target device as one of a diesel engine controller and a natural gas engine controller;

defining a set of specifications of the electronic controller an the selected target device as a function of user input, wherein the selected target device is a natural gas engine and including the substeps of:

defining a set of air features of the electronic controlled and the natural gas engine as a function of used input, defining a set of fuel features of the electronic controller and the natural gas engine as a function of user input, and defining a set of timing features of the electronic controller and the natural gas engine as a function of user input, wherein said timing features include a timing retard map; and producing control software to operate the controller as specified by said specifications.

22. A method of operating a computer to produce control software for an electronic controller for a natural gas engine or a diesel engine, the method comprising the steps of:

selecting a target device as one of a diesel engine controller and a natural gas engine controller;

defining a set of specifications of the electronic controller an the selected target device as a function of user input, wherein the selected target device is a natural gas engine and including the substeps of:

defining a set of air features of the electronic controlled and the natural gas engine as a function of used input, defining a set of fuel features of the electronic controller and the natural gas engine as a function of user input, and defining a set of timing features of the electronic controller and the natural gas engine as a function of user input, wherein said timing features include a steady state timing map; and producing control software to operate the controller as specified by said specifications.

23. A method of operating a computer to produce control software for an electronic controller for a natural gas engine or a diesel engine, the method comprising the steps of:

(1) selecting a target device as one of a diesel engine controller and a natural gas engine controller;

(2) defining a set of specifications of the electronic controller and the selected target device as a function of user input, wherein the selected target device is a natural gas engine and including the steps of:

(i) defining a set of air features of the electronic controller and the natural gas engine as a function of user input, (ii) defining a set of fuel features of the electronic controller and the natural gas engine as a function of user input, and (iii) defining a set of timing features of the electronic controller and the natural gas engine as a function of user input, wherein said timing features include steady stage timing parameters; and (3) producing control software to operate the controller as specified by said specifications.

24. A method of operating a computer to produce control software for an electornic controller for a natural gas engine, the method comprising:

(1) selecting a target device as one of a diesel engine controller and a natural gas engine controller;

(2) defining a first set of engine core features of the electroinc controller and the natural gas engine as a function of user input in response to selecting said target device as the natural gas engine controller;

(3) defining a second set of engine core features of the electronic controller and the diesel engine as a function of user input in response to selecting said target device as the diesel engine controller;

(4) defining a set of specifications of the electronic controller and the selected target device as a function of user input, wherein said set of specifications include air features, fuel features, and timing features if said target device is said natural gas engine controller and said set of specifications include fuel features, timing features, and speed features if said target device is said diesel engine controller; and (5) producing control software to operate the controller as specified by said specifications.

* * * * *